US006769763B2

(12) United States Patent
Kurata et al.

(10) Patent No.: US 6,769,763 B2
(45) Date of Patent: Aug. 3, 2004

(54) CYLINDER PUMP, AN INK JET PRINTING SYSTEM USING THE CYLINDER PUMP AND A PHOTOGRAPH ASSEMBLY HAVING THE PRINTING SYSTEM

(75) Inventors: Tetsuji Kurata, Kanagawa (JP); Hirofumi Hirano, Kanagawa (JP); Yoshitaka Okamura, Kanagawa (JP); Keiji Takahashi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 329 days.

(21) Appl. No.: 09/947,477

(22) Filed: Sep. 7, 2001

(65) Prior Publication Data

US 2002/0039536 A1 Apr. 4, 2002

(30) Foreign Application Priority Data

Sep. 12, 2000 (JP) ..... 2000-277226
Mar. 21, 2001 (JP) ..... 2001-081642

(51) Int. Cl.[7] ..... B41J 2/175; B41J 2/165; F04F 11/00

(52) U.S. Cl. ..... 347/85; 347/30; 417/103

(58) Field of Search ..... 347/20, 30, 85, 347/86, 87; 417/44.2, 98, 97, 103, 104

(56) References Cited

U.S. PATENT DOCUMENTS 6,612,683 B2 * 9/2003 Takahashi et al. ..... 347/30

OTHER PUBLICATIONS

0018–8689–24–1A–255 Jun. 1981 IBM.*

* cited by examiner

*Primary Examiner*—Anh T. N. Vo
(74) *Attorney, Agent, or Firm*—Fitzpatrick, Cella, Harper & Scinto

(57) ABSTRACT

Down-sizing of a pump for sucking two types of different fluids is realized. The pump is provided with a cylinder pump having a cylinder main body having a reciprocally movable piston, a first cylinder chamber partitioned at one side of the piston for being introduced with a first fluid, and a second cylinder chamber partitioned at the other side of the piston for being introduced with a second fluid, and piston driving means for reciprocally moving the piston of the cylinder pump.

14 Claims, 48 Drawing Sheets

DURING STAND-BY

INK SUPPLY START POSITION (WASTE LIQUID HOLE OPEN)

VALVE SWITCHING POSITION

DURING STAND-BY

DURING INK SUPPLY

DURING INK SUCTION

DURING EMPTY SUCTION

DURING PRINTING

| STEP | OPERATION | OPERATION | JOINT LIFTER | | PISTON | | WIPER |
|---|---|---|---|---|---|---|---|
| | | | POSI-TION | MOVEMENT | POSI-TION | MOVEMENT | POSI-TION |
| | | | | | | | |
| S1 | STAND-BY | (HP) | 0.0 | | 0.0 | | 0.0 |
| S2 | CR INITIALIZE | CAP OPEN | -0.6 | -0.6 | 0.0 | | 0.0 |
| S3 | ↓ | (CR INITIALIZE) | -0.6 | | 0.0 | | 0.0 |
| S4 | JOINT | TO PUMP SUPPLY START POSITION | -0.6 | | -1.0 | -1.0 | 2.6 |
| S5 | ↓ | J-HP-OFF DETECTION (CAP CLOSE) | 0.1 | 0.7 | -1.0 | | 2.6 |
| S6 | ↓ | JOINT UP (ATMOSPHERE COMMUNICATION VALVE CLOSE) | 4.3 | 4.2 | -1.0 | | 2.6 |
| S7 | SUPPLY | P-HP-OFF DETECTION | 4.3 | | 0.2 | 1.2 | 0.0 |
| S8 | ↓ | INK SUPPLY (DISCHARGE) | 4.3 | | 19.0 | 18.8 | 0.0 |
| S9 | ↓ | WAIT (1.5 SEC STOP) | 4.3 | | 19.0 | | 0.0 |
| S10 | SUCTION | TO JOINT SUCTION POSITION | 2.3 | -2.0 | 19.0 | | 0.0 |
| S11 | ↓ | SUCTION | 2.3 | | 14.0 | -5.0 | 0.0 |
| S12 | EMPTY SUCTION | ATMOSPHERE COMMUNICATION VALVE OPEN | 1.5 | -0.8 | 14.0 | | 0.0 |
| S13 | ↓ | P-HP DETECTION | 1.5 | | 0.0 | -14.0 | 0.0 |
| S14 | ↓ | WIPER PROTRUSION | 1.5 | | -1.0 | -1.0 | 2.6 |
| S15 | CAP OPEN | J-HP DETECTION | 0.0 | -1.5 | -1.0 | | 2.6 |
| S16 | ↓ | CAP OPEN | -0.6 | -0.6 | -1.0 | | 2.6 |
| S17 | WIPING | (CR WIPING) | -0.6 | | -1.0 | | 2.6 |
| S18 | ↓ | WIPER RETREAT | -0.6 | | 0.0 | 1.0 | 0.0 |
| S19 | PRINTING | (PRINTING) | -0.6 | | 0.0 | | 0.0 |
| DURING CONTINUOUS PRINTING | ↓ | | -0.6 | | 0.0 | | 0.0 |
| S20 | WIPING | WIPER PROTRUSION | -0.6 | | -1.0 | -1.0 | 2.6 |
| S21 | ↓ | (CR WIPING) | -0.6 | | -1.0 | | 2.6 |
| S22 | ↓ | IPER RETREAT | -0.6 | | 0.0 | 1.0 | 0.0 |
| S23 | ↓ | (CR-HP) | -0.6 | | 0.0 | | 0.0 |
| END S24 | STAND-BY | CAP CLOSE | 0.0 | 0.6 | 0.0 | | 0.0 |
| | | | | | | | |

FIG.29

JOINT LIFTER

| | DRIVING POSITION |
|---|---|
| UPPER LIMIT | 4.80 |
| SUPPLY | 4.30 |
| SUCTION | 2.30 |
| EMPTY SUCTION | 1.50 |
| HP STAND-BY | 0.00 |
| PRINTING | -0.60 |
| LOWER END | -1.10 |

PUMP PISTON

| | DRIVING POSITION |
|---|---|
| RIGHT END | 19.50 |
| SUCTION START | 19.00 |
| EMPTY SUCTION START | 15.00 |
| HP STAND-BY | 0.00 |
| WIPER PROTRUSION | -1.00 |
| SUPPLY START | -1.00 |
| LEFT END | -1.50 |

SUPPLY JOINT CONNECTION

CYLINDER PUMP, AN INK JET PRINTING SYSTEM USING THE CYLINDER PUMP AND A PHOTOGRAPH ASSEMBLY HAVING THE PRINTING SYSTEM

This application is based on Japanese Patent Application Nos. 2000-277226 filed Sep. 12, 2000 and 2001-081642 filed Mar. 21, 2001, the content of which is incorporated hereinto by reference.

BACKGROUND OF THE INVENTION

1. Field of the Invention

The present invention relates to a cylinder pump suitable for sucking two different types of liquid and an ink jet printing system using the cylinder pump, specifically to an improvement for down-sizing of the cylinder pump. The present invention further relates to a photograph assembly having an ink jet printing system provided with the down-sized cylinder pump.

2. Description of the Prior Art

As an ink jet printing system, there has heretofore been a so-called serial scan type equipped replaceably with a recording head as recording means and an ink tank as an ink vessel on a carriage movable in a main scanning direction. This printing method successively prints an image on a printing medium by repeating main scanning of a carriage equipped with the recording head and an ink tank and sub-scanning of the printing medium.

When considering realization of an ultra-compact printer suitable for use in PDA (Personal Digital Assistants) or cameras, it is necessary to reduce the size of the carriage itself. Therefore, the ink volume of the ink tank equipped thereon must be extremely small.

When the ink tank volume on the carriage is extremely small as described above, there is a possibility of generating a problem in that replacement frequency of the ink tank becomes high or the ink tank must be replaced in the course of printing operation.

Then, in order to solve such a problem, there is proposed an ink supply method in which ink is supplied from a separately provided main tank to a sub-tank on the carriage at an appropriate timing every time the carriage is positioned at a predetermined stand-by position, hereinafter for convenience called a pit-in ink supply method.

In this pit-in ink supply method, for example, every time a sheet of printing medium is printed, the carriage is positioned at a predetermined stand-by position, the sub-tank on the carriage and the main tank are connected at an appropriate timing, so that with this connection state, ink is supplied from the main tank to the sub-tank. By this operation, the above-described problem with the ink volume of the sub-tank on the carriage is solved.

In the above-described pit-in ink supply method, an ink absorber such as a sponge is provided inside the sub-tank, ink supply is performed by a negative pressure introduced from an air suction opening to the inside, so that ink is introduced from the main tank into the sub-tank through the ink intake.

Further, in the ink jet printing method, when air influxes into the nozzle of the recording head, or when ink increases in viscosity by drying or the like, the nozzle becomes ink ejection impossible, and ink droplets cannot be ejected from such a nozzle. Therefore, a capping member for covering a face of the recording head and suction means for sucking ink from the nozzle of the recording head through the capping member are provided so that ink which does not contribute to image printing is sucked and removed from the tip of the nozzle at an appropriate time.

As described above, in ink jet printing using the pit-in ink supply method, a suction pump is required for sucking air for ink supply and for sucking ink from the recording head.

As the suction pump, there has heretofore been a tube pump for generating a negative pressure in the cap utilizing the restoration force of a tube squeezed by a roller or a piston pump utilizing a movement of a piston, or the like.

In the case of the tube pump, since a rotary mechanism for rotating the roller for squeezing the tube is required, the mechanism itself becomes large in size. Therefore, it is not suited as a suction pump for the above-described ultra-compact printer.

In the case of the piston pump, since it is a reciprocal type, it is suited as a suction pump for ultra-compact printer. However, also in the case of the piston pump, there are problems of requiring a suction pump which is large in construction such that, (1) separate pumps are used for ink suction and air suction, (2) when a common pump is used for ink suction and air suction, a suction switching construction is necessary for switching the ink suction passage and the air suction passage for connecting to the input port of the pump.

As described above, for realizing an ultra-compact ink jet printer suitable for PDA or camera, construction of the suction pump part suitable for ultra-compact structure has been in demand.

Under such circumstances, it is therefore an object of the present invention to provide a cylinder pump which can be constructed small in structure and is suitable for sucking two different types of liquid and an ink jet printing system using the cylinder pump.

SUMMARY OF THE INVENTION

In an aspect of the present invention, a cylinder pump unit comprises a cylinder pump and a piston driving means. The cylinder pump includes a reciprocally movable piston and a cylinder main body having a first cylinder chamber partitioned at one side of the piston and introduced with a first fluid and a second cylinder chamber partitioned at the other side of the piston and introduced with a second fluid.

The piston driving means reciprocally moves the piston of the cylinder pump.

In another aspect of the present invention, the first fluid is air, the second fluid is ink and a piston shaft of the piston is extended to outside the cylinder main body through the second cylinder chamber and connected to the piston drive means.

In another aspect of the present invention, the second cylinder chamber has an input port for sucking ink and an output port for discharging ink. A cylinder pump unit further comprises port switching means for performing switching of opening and closing of the input port and output port in association with movement of the piston. Therefore, when the second cylinder chamber is pressure reduced by movement of the piston, the output port is closed and the input port is opened, and when the second cylinder chamber is pressurized by movement of the piston, the input port is closed and the output port is opened. The port switching means is incorporated preferably in the second cylinder chamber.

In another aspect of the present invention, the second cylinder chamber may have an input port for sucking ink, the piston shaft has a hollow cylindrical form, and the hollow part may be an output port for discharging ink. The cylinder pump unit further comprises port switching means for performing switching of opening and closing of the input port and output port in association with movement of the piston. Therefore, when the second cylinder chamber is pressure reduced by movement of the piston, the output port is closed and the input port is opened, when the second cylinder chamber is pressurized by movement of the piston, the input port is closed and the output port is opened.

In another aspect of the present invention, the port switching means is a check valve provided in a passage communicating with the input port and a check valve provided between the piston and the piston shaft.

In another aspect of the present invention, the piston driving means comprises a screw rod engaging with the piston shaft in the piston shaft and rod driving means for rotatively driving the screw rod.

In another aspect of the present invention, the piston driving means may comprise a pump driving arm for connecting through the piston shaft, a lead screw engaging with the pump driving arm for reciprocally driving the pump driving arm and screw driving means for rotatively driving the lead screw.

In another aspect of the present invention, the first cylinder chamber may be connected with an air suction part provided with a porous film in an ink tank. The air suction part introduces a negative pressure that supplies ink from intake into the ink tank. The piston shaft is a hollow cylindrical body and provided with a relief valve at a tip of the piston shaft for maintaining suction pressure of the first cylinder chamber at less than a predetermined pressure. A setting relief pressure of the relief valve is preferably set smaller than a pressure capable of maintaining performance of the porous film.

In another aspect of the present invention, cross sectional form of the cylinder pump may be elliptical.

In another aspect of the present invention, an ink jet printing apparatus comprises an ink tank, a cap, a cylinder pump and piston driving means. The ink tank has an air suction part provided with a porous film, the air suction part introduces a negative pressure that supplies ink from an intake into the ink tank. The cap caps an ink ejection opening of a recording head capable of ejecting ink supplied from the ink tank. The cylinder pump includes a reciprocally movable piston, a cylinder main body having a first cylinder chamber partitioned at one side of the piston and connected with the air suction part, and a second cylinder chamber partitioned at the other side of the piston and connected with the cap. The piston driving means reciprocally moves the piston of the cylinder pump. Air in the ink tank is sucked through the air suction part of the ink tank by the first cylinder chamber of the cylinder pump, and ink is sucked from the cap by the second cylinder chamber of the cylinder pump.

The above and other objects, effects, features and advantages of the present invention will become more apparent from the following description of embodiments thereof taken in conjunction with the accompanying drawings.

BRIEF DESCRIPTION OF THE DRAWINGS

FIG. 29 is a diagram showing an example of operation sequence of the ink supply recovery processing;

FIG. 32 is a conceptual diagram showing state of each part of the ink supply recovery system during stand-by;

DETAILED DESCRIPTION OF THE PREFERRED EMBODIMENTS

In the following, embodiments of the present invention will be described with reference to the drawings.

In the present specification, "printing" (also referred to as "recording" in some cases) means not only a condition of forming significant information such as characters and drawings, but also a condition of forming images, designs, patterns and the like on printing medium widely or a condition of processing the printing mediums, regardless of significance or unmeaning or of being actualized in such manner that a man can be perceptive through visual perception.

Also, a "printer" and a "recording apparatus" mean not only one complete apparatus for carrying out a printing but also an apparatus having a function for printing.

Further, the "printing medium" means not only a paper used in a conventional printing apparatus but also everything capable of accepting inks, such like fabrics, plastic films, metal plates, glasses, ceramics, wood and leathers, and in the following, will be also represented by a "sheet" or simply by a "paper".

Further, in the present specification, a "camera" indicates an apparatus or device that optically photographs an image and converts the photographed image into electrical signals, and in the following explanation, is also referred to as a "photographing section".

Still further, an "ink" (also referred to as "liquid" in some cases) should be interpreted in a broad sense as well as a definition of the above "printing" and thus the ink, by being applied on the printing mediums, shall mean a liquid to be used for forming images, designs, patterns and the like, processing the printing medium or processing inks (for example, coagulation or encapsulation of coloring materials in the inks to be applied to the printing mediums).

Meantime, one embodiment of a head to which the present invention is advantageously employed is the embodiment in which a thermal energy generated by an electrothermal converter is utilized to cause a film boiling to the liquid resulting in a formation of bubbles.

[Basic Structure]

Firstly, a basic structure of a device according to the present invention will be explained in view of FIGS. 1 to 14. The device explained in the present embodiments is constituted as an information processing equipment comprising a photographing section for optically photographing an image and then converting the photographed image into an electric signals (hereinafter, also referred to as "camera section") and an image recording section for recording image on the basis of thus obtained electric signals (hereinafter, also referred to as "printer section"). Hereinafter, the information processing equipment in the present embodiments is explained in the name of a "printer-built-in camera".

Figure 5:
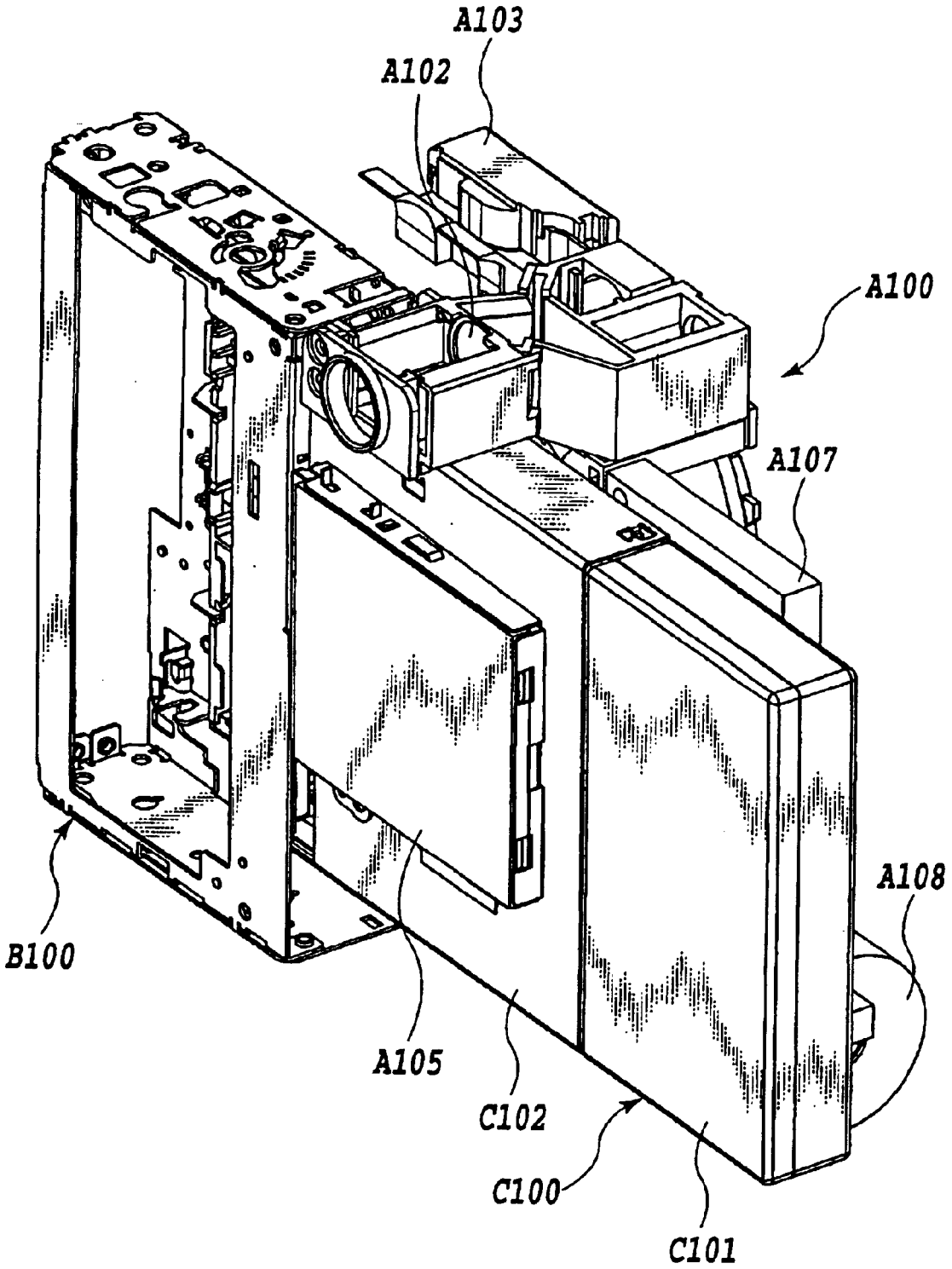
FIG. 5 is a perspective view showing an arrangement of the main components within the camera in FIG. 1.

In a main body A001, there is incorporated a printer section (recording apparatus section) B100 at the backside of a camera section A100 in an integral manner. The printer section B100 records an image by using inks and printing mediums which are supplied from a medium pack C100. In the present structure, as apparent from FIG. 5 illustrating the main body A001 viewing from the backside with an outer package removed, the medium pack C100 is inserted at the right hand of the main body A001 in FIG. 5 and the printer section B100 is arranged at the left hand of the main body A001 in FIG. 5. In the case of performing a recording by the printer section B100, the main body A001 can be placed facing a liquid crystal display section A105 up and a lens A101 down. In this recording position, a recording head B120 of the printer section B100, which will be described below, is made to be positioned to eject inks in the downward direction. The recording position can be made to be the same position as that of photographing condition by the camera section A100 and thus is not limited to the recording position as mentioned above. However, in view of a stability of a recording operation, the recording position capable of ejecting the inks in the downward direction is preferred.

There follows the explanations of the basic mechanical structure according to the present embodiment under the headings of 1 as "Camera Section", 2 as "Medium Pack" and 3 as "Printer Section", and of the basic structure of the signal processing under the heading of 4 as "Signal Processing".

1: Camera Section

Figure 1:
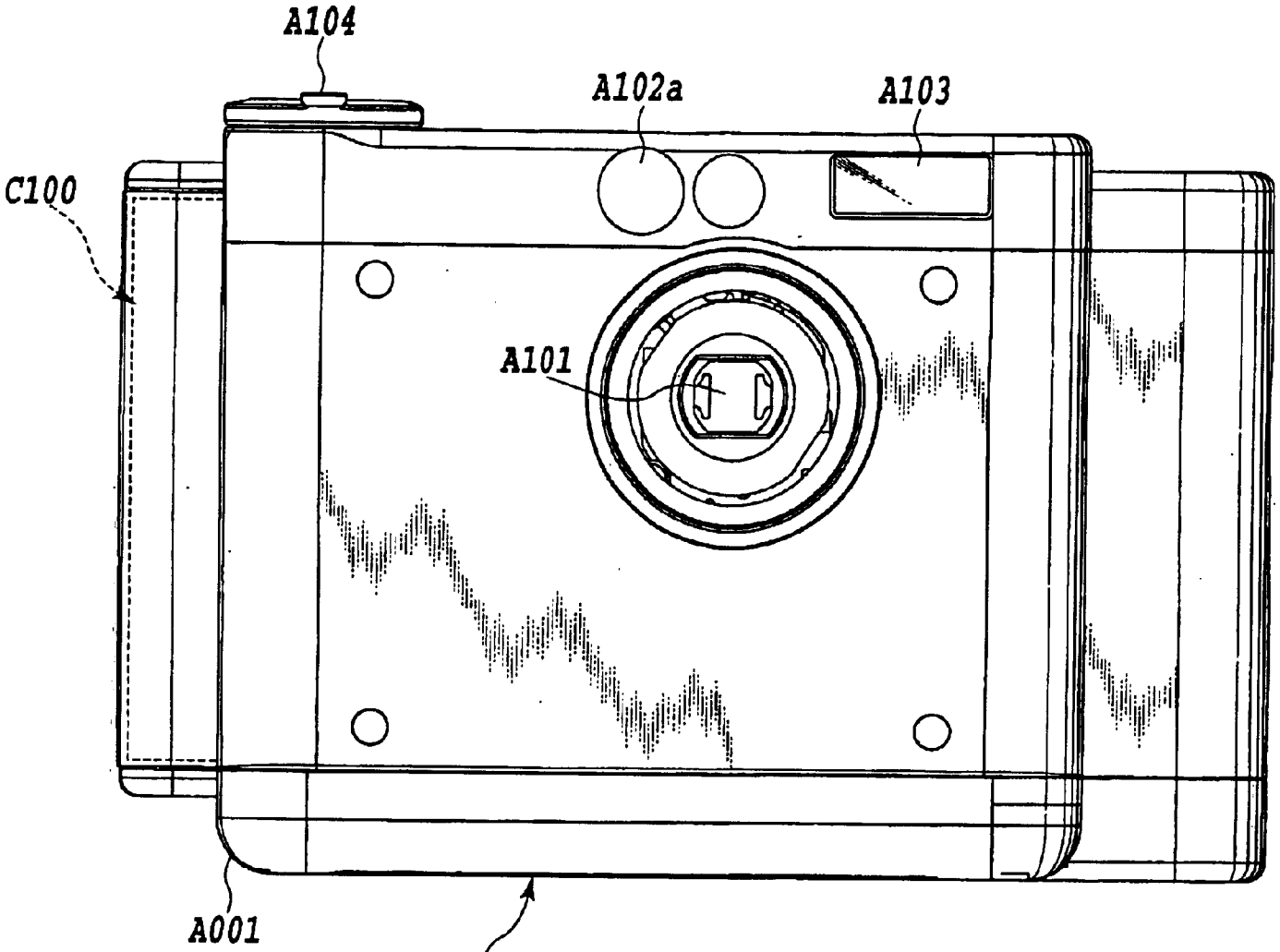
FIG. 1 is a front elevation view of a printer-built-in camera to which the present invention is applicable.
Figure 2:
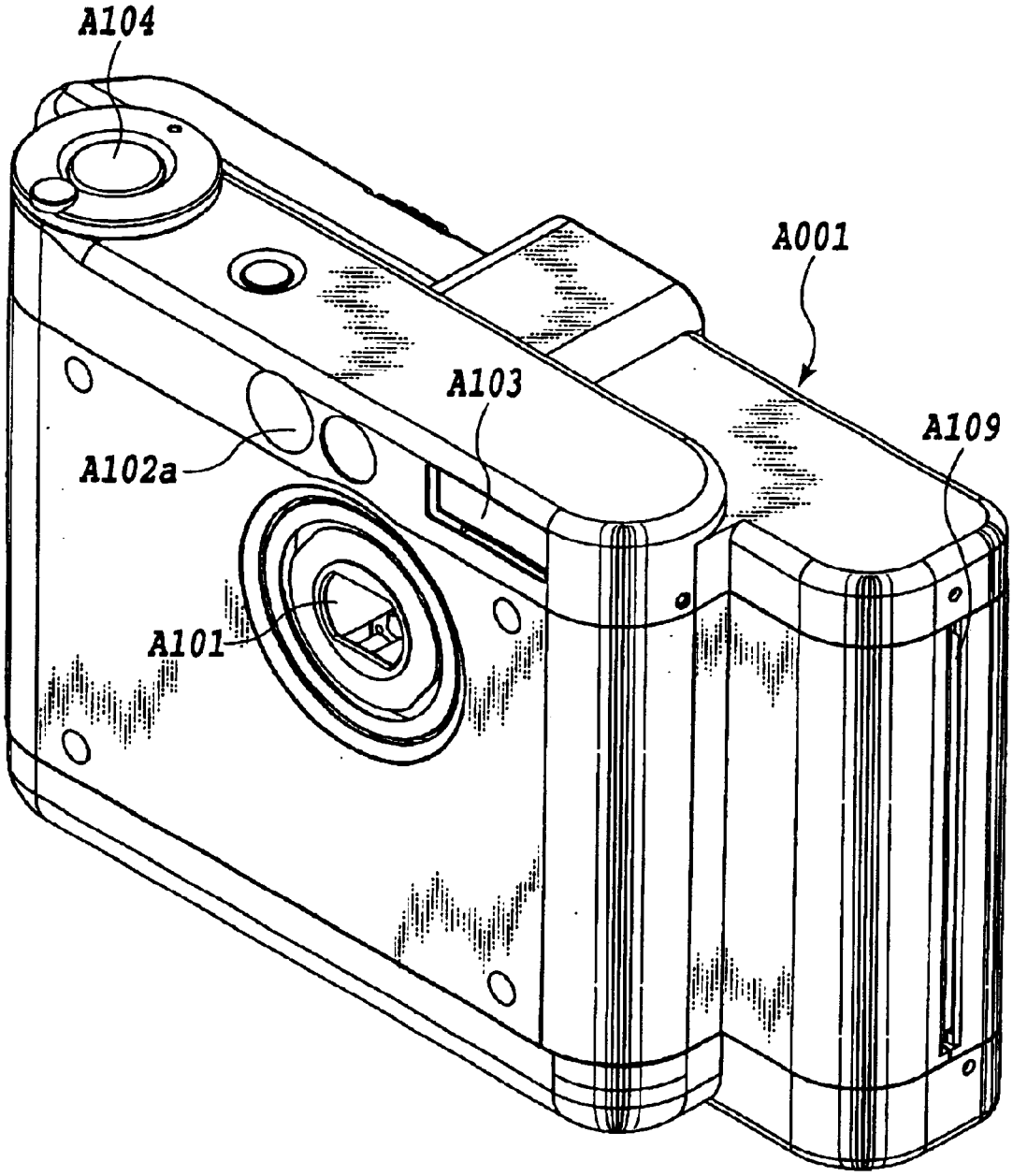
FIG. 2 is a perspective view of the camera in FIG. 1 viewing diagonally from the front thereof.
Figure 3:
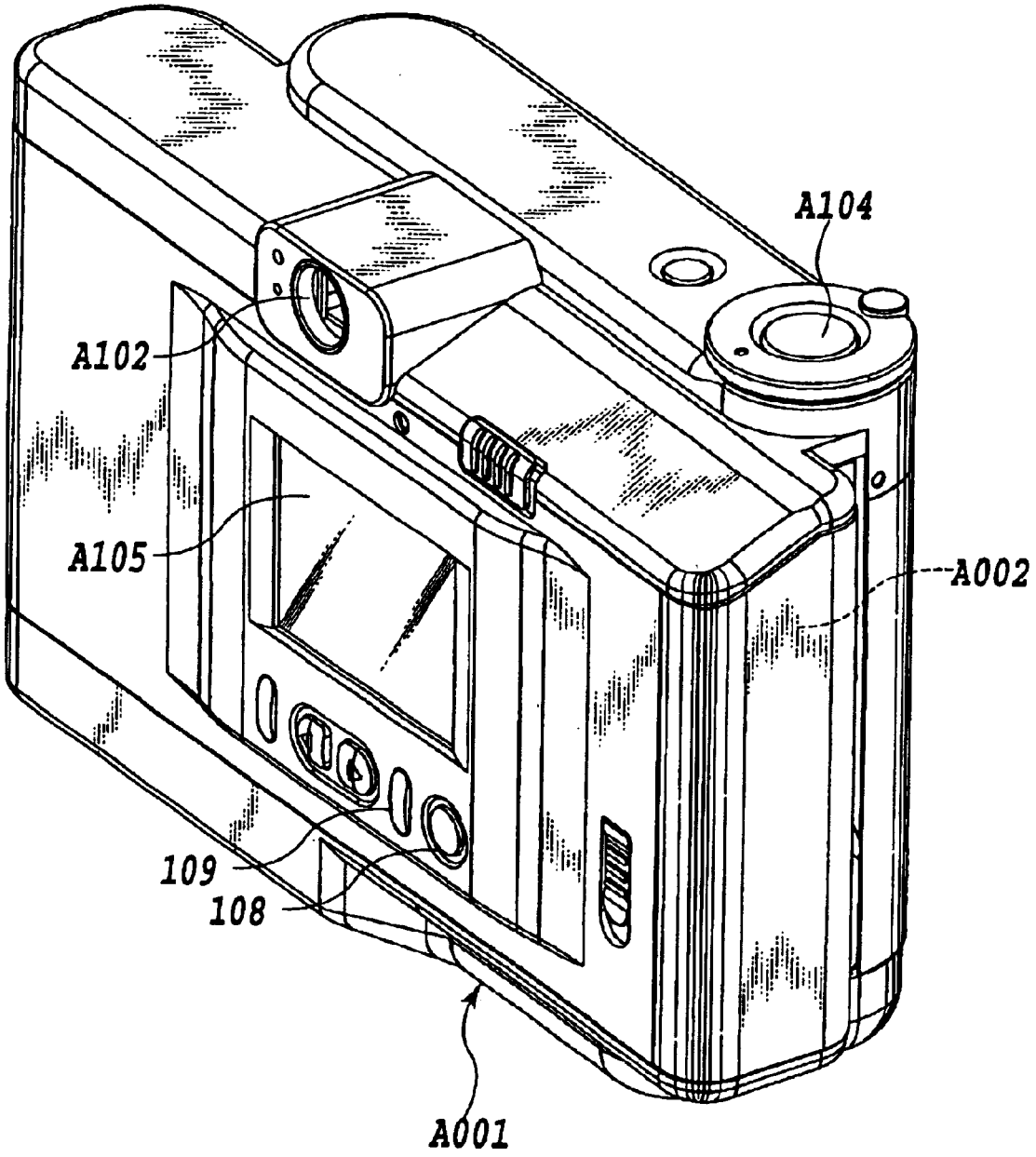
FIG. 3 is a perspective view of the camera in FIG. 1 viewing diagonally from the back thereof.

The camera section A100, which basically constitutes a conventional digital camera, constitutes the printer-built-in digital camera having an appearance in FIGS. 1 to 3 by being integrally incorporated into the main body A001 together with a printer section B100 described below. In FIGS. 1 to 3, A101 denotes a lens; A102 denotes a viewfinder; A102*a* denotes a window of the viewfinder; A103 denotes a flush; A104 denotes a shutter release button; and A105 denotes a liquid crystal display section (outer display section). The camera section A100, as described below, performs a processing of data photographed by CCD, a recording of the images to a compact flash memory card (CF card) A107, a display of the images and a transmission of various kinds of data with the printer section B100. A109 denotes a discharge part for discharging a printing medium C104 on which the photographed image is recorded. A108, as shown in FIG. 5, is a battery as a power source for the camera section A100 and the printer section B100.

2: Medium Pack

Figure 4:
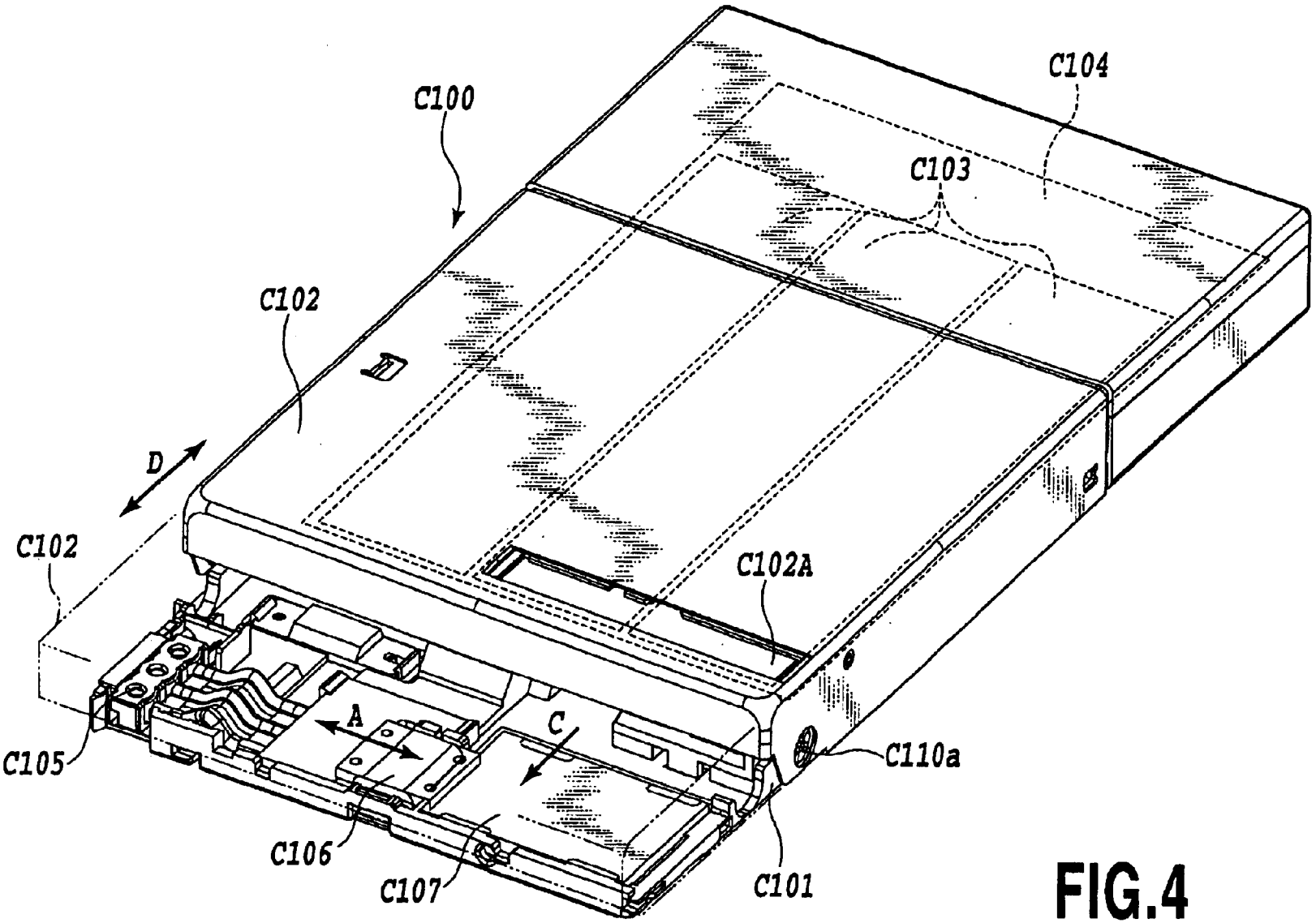
FIG. 4 is a perspective view of a medium pack insertable to the camera in FIG. 1.

A medium pack C100 is detachable relating to a main body A001 and, in the present embodiment, is inserted through an inserting section A002 of the main body A001 (see FIG. 3), thereby being placed in the main body A001 as shown in FIG. 1. The inserting section A002 is closed as shown in FIG. 3 when the medium pack C100 is not inserted therein, and is opened when the medium pack is inserted therein. FIG. 5 illustrates a status wherein a cover is removed from the main body A001 to which the medium pack C100 is inserted. As shown in FIG. 4, a shutter C102 is provided with a pack body C101 of the medium pack C100 in such manner being slidable in an arrow D direction. The shutter C102, which slides to stay at a position indicated by the two-dots-and-dushed lines in FIG. 4 when the medium pack C100 is not inserted in the main body A001, while slides to a position indicated by the solid lines in FIG. 4 when the medium pack C100 is placed in the main body A001.

The pack body 101 contains ink packs C103 and printing mediums C104. In FIG. 4, the ink packs C103 are held under the printing mediums C104. In the case of the present embodiment, three ink packs C103 are provided so as to separately hold the inks of Y (yellow), M (magenta) and C (cyan), and about twenty sheets of the printing mediums C104 are stored in pile. A suitable combination of those inks and the printing mediums C104 for recording an image is selected to be stored within the medium pack C100. Accordingly, the various medium packs C100 each having a different combination of the inks and the printing mediums (for example, medium packs for super high-quality image; for normal image; and for sealing (seal partitioning)) are prepared and, according to a kind of images to be recorded and an use of the printing medium on which an image is formed, those medium packs C100 are selectively inserted in the main body A001, thereby being able to perform an ensured recording of the images in compliance with the purpose by employing the most suitable combination of the ink and the printing medium. Further, the medium pack C100 is equipped with the below-mentioned EEPROM to which is recorded the identification data such as kinds or remaining amounts of the inks and the printing mediums contained in the medium pack.

The ink pack C103, upon the medium pack C100 is inserted in the main body A001, is connected to an ink supplying system in the main body A001, through three joints C105 each corresponding to the respective inks of Y, M and C. On the other hand, the printing mediums C104 are separated one by one using a separating mechanism which is not shown in the figures and then sent to a direction of an arrow C by a paper feeding roller C110 (see FIG. 9). A driving force of the paper feeding roller C110 is supplied from an after-mentioned conveying motor M002 (see FIG. 9) provided on the main body A001 through a connecting portion C110*a*.

Further, the pack body C101 comprises a wiper C106 for wiping a recording head of the after-mentioned printer section, and an ink absorption body C107 for absorbing the abolished inks discharged from the printer section. The recording head in the printer section reciprocates in a direction of the main scanning direction as indicated by an arrow A in such manner describing below. When the medium pack C100 is in the status of being removed from the main body A001, the shutter C102 slides to an position indicated by the two-dots-and-dashed lines in FIG. 4 to protect the joints C105, the wiper C106, the ink absorbing body C107 and so on.

3: Printer Section

The printer section B100 according to the present embodiment is a serial type employing an ink jet recording head. This printer section B100 is explained under the headings of 3-1 "Printing Operating Section"; 3-2 "Printing Medium Carrying"; and 3-3 "Ink Supplying System", respectively.

3-1: Printing Operating Section

Figure 6:
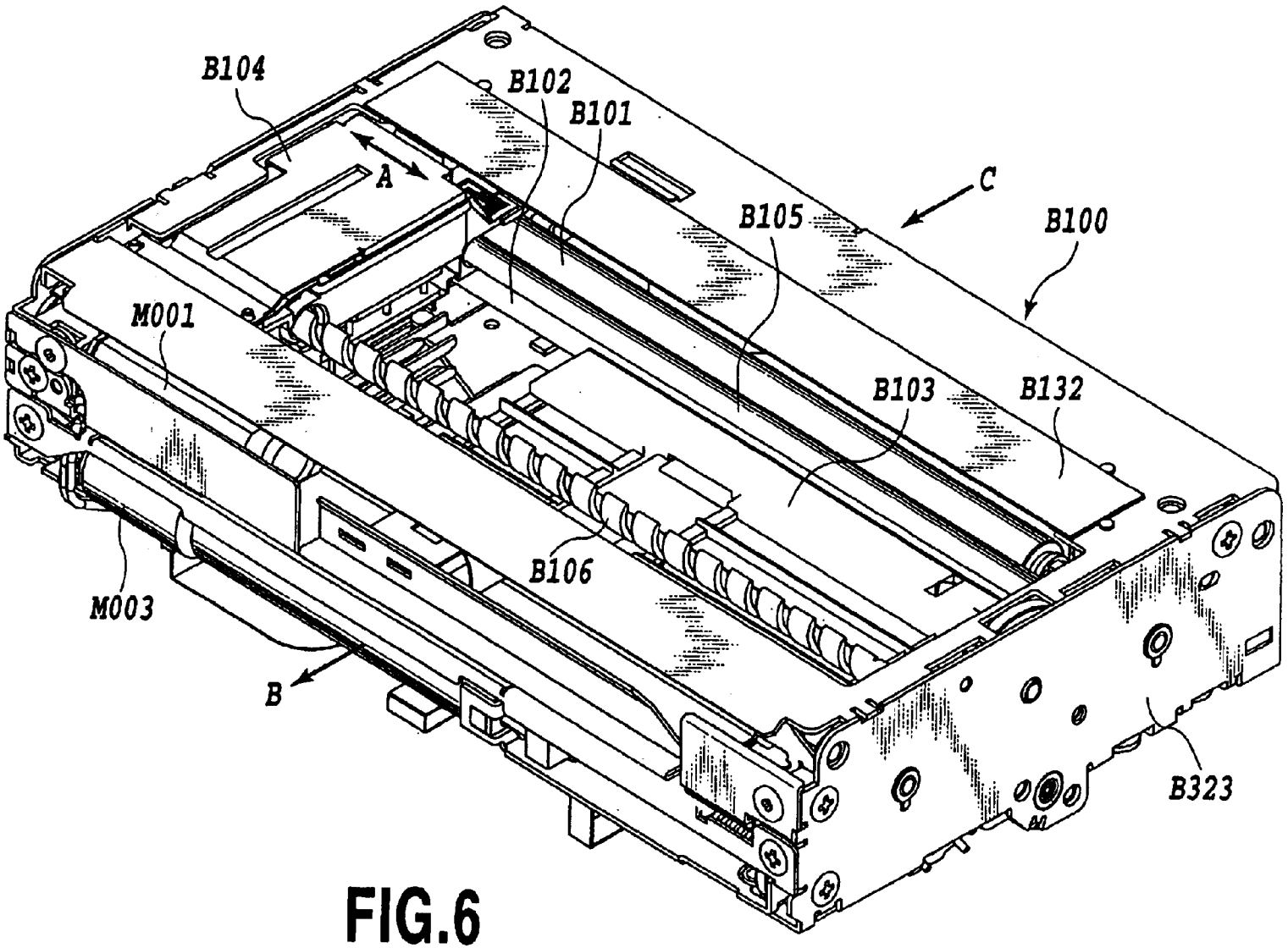
FIG. 6 is a perspective view of a printer section in FIG. 5.
Figure 7:
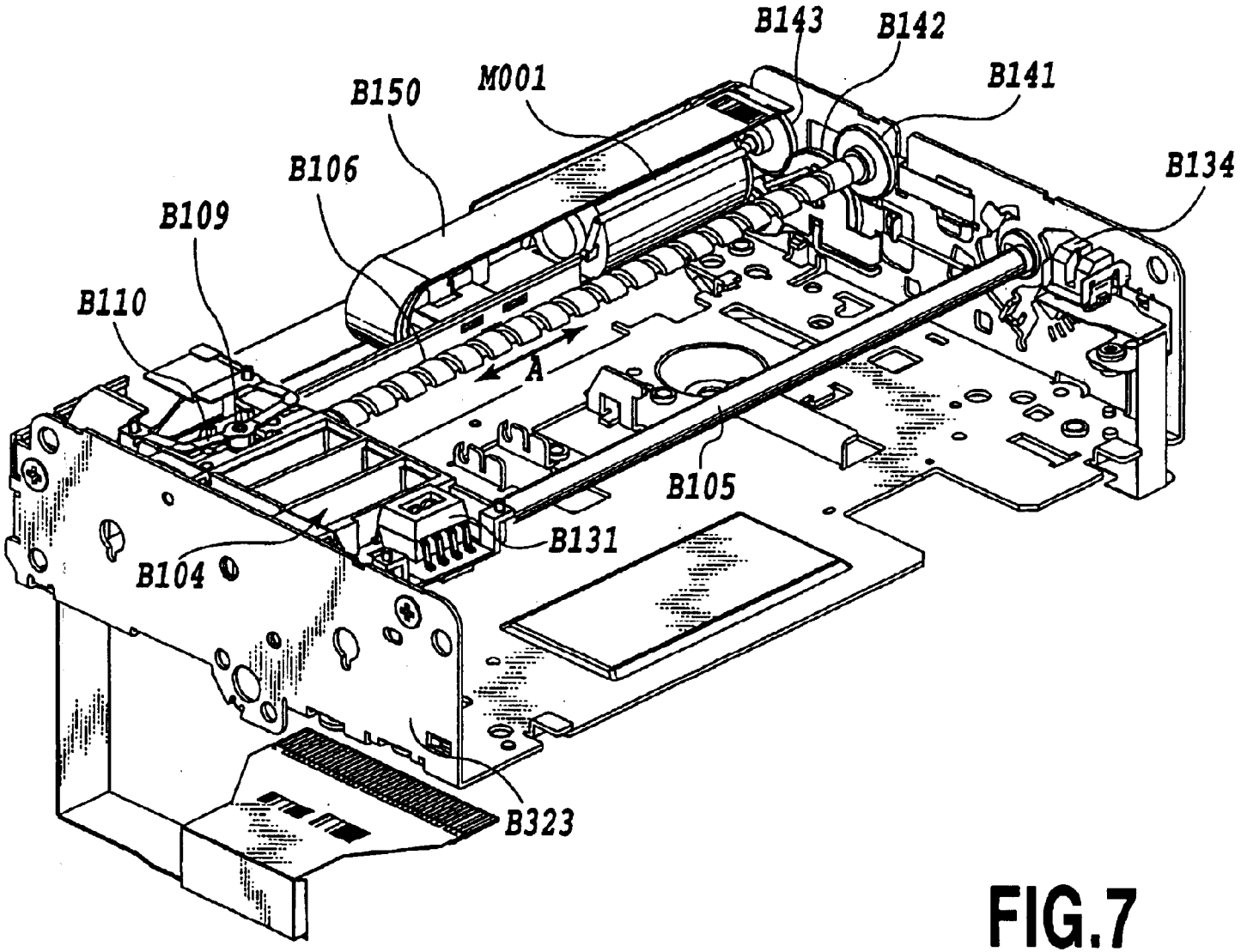
FIG. 7 is a perspective view in which a portion of the printer section in FIG. 6 is dislodged.

FIG. 6 is a perspective view illustrating the entire printer section B100, and FIG. 7 is a perspective view illustrating the printer section B100 with a part partially taken out.

At a predetermined position in the main body of the printer section B100, a tip portion of the medium pack C100 is positioned when the medium pack C100 is placed in the main body A001 as shown in FIG. 5. The printing medium C104 sent to the direction of an arrow C from the medium pack C100, while being sandwiched between a LF roller B101 and a LF pinch roller B102 of the below-mentioned printing medium carrying system, is carried to the sub-scanning direction indicated by an arrow B on a pressure plate B103. B104 denotes a carriage which reciprocates toward a main scanning direction indicated by an arrow A along a guiding shaft B105 and a leading screw B106.

Figure 8:
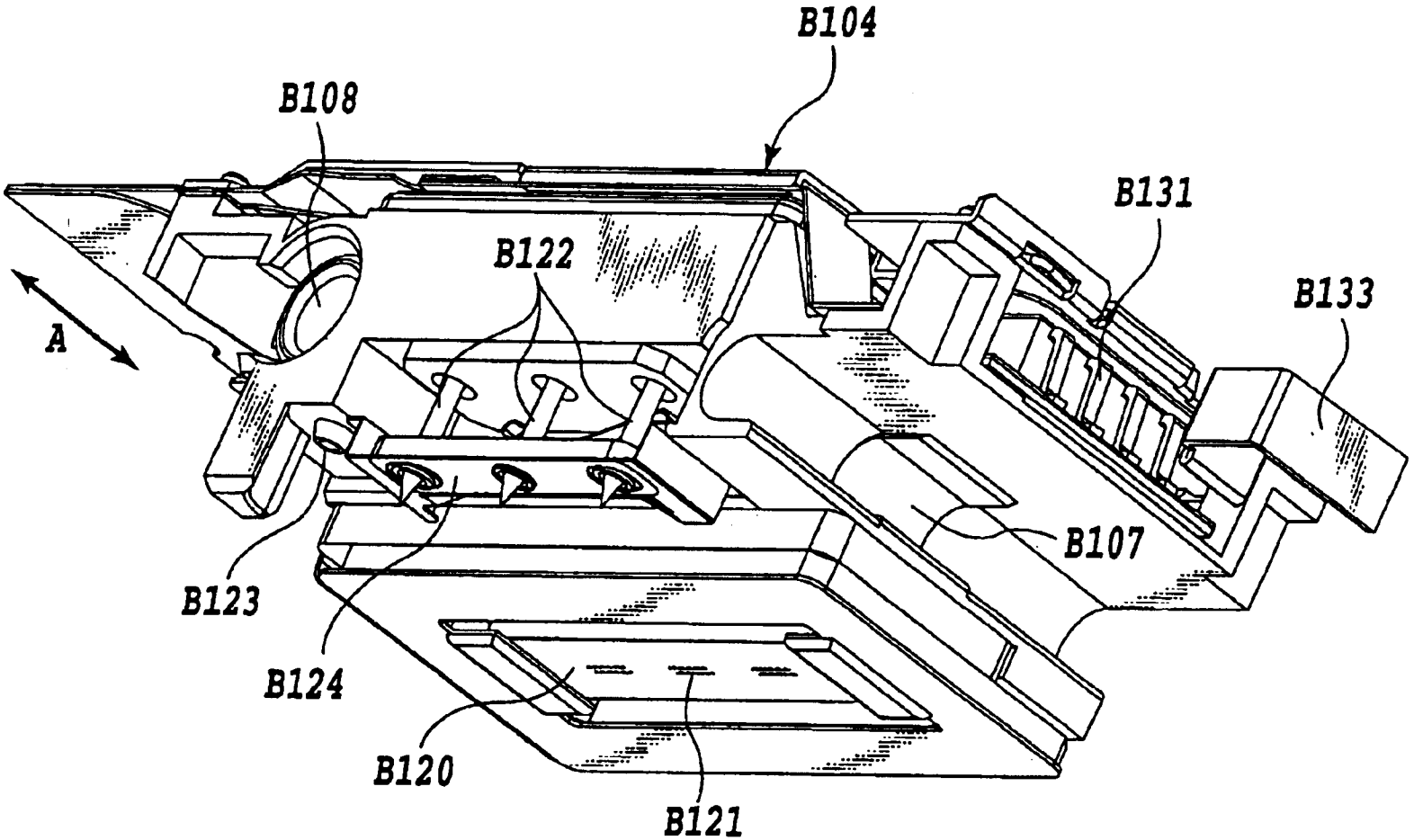
FIG. 8 is a perspective view of a carriage of the printer in FIG. 6.

As shown in FIG. 8, the carriage B104 is provided with a bearing B107 for a guiding shaft B105 and a bearing B108 for a leading screw B106. At a fixed position of the carriage B104, as shown in FIG. 7, a screw pin B109 projecting toward an interior of the bearing B108 is installed by a spring B110. A fit of a tip of the screw pin B109 to a helical thread formed on the outer circumference of the leading screw 13106 converts a rotation of the leading screw B106 to a reciprocating movement of the carriage B104.

The carriage B104 is equipped with an ink jet recording head B120 capable of ejecting the inks of Y, M and C, and a sub-tank (not shown) for reserving inks to be supplied to the recording head B120. On the recording head B120, a plurality of ink ejection openings B121 (see FIG. 8), which are aligned with the direction crossing with the main scanning direction indicated by the arrow A (in the present embodiment, an orthogonal direction), are formed. The ink ejection openings B121 form nozzles capable of ejecting inks supplied from the sub-tank. As a generating means of energy for discharging the inks, an electro-thermal converting element equipped with each of the nozzles may be used. The electro-thermal converting element generates bubble in the inks within the nozzle by a heating and thus generated foaming energy causes an ejection of the ink droplet from the ink ejection opening B121.

The sub-tank has a capacity smaller than the ink packs C103 contained in the media pack C100 and made to be a sufficient size for storing a required amount of ink for recording an image corresponding to at least one sheet of printing medium C104. In the sub-tank, there are ink reserving sections for each of the inks of Y, M and C, on each of which is formed the ink supplying section and the negative pressure introducing sections, wherein those ink supplying sections are individually connected to the corresponding three hollow needles B122 and those negative pressure introducing sections are also connected to a common air suction opening B123. Such ink supplying sections, as will be mentioned below, are supplied with inks from the ink packs C103 in the medium pack C100 when the carriage B104 moves to a home position as illustrated in FIG. 6.

In the carriage B104 in FIG. 8, B124 denotes a needle cover which is moved to a position for protecting the needles B122 by the force of the springs as illustrated in FIG. 8 when the needles B122 and the joints C105 are not mated each other, and which releases a protection of the needles B122 by being pushed upwardly against the force of the springs in FIG. 8 when the needles B122 and the joints C105 are mated with each other. A movement position of the carriage B104 is detected by an encoder sensor B131 on the carriage B104 and a linear scale B132 (see FIG. 6) on the main body of the printer section B100. Also, a fact that the carriage B104 moves to the home position is detected by a HP (home position) flag B133 on the carriage B104 and a HP sensor B134 (see FIG. 7) on the main body of the printer section B100.

In FIG. 7, at the both ends of the guiding shaft B105, supporting shafts (not shown) are provided at a position eccentric to the center axis of the guiding shaft. The guiding shaft B105 is turned and adjusted upon the supporting shaft, thereby controlling a height of the carriage 104, resulting in achieving an adjustment of a distance between the recording head B120 and the printing medium C104 on the pressure plate B103. The leading screw B106 is rotatably driven by a carriage motor M001 through a screw gear B141, an idler gear B142 and a motor gear B143. B150 denotes a flexible cable for electrically connecting the after-mentioned controlling with the recording head B120.

The recording head B120 moves together with the carriage B104 toward the main scanning direction indicated by the arrow A and concurrently ejects the inks from the ink ejection openings B121 in accordance with the image signals, thereby recording an image corresponding to one band on the printing medium on the pressure plate B103. An alternate repeat of a recording operation of an image corresponding to one band by such recording head B120 and a conveying operation of the predetermined amount of the printing medium toward the sub-scanning direction indicated by the arrow B by means of the below-mentioned printing medium conveying system enables a sequential recording of the images on the printing medium.

3-2: Printing Medium Carrying

Figure 9:
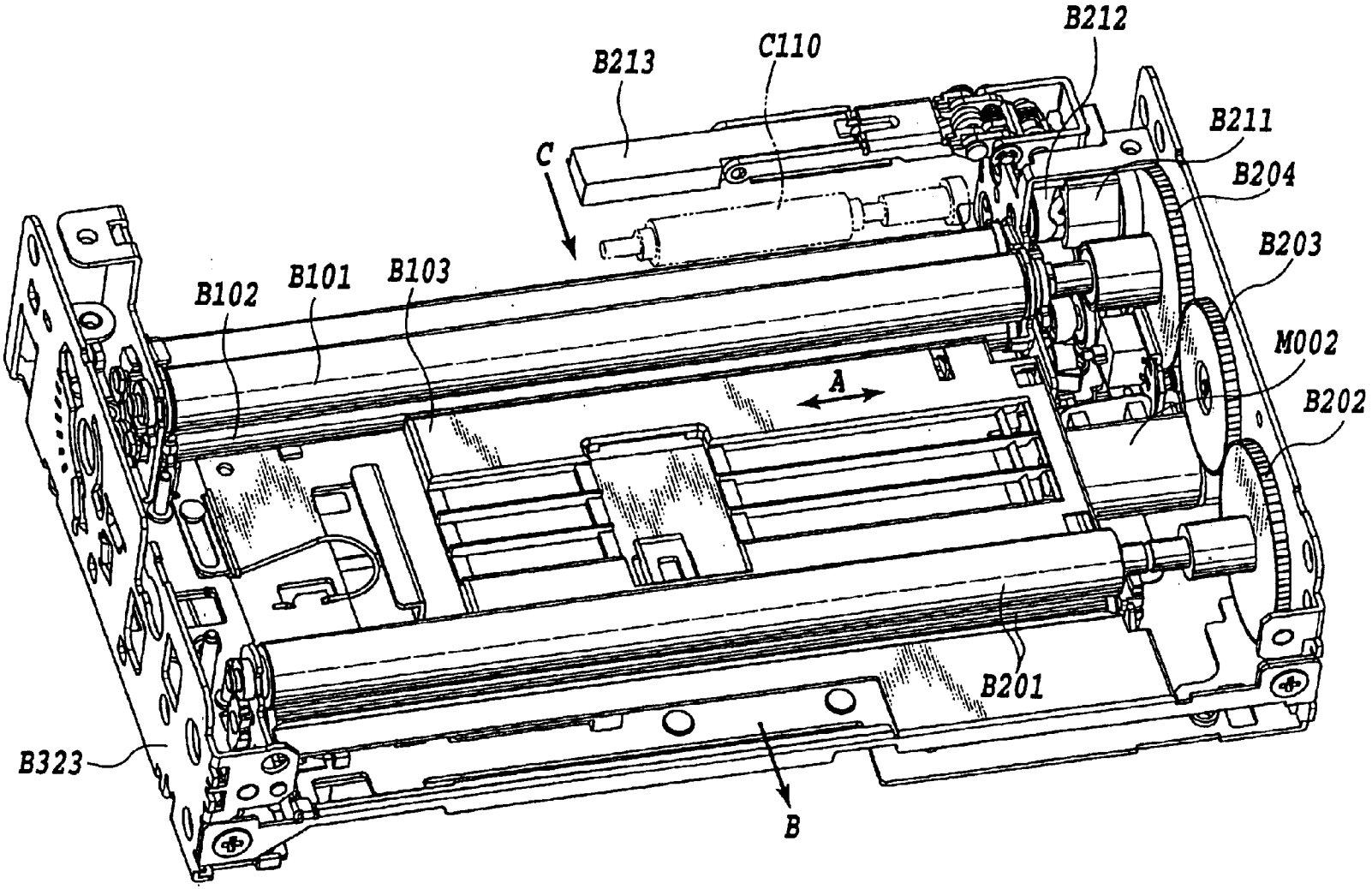
FIG. 9 is a perspective view of a component part of a printing medium carrying of the printer section in FIG. 6.

FIG. 9 is a perspective view showing a component of the printing medium conveying system of the printer section B100. In FIG. 9, B201 denotes a pair of paper delivering rollers, and the upper one of the paper delivering rollers B201 in FIG. 9 is driven by a conveying motor M002 through the paper delivering roller gear B202 and a junction gear B203. Likewise, the aforementioned LF roller B101 is driven by the conveying motor M002 through a LF roller gear B204 and the junction gear B203. The paper delivering roller B201 and the LF roller B101 convey the printing medium C104 toward the sub-scanning direction indicated by the arrow B by a driving force of the conveying motor M002 rotating in the forward direction.

On the other hand, when the conveying motor M002 couterrotates, a pressure plate head B213 and a locking mechanism which is not shown are driven through a switching slider B211 and a switching cam B212, while a driven force is transmitted to the paper feeding roller C110 on the medium pack C100. That is, the pressure plate head B213 pressurizes the printing mediums C104, which are piled up within the medium pack C100, in a downward direction in FIG. 4 by a driven force caused by a reverse rotation of the carrying motor M002, through a window portion C102A (see FIG. 4) of a shutter C102 of the medium pack C100. As a result thereof, the printing medium C104 positioned at the lowest position in FIG. 4 is pressed against the feeding roller C110 in the medium pack C100. Also, the locking mechanism which is not shown locks the medium pack C100 to the main body A001 to inhibit a removal of the medium pack C100. The feeding roller C110 of the medium pack C100 feeds one piece of the printing medium C104 at the lowest position in FIG. 4 toward the direction indicated by the arrow C as a result that the driven force caused by the reverse rotation of the conveying motor M002 is transmitted.

As stated above, only one piece of printing medium C104 is taken out from the medium pack C100 toward the direction indicated by the arrow C by the reverse rotation of the conveying motor M002, and then a forward rotation of the conveying motor M002 conveys the printing medium C104 to the direction indicated by the arrow B.

3-3: Ink Supplying System

Figure 10:
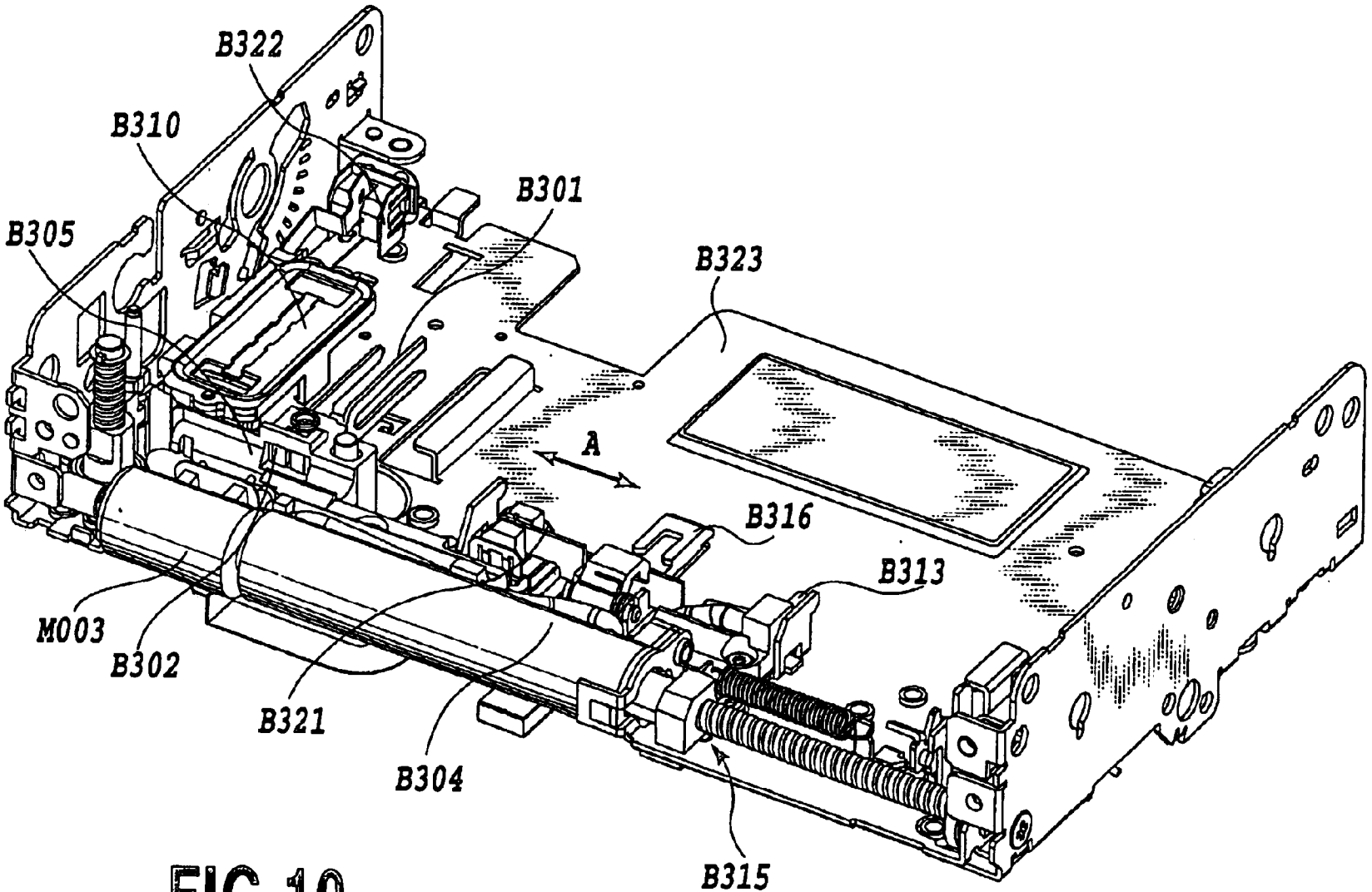
FIG. 10 is a perspective view of a component part of the ink supplying of the printer section in FIG. 6.
Figure 11:
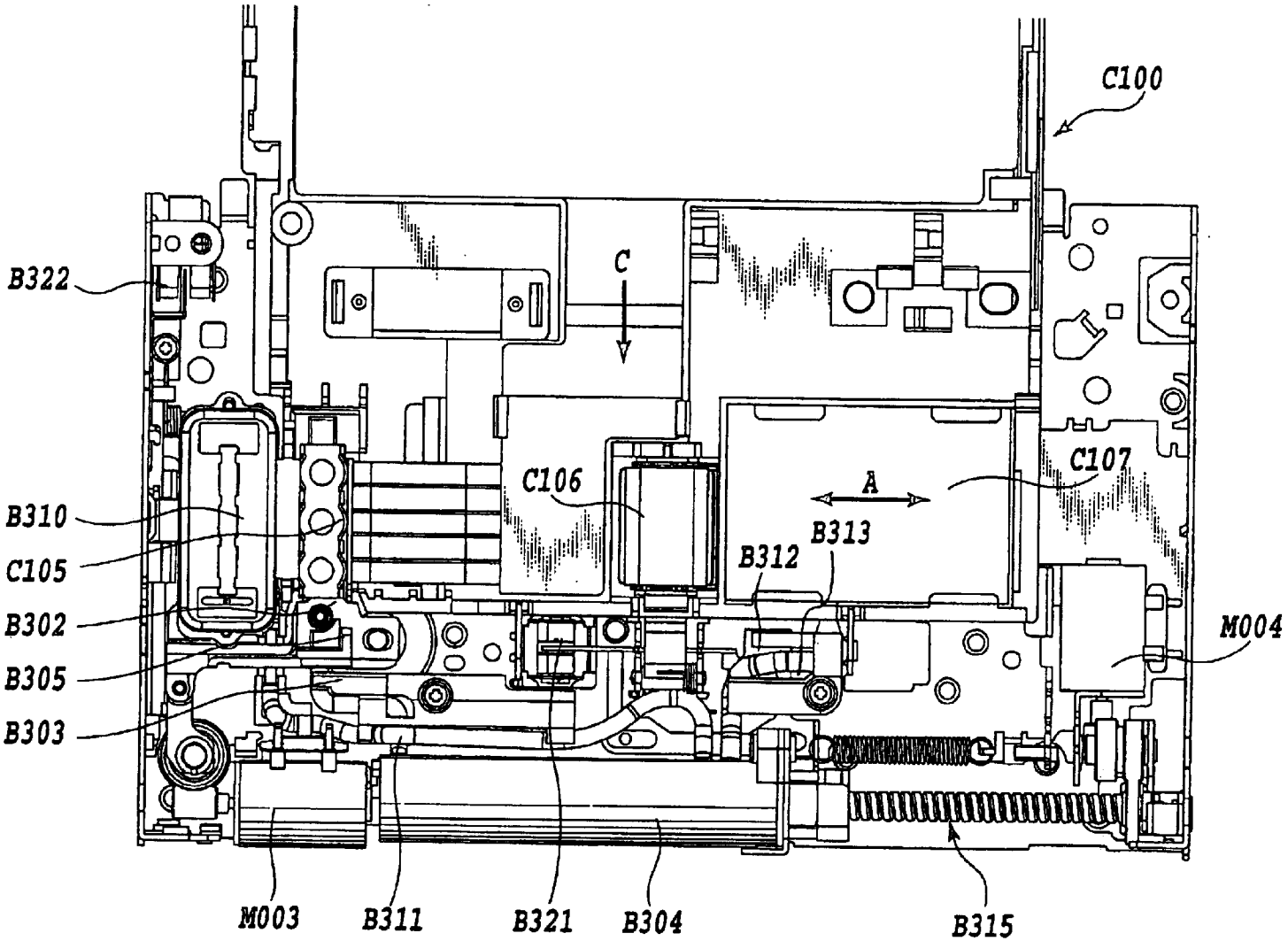
FIG. 11 is a plan view illustrating that the medium pack is inserted into a component part of the ink feeding in FIG. 10.

FIG. 10 is a perspective view showing a component part of an ink supplying system of the printer section B100: FIG. 11 is a plane view showing a status that the medium pack C100 is inserted in the component part of the ink supplying system.

A joint C105 of the medium pack C100 installed to the printer section B100 is positioned below the needles B122 (see FIG. 8) on the carriage B104 moved to a home position. The main body of the printer section B100 is equipped with a joint fork B301 (see FIG. 10) positioned below a joint C105, and an upward movement of the joint C105 caused by the joint fork B301 establishes a connection of the joint C105 to the needles B122. As a result thereof, an ink supplying path is formed between the ink packs C103 in the medium pack C100 and the ink supplying sections on the sub-tank on the carriage B104. Further, the main body of the printer section B100 is equipped with a suction joint B302 positioned below an air suction opening B123 (see FIG. 8) of the carriage B104 moved to the home position. This suction joint B302 is connected to a pump cylinder B304 of a pump serving as a negative pressure generating source, through a suction tube B304. The suction joint B302 is connected to the air suction opening B123 on the carriage B104 according to the upward movement caused by a joint lifter B305. In the light of the foregoing, a negative pressure introducing path, between a negative pressure introducing section of the sub-tank on the carriage B104 and the pump cylinder B304, is formed. The joint lifter B305 makes the joint fork B301 move up and down together with the suction joint B302 by a driving power of the joint motor M003.

The negative pressure introducing section of the sub-tank is equipped with a gas-liquid partition member (not shown) which allows a passing through of air but prevents a passing through of the inks. The gas-liquid partition member allows a passing through of the air in the sub-tank to be suctioned through the negative pressure introducing path, and as a result, an ink is supplied to the sub-tank from the medium pack C100. Then, when the ink is sufficiently supplied to the extent that the ink in the sub-tank reaches to the gas-liquid partitioning member, the gas-liquid partitioning member prevents the passing through of the inks, thereby automatically stopping a supply of the inks. The gas-liquid partitioning member is equipped with the ink supplying section in the ink storing sections for the respective inks in the sub-tank, and thus the ink supplying is automatically stopped with respect to each ink storing section.

The main body of the printer section B100 is further equipped with a suction cap B310 capable of capping with respect to the recording head B120 (see FIG. 8) on the carriage B104 which moved to the home position. The suction cap B310 is introduced the negative pressure thereinto from the pump cylinder B304 through suction tube B311, so that the inks can be suctioned and emitted (suction recovery processing) from the ink ejection openings B121 of the recording head B120. Further, the recording head B120, as required, makes the ink, which does not contribute to a recording-of an image, ejection into the suction cap B310 (preliminary ejection processing). The ink within the suction cap B310 is discharged into the ink absorption body C107 in the medium pack C110 from the pump cylinder B304 through a waste water liquid tube B312 and a waste liquid joint B313.

The pump cylinder B304 constitutes a pump unit B315 together with a pump motor M004 for enabling a reciprocate drive of the pump cylinder. The pump motor M004 also functions as a driving source by which a wiper lifter B316 (see FIG. 10) is moved up and down. The wiper lifter B316 makes the wiper C106 of the medium pack C100 placed in the printer section B100 move upwardly, thereby displacing the wiper C106 to a position capable of a wiping of the recording head B120.

In FIGS. 10 and 11, B321 denotes a pump HP sensor for detecting if an operating position of the pump, which is constituted by the pump cylinder B304, lies at the home position. Further, B322 denotes a joint HP sensor for detecting if the aforementioned ink supplying path and the negative pressure introducing path were formed. Still further, B323 denotes a chassis for constituting a main body of the printer section B100.

4: Signal Processing

Figure 12:
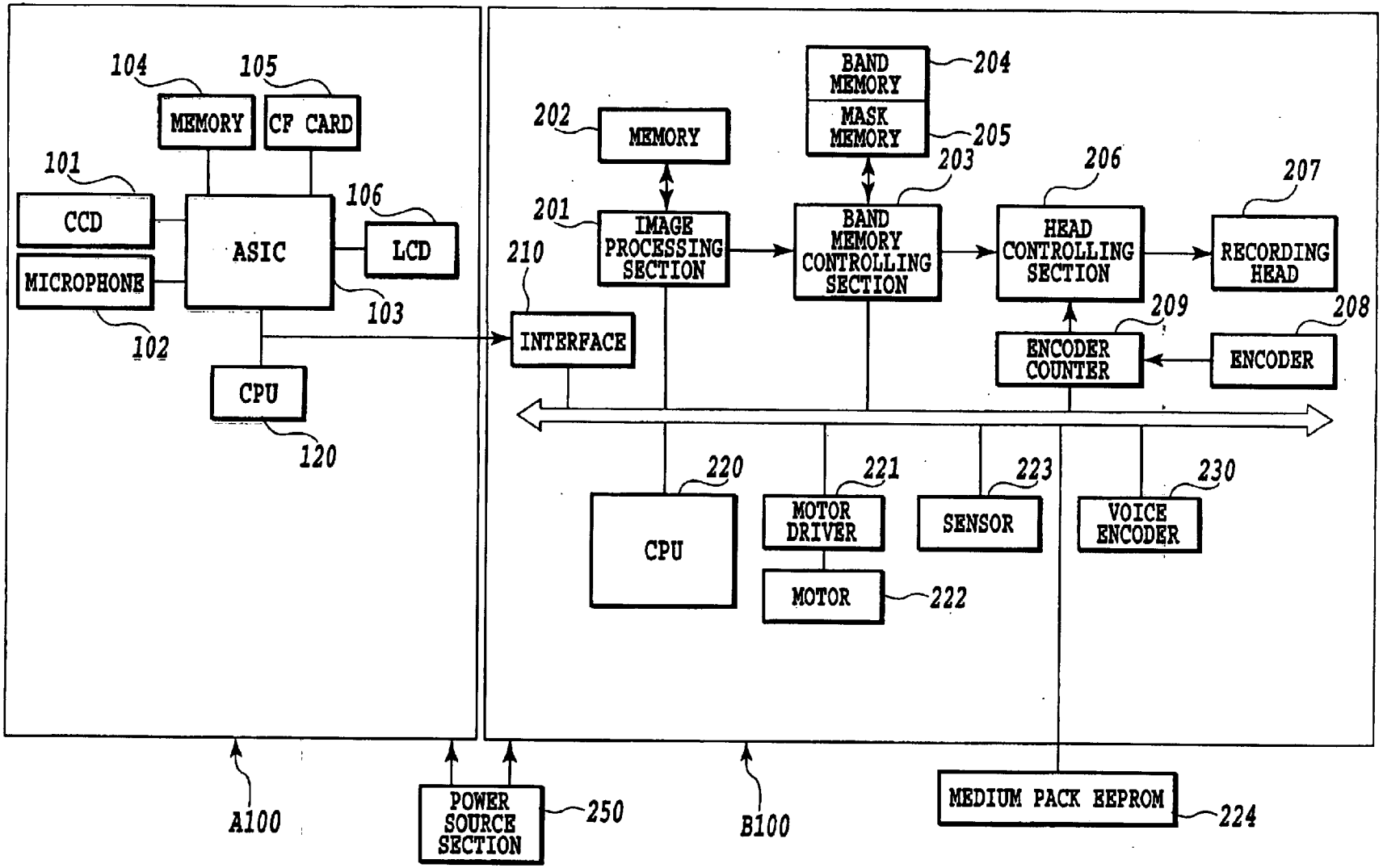
FIG. 12 is a block schematic diagram of the camera section and the printer section of the camera in FIG. 1.

FIG. 12 is a block diagram generally showing the camera section A100 and the printer section B100.

In the camera section A100, 101 denotes a CCD as an image element; 102 denotes a microphone for inputting voice; 103 denotes an ASIC (Application Specific IC) for performing various processings; 104 denotes a first memory for temporary storing an image date and the like; 105 denotes a CF (compact flush) card (corresponding to a "CF card A107") for recording the photographed image; 106 denotes a LCD (corresponding to a "liquid crystal display section A105") which displays the photographed image or a replayed image; and 120 denotes a first CPU for controlling the camera section A100.

In the printer section B100, 210 denotes an interface between the camera section A100 and the printer section B100; 201 denotes an image processing section (including a binary processing section for binarizing an image); 202 denotes a second memory to be used in performing the image processing; 203 denotes a band memory controlling section; 204 denotes a band memory; 205 denotes a mask memory; 206 denotes a head controlling section; 207 denotes a recording head (corresponding to the "recording head B120"); 208 denotes an encoder (corresponding to the "encoder sensor B131"); 209 denotes an encoder counter; 220 denotes a second CPU for controlling the printer section B100; 221 denotes motor drivers; 222 denotes motors (corresponding to the motors M001, M002, M003 and M004"); 223 denotes sensors (including the "HP sensors B134, B321 and B322"); 224 denotes an EEPROM contained in the medium pack C100; 230 denotes a voice encoder section and 250 denotes a power source section for supplying electric power to the entire device (corresponding to the "battery A108").

Figure 13:
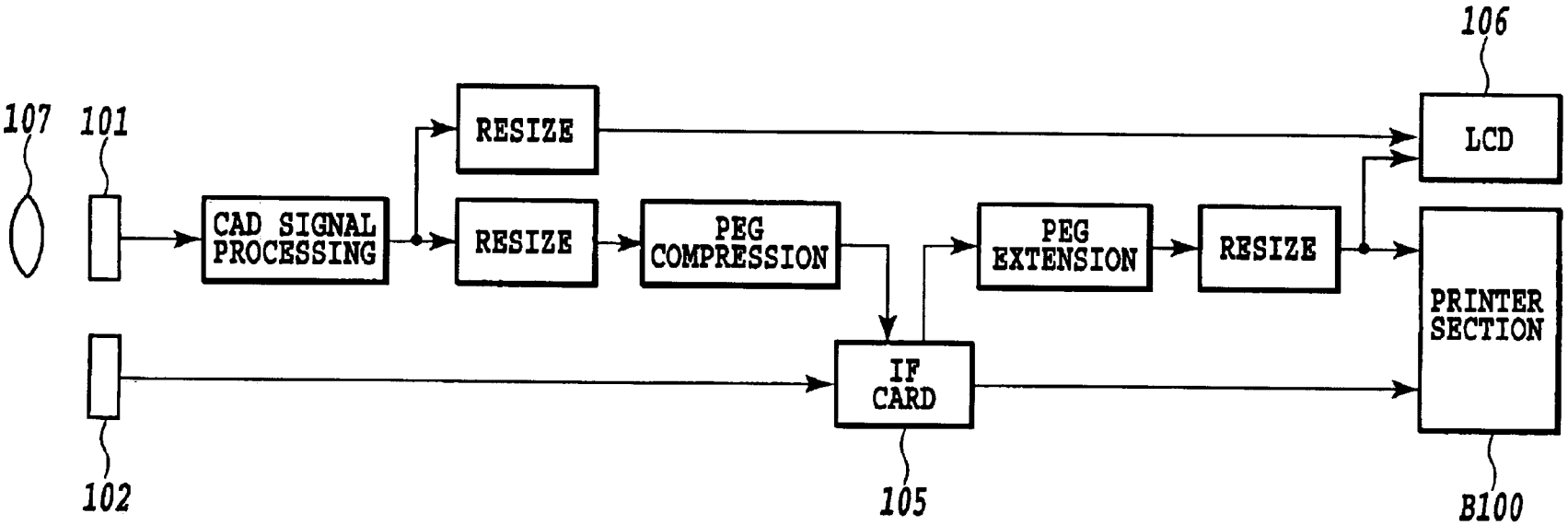
FIG. 13 is a schematic diagram of a signal processing performed in the camera section in FIG. 12.

FIG. 13 is a schematic diagram showing a signal processing in the camera section A100. In a photographing mode, an image photographed by the CCD 101 through a lens 107 is signal-processed (CCD signal processing) by ASIC 103 and then is converted to YUV intensity with two-color-different signal. Further, the photographed image is resized to a predetermined resolution and recorded on a CF card 105 using a compression method by JPEG, for example. Also, a voice is inputted through a microphone 102 and stored in the CF card 105 through the ASIC 103. A recording of the voice can be performed in such manner recording at the same time of photographing, or after photographing so called an after-recording. In a replay mode, the JPEG image is read out from the CF card 105, extended by the JPEG through the ASIC 103 and further resized to be a resolution for displaying, thereby being displayed on the LCD 106.

Figure 14:
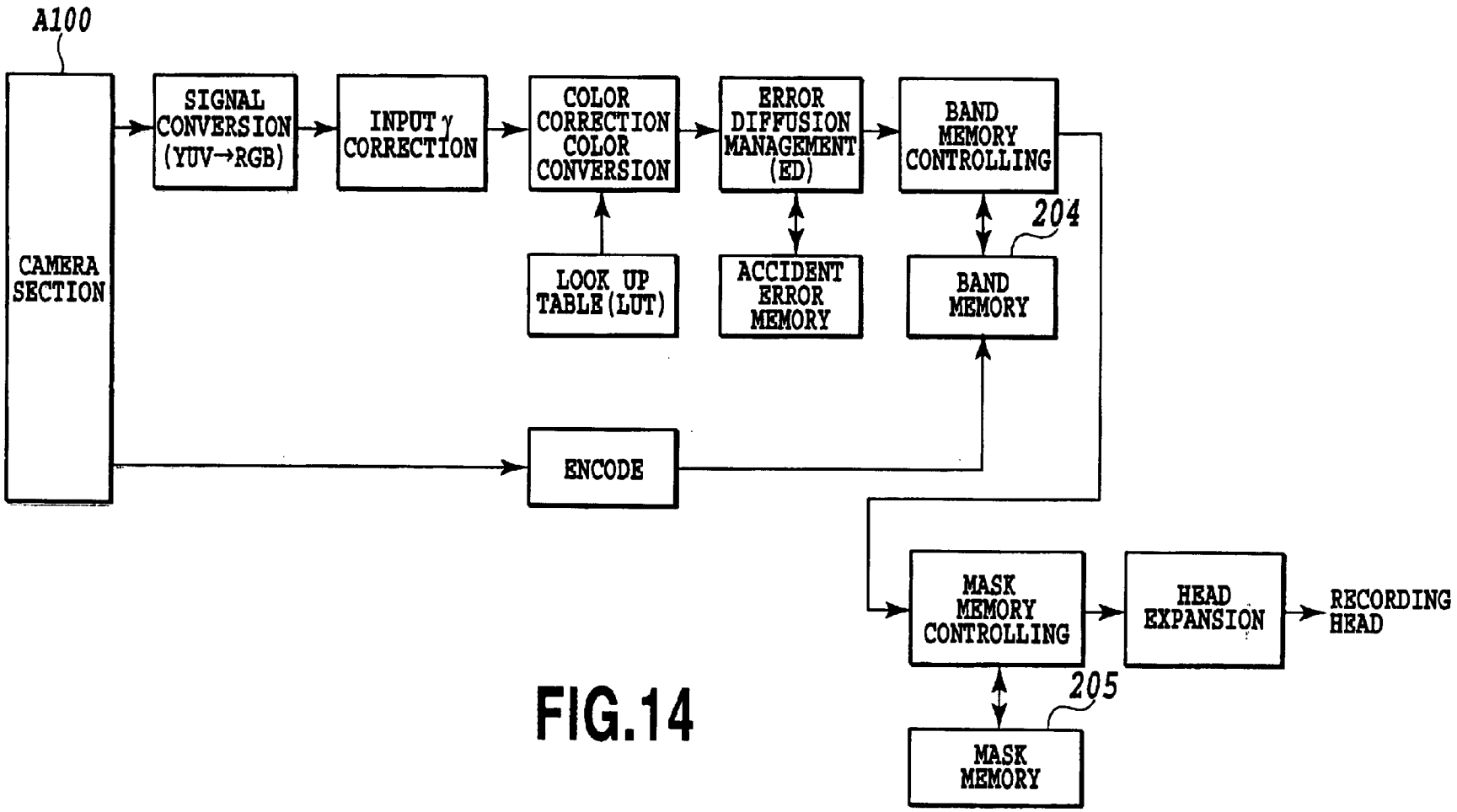
FIG. 14 is a schematic diagram of a signal processing performed in the printer section in FIG. 12.

FIG. 14 is a schematic diagram showing a signal processing performed in the printer section B100.

An image replayed on the camera section A100, that is the image being read out from the CF card 105, is extended by the JPEG as shown in FIG. 13 to resize a resolution to a suitable size for printing. Then, the resized image data (YUV signal), through an interface section 210, is transferred to the printer section B100. As shown in FIG. 14, the printer section B100 performs an image processing of an image data transferred from the camera section A100 by an image processing section 201, thereby performing an conversion of the image data to a RGB signal, an input $\gamma$ correction in accordance with the features of a camera, a color correction and a color conversion using a look up table (LUT), and an conversion to a binarized signal for printing. When performing the binarizing processing, in order to perform an error diffusion (ED), a second memory 202 is utilized as an error memory. In the case of the present embodiment, though a binarizing processing section in the image processing section 201 performs the error diffusion processing, in other processing may be performed such as a binarizing processing using a dither pattern. The binarized printing data is stored temporary in the band memory 204 by a band memory controlling section 203. An encoder pulse from the encoder 208 enters into the encoder counter 209 of the printer section B100 every time the carriage B104 carrying the recording head 207 and the encoder 208 moves a certain distance. Then, in sync with this encoder pulse, a printing data is read out from the band memory 204 and the mask memory 205, and, based on thus obtained printing data, the head controlling section 206 controls the recording head 207 to perform a recording.

A band memory shown in FIG. 14 is explained as below.

A plurality of nozzles in the recording head 207, for example, is formed in array so as to achieve a density of 1200 dpi (dots/inch). For recording the image by using such recording head 207, upon performing one scanning by the carriage, it is preferred to previously prepare a recording data (a recording data corresponding to one scanning) corresponding to the number of nozzles in the sub-scanning direction (hereinafter, also referred to as a "column (Y direction)") and a recording data corresponding to the recording area in the scanning direction (hereinafter, also referred to as a "row (X direction)", respectively. The recording data is created in the image processing section 201 and then is temporary stored in the band memory 204 by the band memory controlling section 203. After the recording data corresponding to one scan is stored in the band memory 204, the carriage is scanned in the main scanning direction. In so doing, an encoder pulse inputted by the encoder 208 is counted by the encoder counter 209 and, in accordance with this encoder pulse, a recording data is read out from the band memory 204. Then, on the basis of the image data, ink droplets are ejected from the recording head 207. In the case that a bidirectional recording system wherein an image is recorded upon outward scanning and homeward scanning (outward recording and homeward recording) of the recording head 207 is employed, the image data is read out from the band memory 204 depending on the scanning direction of the recording head 207. For example, an address of the image data read out from the band memory 204 is increased sequentially when the outward recording is performed, while an address read out from the band memory 204 is decreased sequentially when the homeward scanning is performed.

In a practical sense, a writing of an image data (C, M and Y) created by the image processing section 201 into the band memory 204 and a subsequent preparation of the image data corresponding to one band enable a scanning of the recording head 207. Then, the image data is read out from the band memory 204 subsequent to a scan of the recording head 207, so that the recording head 207 records the image on the basis of the image data. While the recording operation, an image data to be recorded next is created at the image processing section 201 and thus created image data is written into an area of the band memory 204 corresponding to a recording position.

As has been stated above, the band memory controlling is carried out in such manner that a writing operation in which an recording data (C, M, Y) created by the image processing section 201 is written into the band memory 204 and a reading operation for transferring the recording data (C, M, Y) to the head controlling section 206 in accordance with a scanning movement of the carriage are changed over.

A mask memory controlling in FIG. 14 is explained as below.

This mask memory controlling is required when a multipass recording system is employed. In using the multipass recording system, the recording image corresponding to one line which has a width corresponding to a length of the nozzle array of the recording head 207 is divided to a plurality of scanning of the recording head 207 to record. That is, conveying amount of the printing medium to be intermittently carried to the sub-scanning direction is made to be 1/N of a length of the nozzle array. For example, when N=2, a recording image corresponding to one line is divided into two scans to record (two-pass recording), and when N=4, a recording image corresponding to one line is divided into four scans to record (four-pass recording). In similar fashion, when N=8, it becomes eight-pass recording, and when N=16, it becomes sixteen-pass recording. Therefor, the recording image corresponding to one line will be completed by a plurality of scans of the recording head 207.

Practically, a mask data for assigning the image data to a plurality of scans of the recording head 207 is stored in the mask memory 205, and then based on a conjunction (AND) data between the mask data and the image data, the recording head 207 ejects inks to record the image.

Also, in FIG. 14, a voice data stored in the CF card 105, alike the image data, is transferred to the printer section B100 through an interface 210 by the ASIC 102. The voice data transferred to the printer section B100 is encoded at the voice encoder 230 and then recorded with the image to be printed as a code data. When there is no necessity to input a voice data into a printing image, or when printing an image without a voice data, of course, the encoded voice data is not printed but only the image is printed.

In the present embodiment, the present invention has been explained as a printer built-in camera integral with a camera section A100 and printer section B100. However, it would be possible to make each of the camera section A100 and the printer section B100 a separate device and to form in a similar manner as a structure in which those devices are connected each other by the interface 210 to realize a similar function.

[Characteristic Construction]

(First Embodiment)

In the following, a first embodiment of characteristic construction of the present invention will be described.

(Ink Supply Recovery System)

Figure 15:
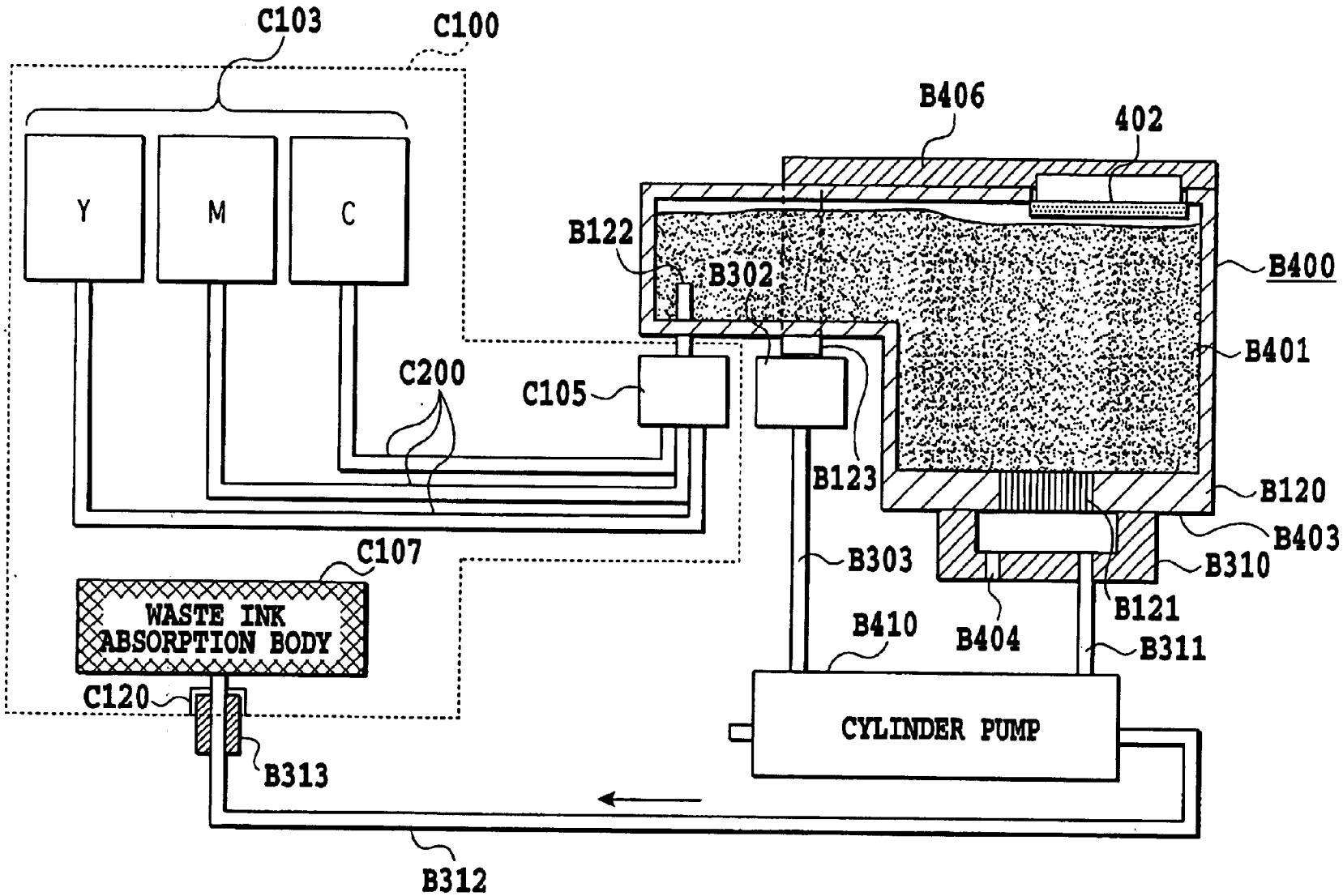
FIG. 15 is a diagram showing conceptual construction of an ink supply recovery system.

FIG. 15 shows conceptual construction of the ink supply recovery system.

In FIG. 15, in a medium pack C100, three ink packs (or main tank) C103 charged with three color inks of Y (yellow), M (magenta), and C (cyan) are contained. These three ink packs C103 are connected to three joints C105 through three ink supply passages C200.

The medium pack C100 is provided with a waste liquid introducing hole C120 (see FIG. 4) which is inserted and connected with a waste liquid joint B313 (see FIG. 10) provided at the tip of a waste liquid tube B312 on the printer section B100. The medium pack C100 is provided with a waste ink absorption body C107 for storing waste ink flowing from a cylinder pump B410 through the waste liquid introducing hole C120.

The carriage B104 is equipped with sub-tanks (or carriage tanks) B400 separately storing Y, M, and C inks, and a recording head B120 having a plurality of ink ejection openings (nozzles) for three groups (Y, M and C) for ejecting inks supplied from the respective carriage tanks B400.

The respective ink reserving section (ink supplying section) of the sub-tank B400 are nearly almost fully charged with an ink absorption body (for example, sponge) B401 for absorbing and holding inks such as made of polypropylene fiber or the like. Further, the respective ink reserving section (ink supplying section) of the sub-tanks B400, as shown in FIG. 8, are provided with hollow needles B122 as an ink intake protruding downward. These three needles B122 become connectable with three rubber joints C105 of the medium pack C100 when the carriage B104 moves to the home position.

Above the respective ink suppliers of the sub-tanks B400, negative pressure introducing section (air suction part) B406 are formed. These negative pressure introducing section B406 are, as described above, finished to be water repellent and oil repellent, and respectively provided with porous films (ink filling valves) B402 as gas-liquid partition members which allow a passing through of air but prevent a passing through of the ink. Since passage of ink is blocked with this porous film B402, ink supply is stopped automatically when the ink surface in the sub-tanks reaches the porous film B402.

The respective negative pressure introducing section B406 of the sub-tanks B400 are, as described above, communicated with a common air suction opening B123 (FIG. 8) formed on the lower surface side of the carriage B104. The air suction opening B123, when the carriage B104 moves to the home position, becomes connectable with a suction joint B302 provided on the main body of the printer section B100, and connectable with one cylinder chamber of the cylinder pump B410 of the pump unit B315 through the suction joint B302 and the suction tube B303.

On the printer section B100, there is provided a suction cap B310 for capping the face (ink ejection opening formation surface) B403 of the recording head B120 on which a plurality of ink ejection openings (nozzles) B121 for three groups of Y, M, C are formed when the carriage B104 moves to the home position. The suction cap B310 is provided with an air communication opening B404. The air communication opening B404 can be opened and closed by an air communication valve B405.

The suction cap B310 is connected to the other cylinder chamber of the cylinder pump B410 through the suction tube B311.

A cylinder main body (a pump cylinder) B304 has three ports connected with the suction tube B303, the suction tube B311 and the waste liquid tube B312.

(Pump Unit)

A pump unit B315 including the cylinder pump B410 will be described in detail with reference to FIGS. 16 to 21.

As shown in these drawings, the cylinder pump B410 has a cylinder main body B304 and a piston B411. The piston B411 has a piston shaft B411*a* and a piston body (hereinafter referred to as piston rubber) B412 comprising an elastic material such as rubber provided at a tip flange of the piston shaft B411*a*.

The cylinder main body B304 is partitioned by the piston rubber B412 into two (right and left) pump chambers (an air suction chamber B413 and an ink suction chamber B414).

The air suction chamber B413 is introduced with air (the first fluid), and the ink suction chamber B414 is supplied with ink (the second fluid). The air suction chamber B413 is provided with an input/output port B415 communicated with the suction tube B303. The ink suction chamber B414 is provided with an input port B416 communicated with the suction tube B311 and an output port B417 communicated with the waste liquid tube B312. On an end surface wall B425 of the ink suction chamber B414, there are formed a hole B426 (FIG. 17) for inserting and sliding with the piston shaft B411*a* and a hole B427 (FIG. 18) for inserting and sliding with a plurality of slide pins B442 which will be described later.

Figure 16:
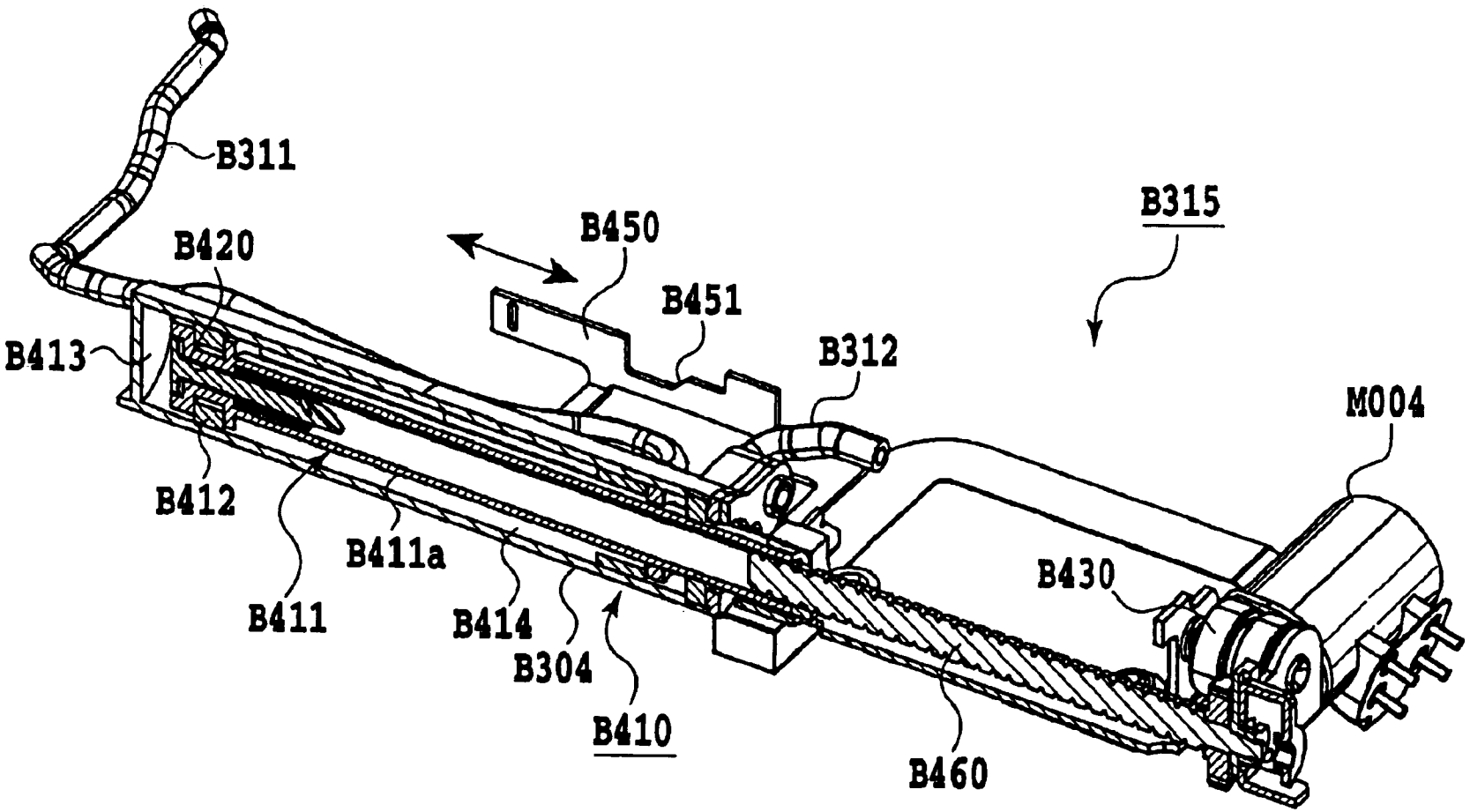
FIG. 16 is a partially broken perspective view showing a pump unit.
Figure 17:
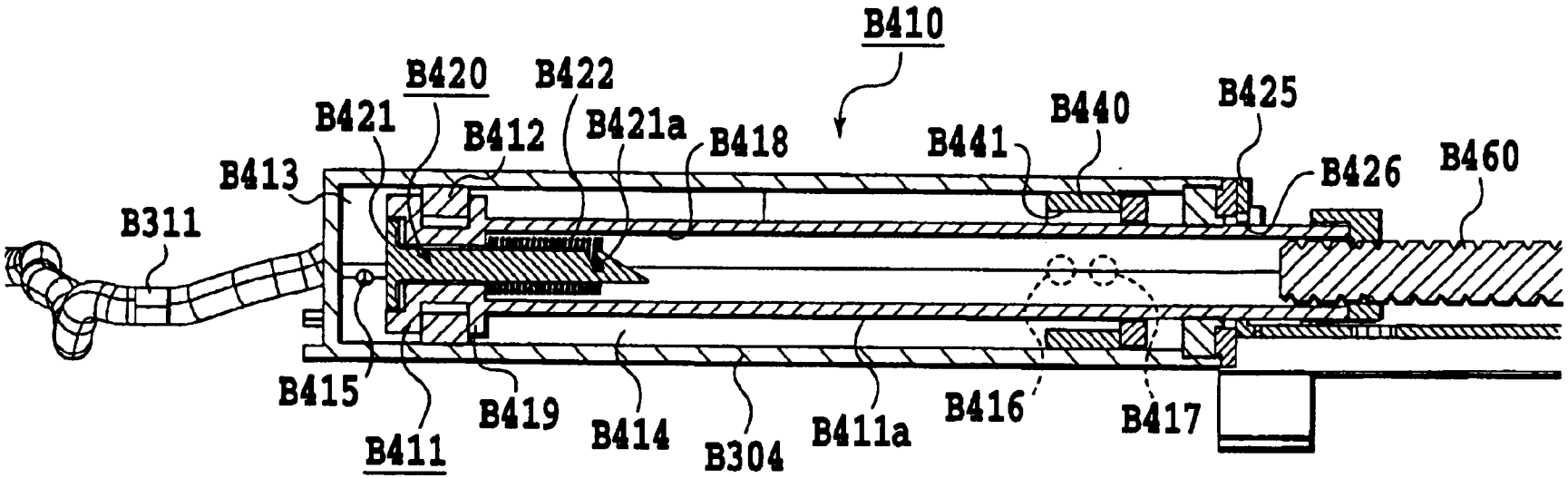
FIG. 17 is a sectional diagram showing stand-by state of a cylinder pump.

The piston B411, as shown in FIG. 16 and FIG. 17, has a penetrated hollow cylindrical form and can be introduced with the atmosphere into the hollow part B418. The tip flange part B419 of the piston 411 is provided with a relief valve B420 which operates when the suction pressure (negative pressure) of the air suction chamber B413 exceeds a predetermined pressure.

The relief valve B420 comprises a valve main body B421 and a spring B422 for setting the relief pressure. The spring B422 is interposed between a spring stopper B421 of the valve main body B421 and the flange part B419 so that the valve main body B421 is released with a predetermined relief pressure.

As described above, when the suction pressure (negative pressure) of the air suction chamber B413 exceeds a predetermined pressure, since the relief valve B420 is opened so that air is little by little sucked into the air suction chamber B413, negative pressure greater than the relief pressure is all cut off. The relief pressure of the relief valve B420 is set so that the pressure is less than a pressure that is able to maintain the performance of the porous film B402.

In the pit-in ink supply method using the porous film B402 in the sub-tank B400, ink supplying to the sub-tank B400 is performed by sucking air in the tank B402 with the cylinder pump B410 through the porous film B402. When suction is performed by the cylinder pump B410 with the ink tank is fully charged state, ink leakage from the porous film B402 is prevented by the function of the porous film B402, however, it has an adverse effect on the durability of the porous film B402, reducing the service life of the porous film B402. Then, in this system, the relief value B420 is disposed in the piston shaft B411*a* of the cylinder pump B410 for achieving space-saving and preventing exertion of an excessive ink pressure to the porous film B402 during ink supply, thereby assuring reliable operation of the porous film B402.

In the hollow part B418 of the piston shaft B411*a*, a screw rod (pump unit) B460 is inserted in a screwed state, so that by the rotation of the screw rod B460, the piston B411 is reciprocally moved in the piston shaft direction. The screw rod B460 is, as shown in FIG. 16, connected to a pump motor M004 as a drive source through a gear mechanism B430, and rotated by the rotation of the pump motor M004.

Figure 18:
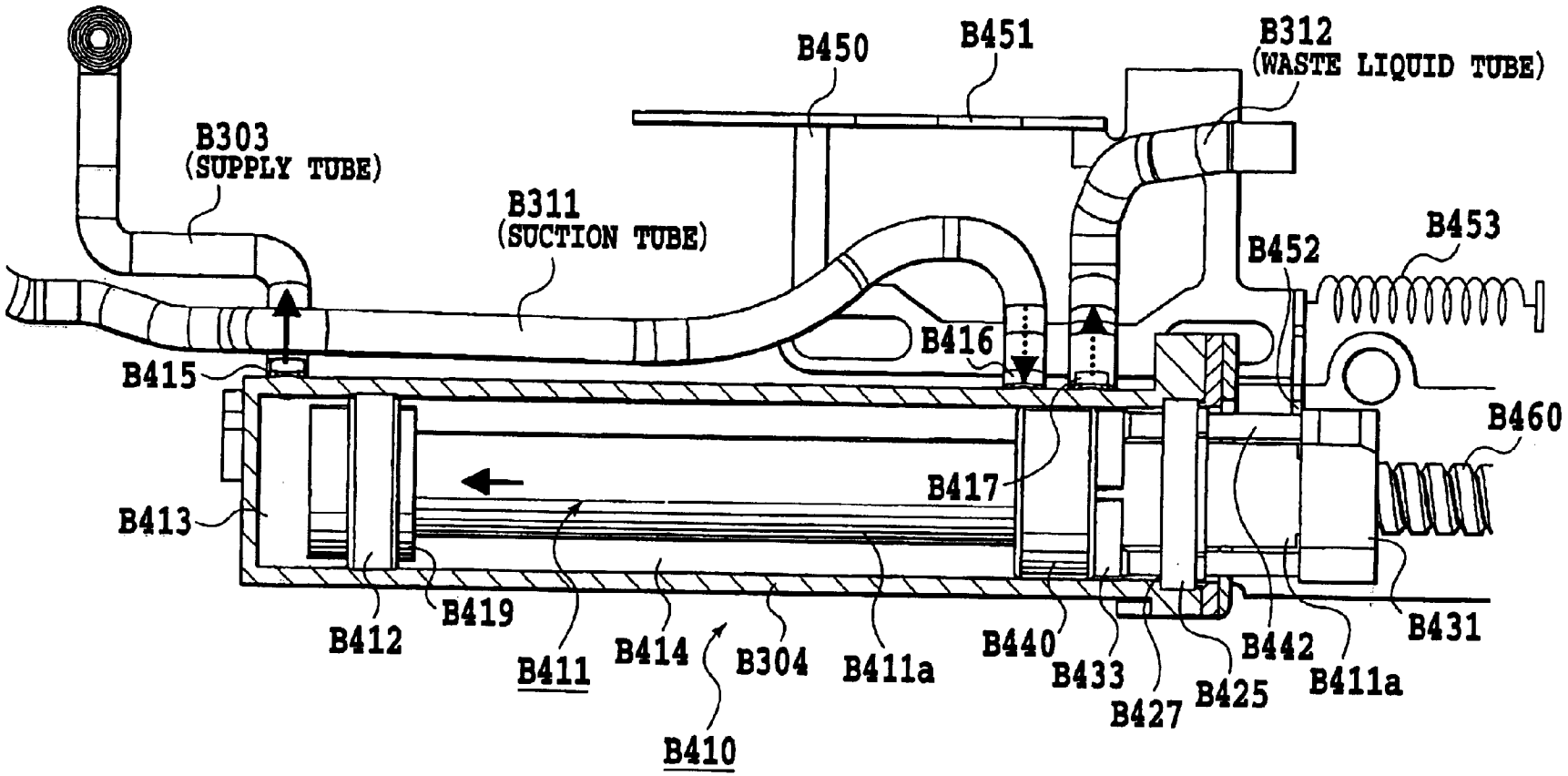
FIG. 18 is a partially sectional diagram showing stand-by state of the cylinder pump.

At the rear end side of the piston B411, as shown in FIG. 18 and the like, a pressure slider B431 is disposed. The pressure slider B431 is also screwed with the screw rod B460, and can be reciprocally moved in the piston shaft direction in association with the rotation of the screw rod B460.

In the ink suction chamber B414 of the cylinder main body B304, a switching valve (hereinafter referred to as valve rubber) B440 as port switching means comprising an elastic material such as rubber is disposed movably in the piston shaft direction. The valve rubber B440 is provided with a hole B441 (FIG. 17) for inserting the piston shaft B411*a*. Therefore, the piston shaft B411*a* can be freely moved relative to the valve rubber B440 through the hole 441. By switching the position of the valve rubber B440, one of input port B416 connecting to the suction tube B311 and output port B417 connecting to the waste liquid tube B312 is opened and the other is closed, thereby controlling open/close state of these input port B416 and output port B417.

Between the rear end surface of the valve rubber B440 and the pressure slider B431, as shown in FIG. 18 and the like, a plurality of slide pins B442 for pressing the rear end surface of the valve rubber B440 are disposed. At the (tip side) valve rubber B440 side of the slide pin B442, a pressing body B433 having a large contact surface is fixed for achieving uniform pressing force to the rear end surface of the valve rubber B440.

Figure 19:
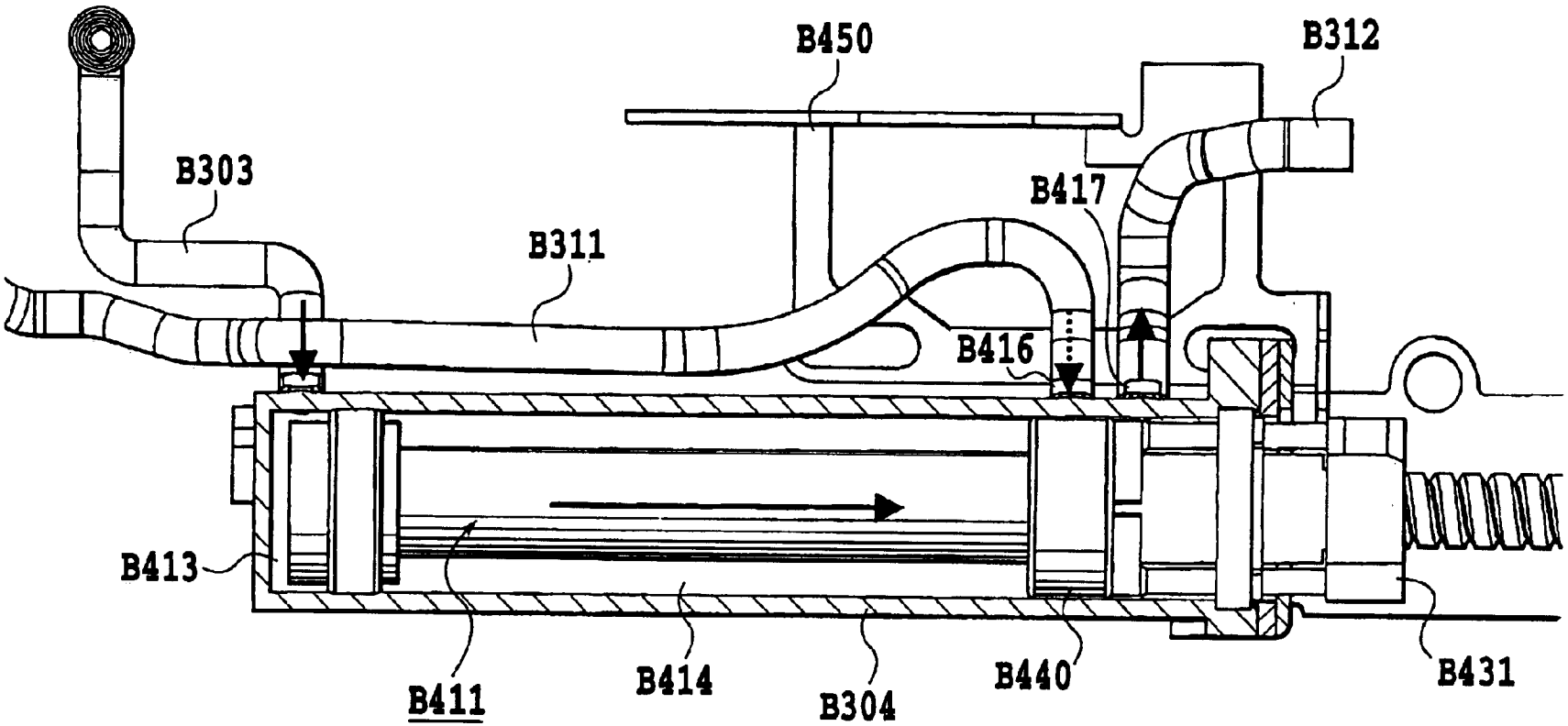
FIG. 19 is a partially sectional diagram showing the cylinder pump when the piston is at an ink supply start position.

To obtain a state that the valve rubber B440 in stand-by state as shown in FIG. 18 is moved in the piston travel direction (left direction in the figure), so that the input port B416 is closed and the output port B417 is opened as shown in FIG. 19, the pressing force of the pressure slider B431 is used.

That is, in stand-by state, the pressure slider B431 is, as shown in FIG. 18, in contact with a plurality of slide pins B442. In this state, when the pressure slider B431 is further moved in the piston travel direction (left direction) by the rotation of the screw rod B460, the plurality of slide pins B442 and the valve rubber B440 are moved to the left direction to the position shown in FIG. 19 by the pressing force of the pressure slider B431.

Figure 20:
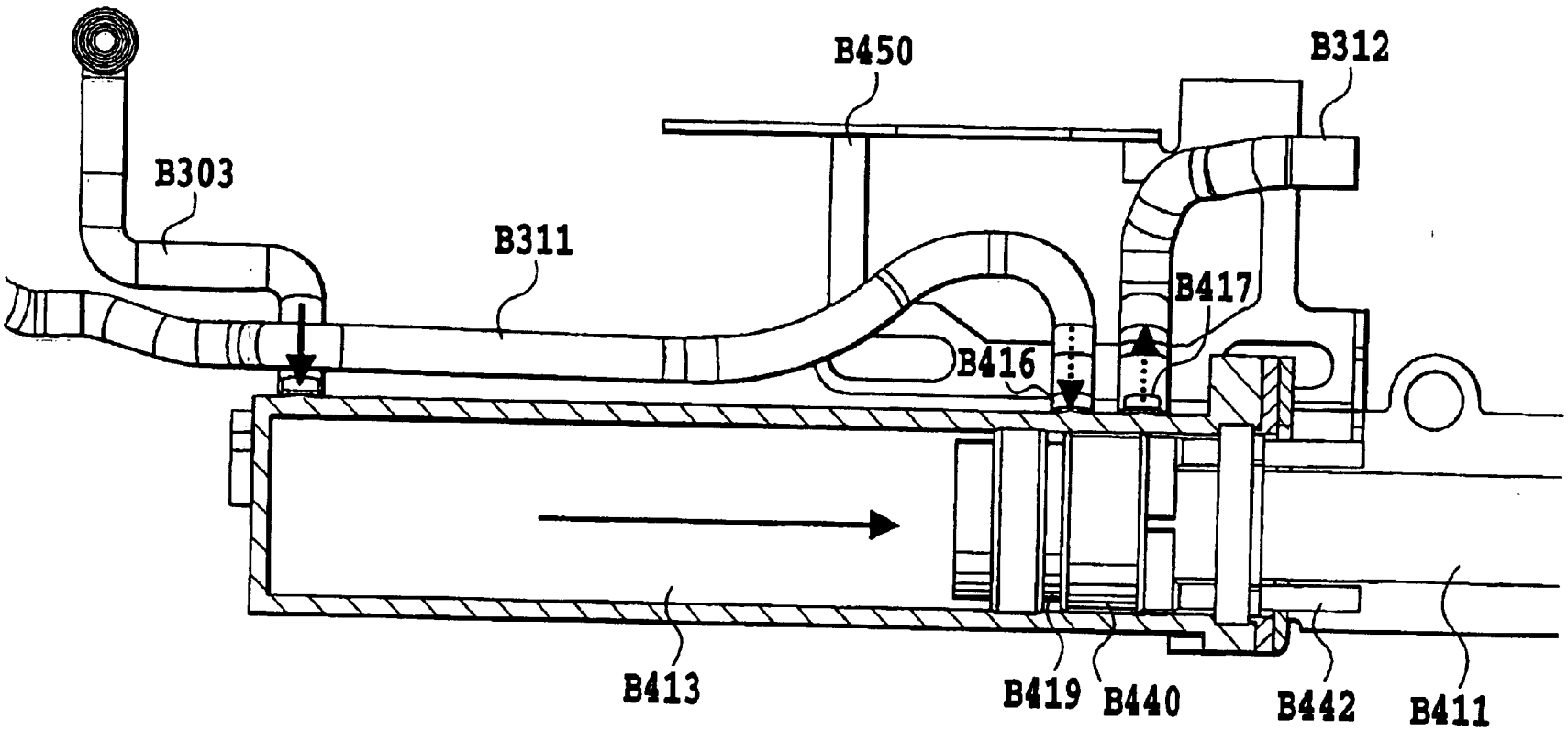
FIG. 20 is a partially sectional diagram showing the cylinder pump when the piston is at a valve switching position.
Figure 21:
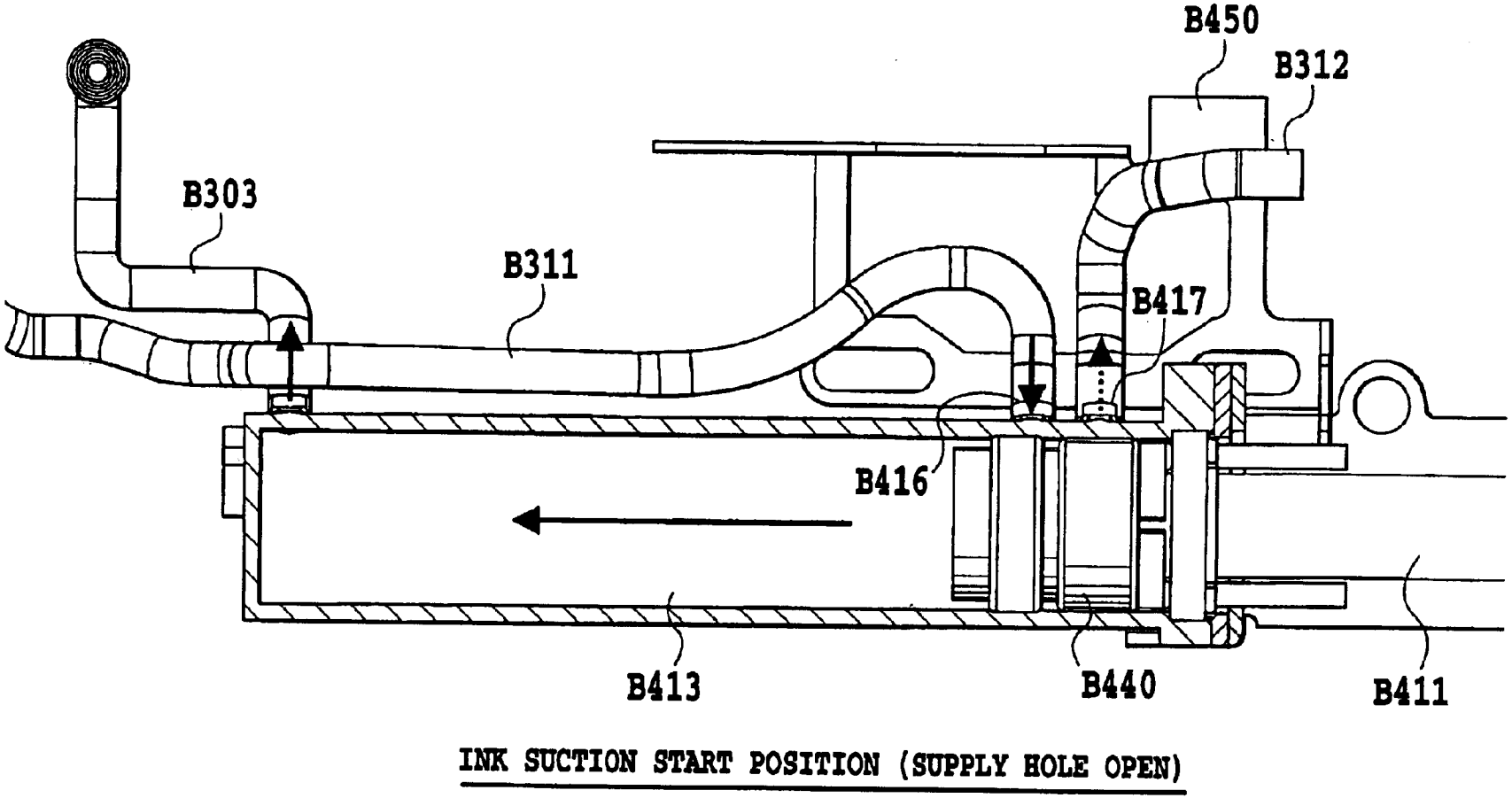
FIG. 21 is a partially sectional diagram showing the cylinder pump when the piston is at an ink supply start position.
Figure 22:
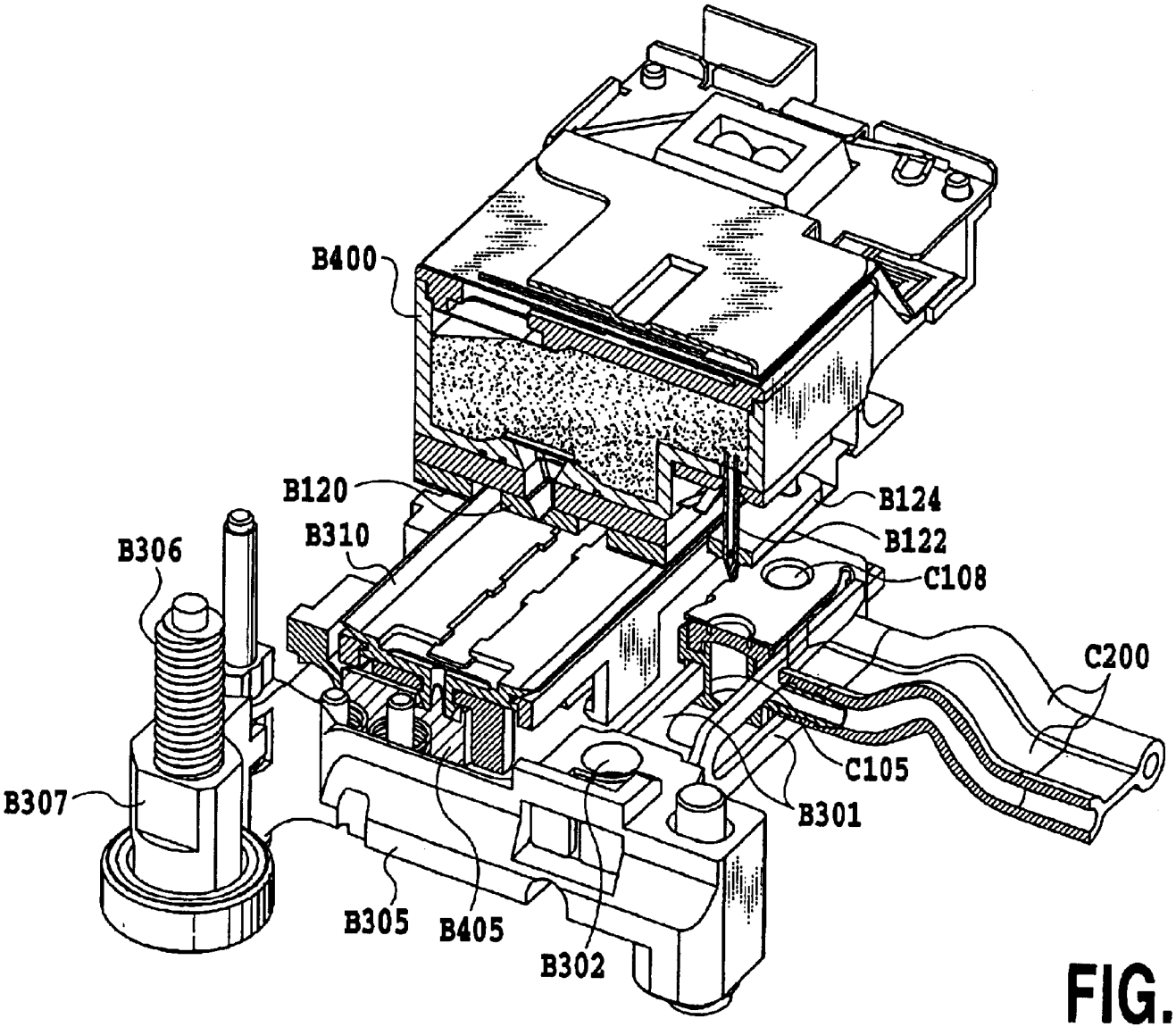
FIG. 22 is a perspective diagram showing construction such as a joint lifter and the carriage.

On the other hand, to move the valve rubber B440 from the position shown in FIG. 19 to the position shown in FIG. 20 and further to the position shown in FIG. 21 in a piston retreat direction (right direction in the figure), the pressing force of the flange part B419 at the tip of the piston B411 is used.

That is, for example, as shown in FIG. 20, after the tip flange part B419 of the piston B411 is contacted with the valve rubber B440, when the piston B411 is moved in the retreat direction, the valve rubber B440 and the plurality of slide pins B442 are moved by the pressing force of the flange part B419 in the right direction to the position shown in FIG. 21.

Such position switching of the valve rubber B440 is performed at a predetermined timing in one cycle including air suction (ink supply), ink suction, and ink discharge by reciprocal movement of the piston B411.

Next, air suction, ink suction, and ink discharge operation by the cylinder pump B410 will be briefly described.

(Air Suction and Ink Discharge Operation)

The state shown in FIG. 19 is the initial state of air suction, in which the piston B411 is moved forward almost to the stroke end at the piston travel side. At this moment, the valve rubber B440 is switched to the position where the ink suction chamber B414 is communicated with the waste tube B312 and blocked from the suction tube B311.

When, from the state shown in FIG. 19, the piston B411 is moved to the right direction in the piston retreat direction, the air suction chamber B413 is pressure reduced and the ink suction chamber B414 is pressurized.

By this operation, air in the sub-tank B400 is sucked to the air suction chamber B413 through the porous film B402, the negative pressure introducing section B406, the air suction opening B123, the suction joint B302, and the suction tube B303 (FIG. 15). As a result, ink is supplied from the main tank C103 of the medium pack C100 to the sub-tank B400.

On the other hand, it is assumed that the ink suction chamber B414 is stored with sucked ink from the suction cap B310 sucked in the previous cycle. In this state, when the piston B411 is moved from the state shown in FIG. 19 in right direction in the piston retreat direction, the ink suction chamber B414 is pressurized. Thus, the sucked ink stored in the ink suction chamber B414 is flowed through the waste liquid tube B312 to the waste ink absorption body C107 of the medium pack C100, where it is absorbed and held by the waste ink absorption body C107.

(Ink Suction Operation)

The state shown in FIG. 21 is the initial state of ink suction, in which the piston B411 is moved almost to the stroke end at the piston retreat side. At this time, the valve rubber B440 is switched to the position where the ink suction chamber B414 is communicated with the suction tube B311 and blocked from the waste liquid tube B312.

When, from the state shown in FIG. 21, the piston B411 is moved to the left direction in the piston travel direction, the air suction chamber B413 is pressurized and the ink suction chamber B414 is pressure reduced.

By this operation, as shown in FIG. 15, the inside of the suction cap B310 connected to the ink suction chamber B414 through the suction tube B311 is evacuated, and ink is sucked from the ink ejection opening B121 of the recording head B120 to the suction cap B310. The sucked ink is flowed to the ink suction chamber B414.

On the other hand, during the ink suction operation, the air suction chamber B413 is pressurized, however, at this time, as will be described later, since the suction joint B302 is disconnected from the air suction opening B123 of the sub-tank B400, the inside of the sub-tank B400 will never be pressurized.

In the cylinder pump B410, the cylinder chamber B414 inserting the piston shaft B411*a* is used for ink suction and the other cylinder chamber B413 for air suction. Therefore, suction amounts of the respective cylinder chambers B413 and B414 can be set to different values with the same piston stroke. That is, the cylinder chamber B414 inserting the piston shaft B411*a* is smaller in suction amount. Further, by changing the shaft diameter of the piston shaft B411*a*, the suction volume ratio of the ink suction chamber B414 and the air suction chamber B413 can be easily changed.

Next, moving mechanism of wiper C106 of the medium pack C100 will be described.

As shown in FIG. 16 and FIGS. 18 to 21, a plate cam member B450 for moving up and down a wiper lifter B316 (see FIG. 10) is provided in the vicinity of the cylinder pump B410. The plate cam member B450, as shown in FIG. 16, has a two-stage cam part B451 differing in height, which moves up and down the wiper lifter B316 engaging with the cam part B451.

The plate cam member 450 is reciprocally movable in the retreat direction of the piston B411 of the cylinder pump B410. The plate cam member 450 has a contact B452 (FIG. 18) contacting with the pressure slider B431 screwed with the screw rod B460. The plate cam member 450 is moved in the forward direction (left direction) of the piston B411 by being pressed by the movement of the pressure slider B431. The plate cam member 450 is moved in the retreat direction (right direction) of the piston B411 by the righting force of the spring B453 (FIGS. 10, 11, 18).

(Joint Lifter Moving Mechanism)

Next, using FIGS. 22 to 27, contact/separate mechanism of the joint C105 of the medium pack C100 to the needle B122 of the sub-tank B400, contact/separate mechanism of the suction joint B302 to the air suction opening B123 of the carriage B104, contact/separate mechanism of the suction cap B310 to the face B403 of the recording head B120, and open/close mechanism of the atmosphere communication opening B404 of the suction cap by the atmosphere communication valve B405 will be described in further detail.

Figure 23:
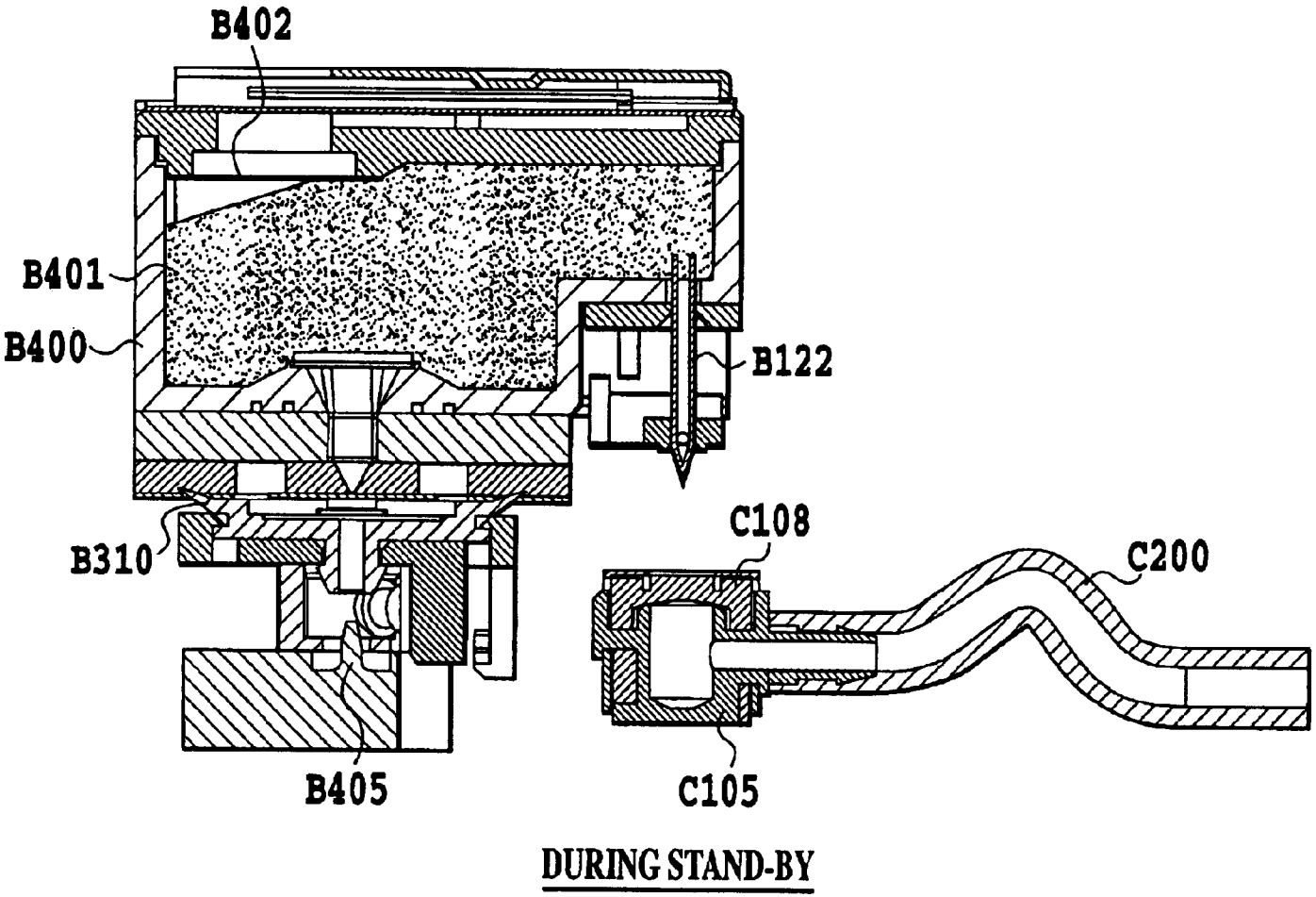
FIG. 23 is a sectional diagram showing stand-by state of a joint and a suction cap.
Figure 24:
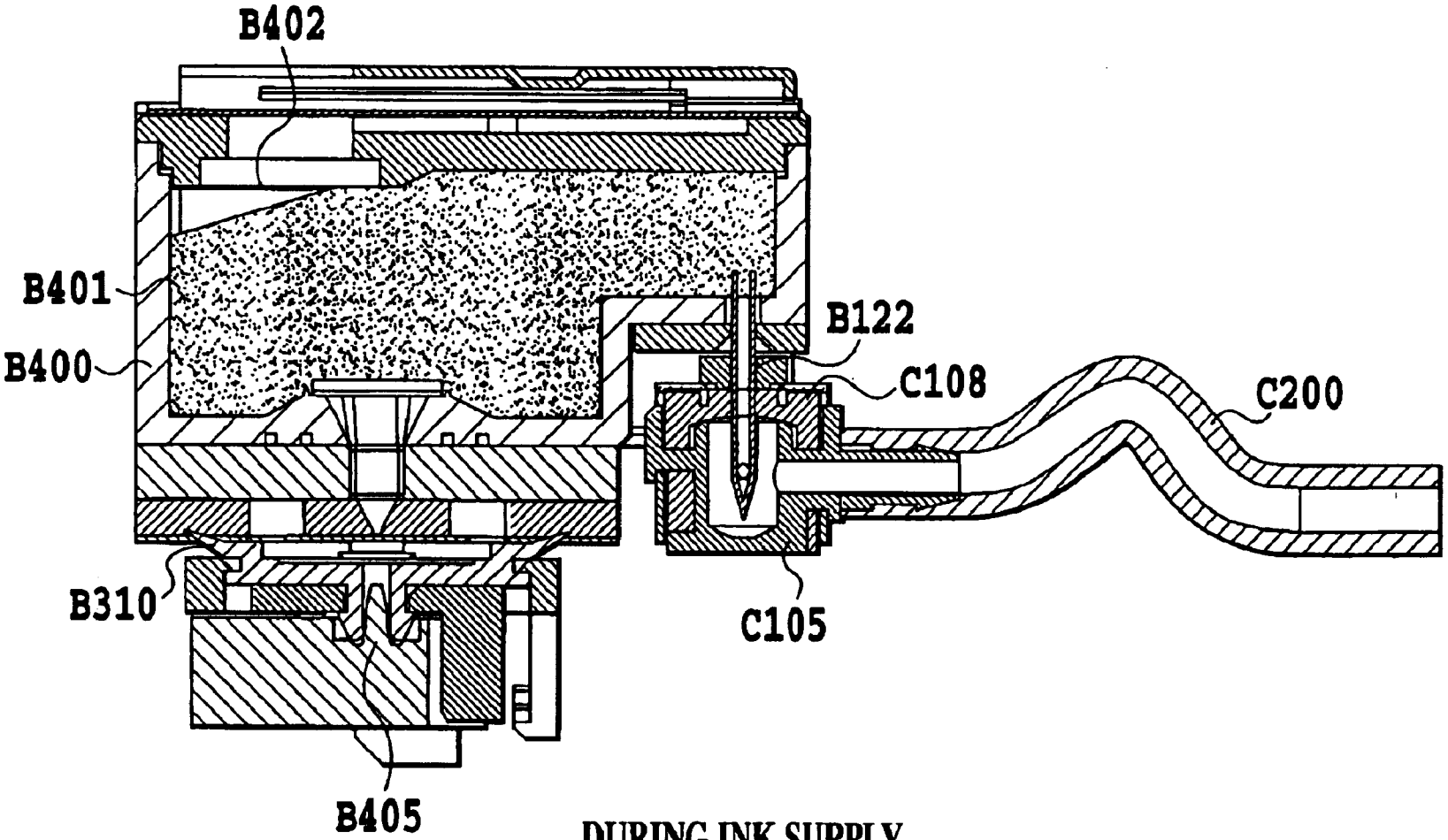
FIG. 24 is a sectional diagram showing ink supply state of a joint and a suction cap.
Figure 25:
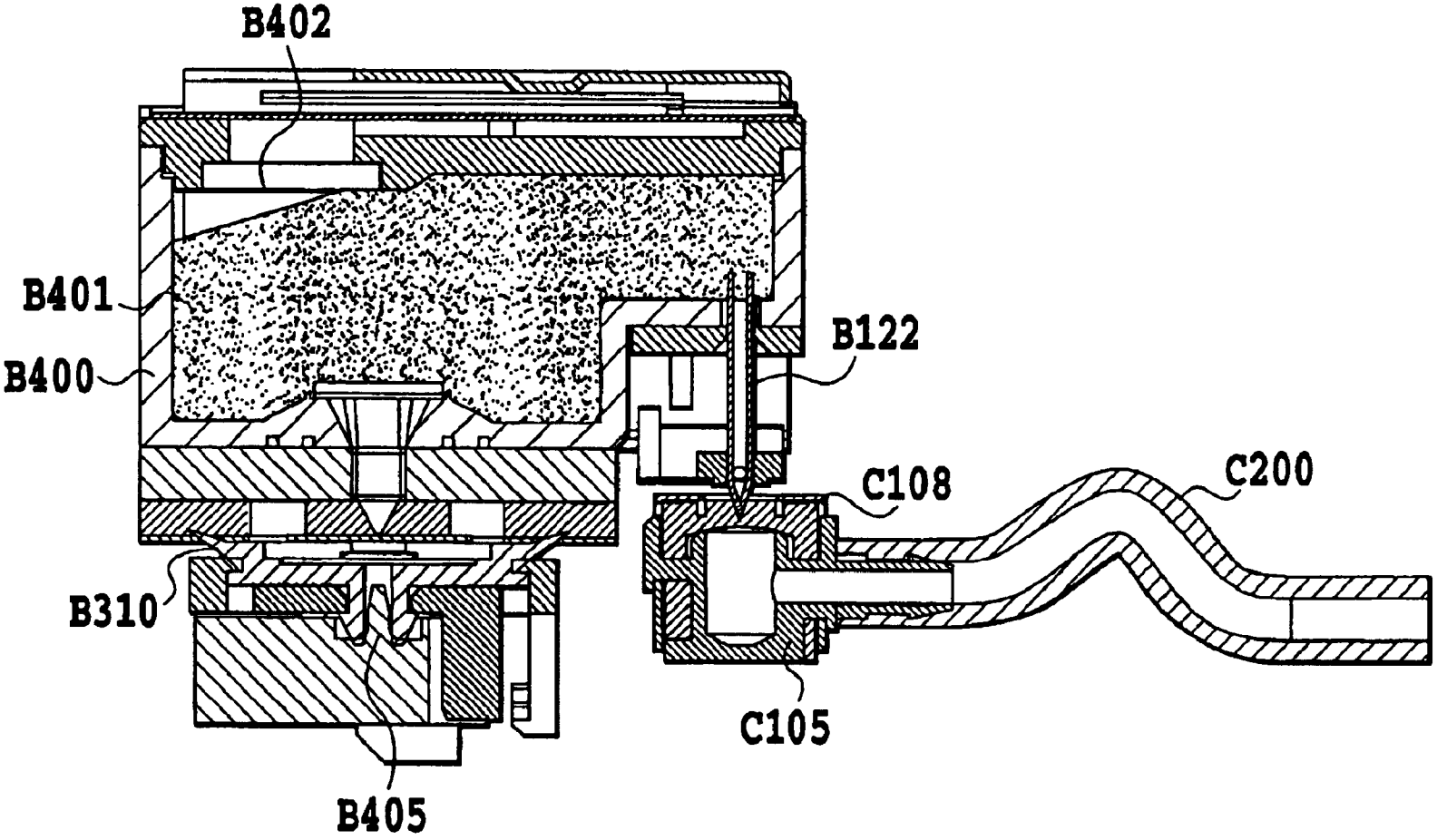
FIG. 25 is a sectional diagram showing ink suction state of a joint and a suction cap.
Figure 26:
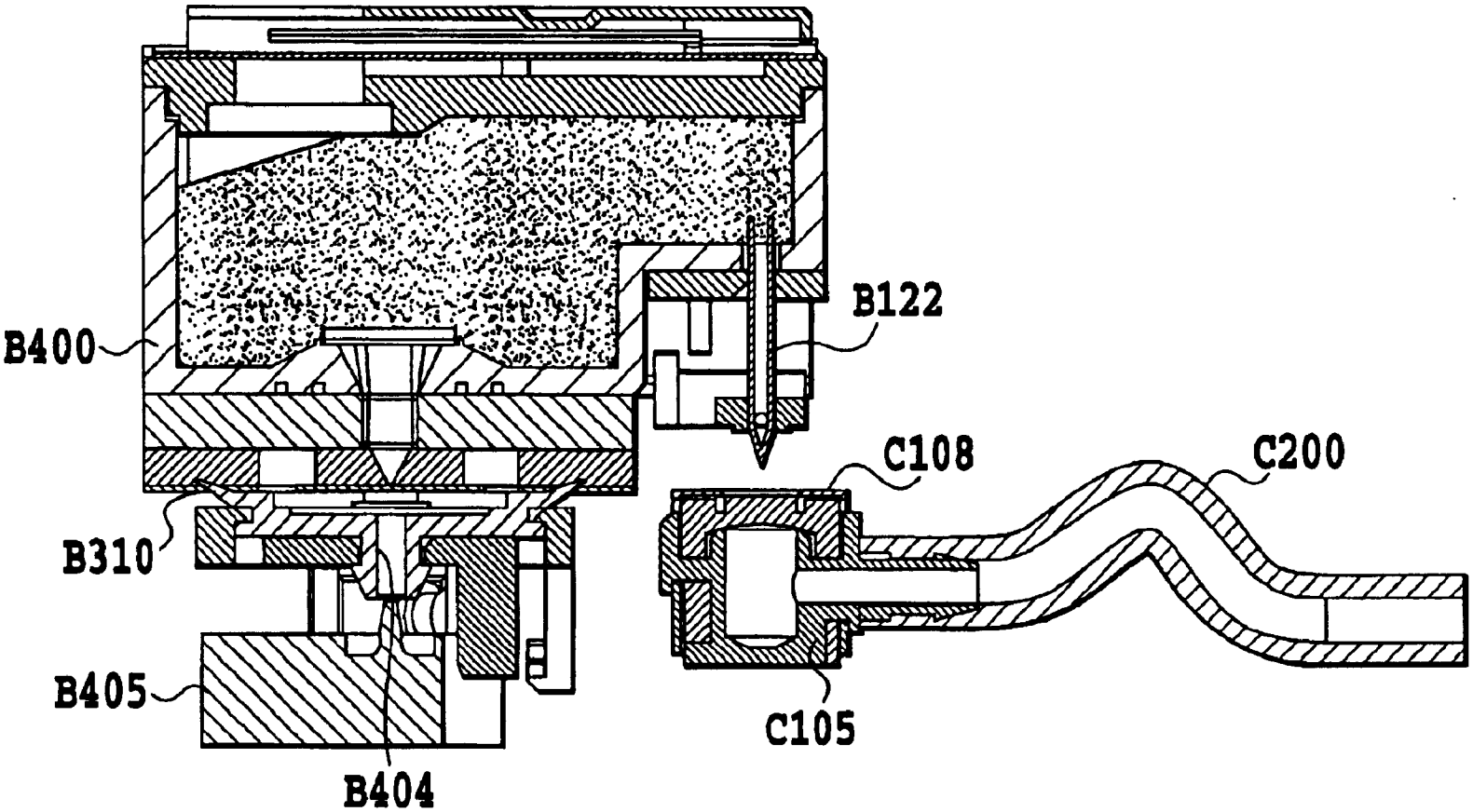
FIG. 26 is a sectional diagram showing empty suction state of a joint and a suction cap.
Figure 27:
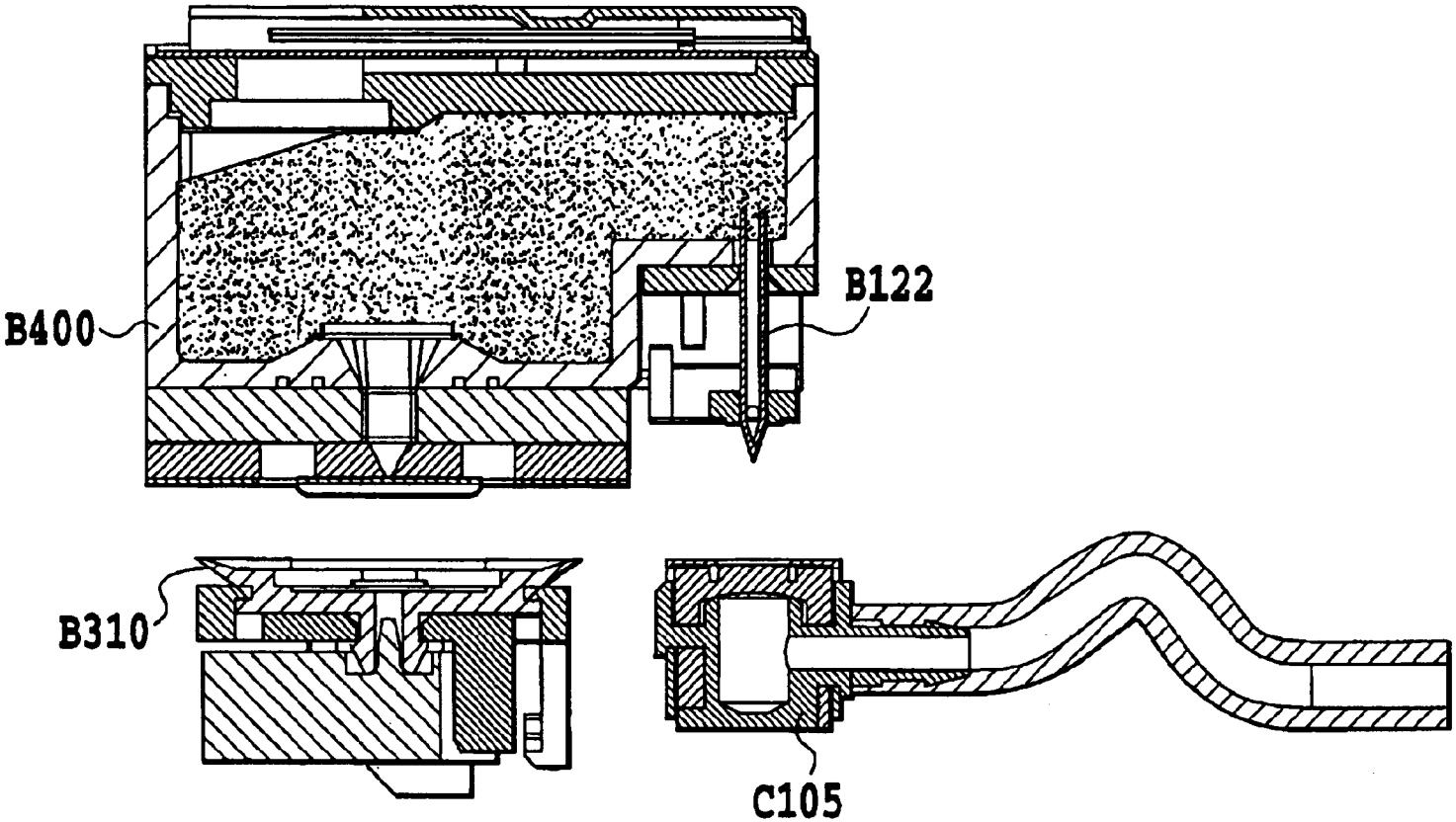
FIG. 27 is a sectional diagram showing printing state of a joint and a suction cap.

FIG. 23 shows stand-by state, FIG. 24 ink supplying state, FIG. 25 ink suction state, FIG. 26 empty suction state, and FIG. 27 printing state.

The joint motor M003 rotates and drives the screw rod B306 through an appropriate gear mechanism (not shown). The screw rod B306 is screwed with a joint slider B307, and therefore the joint slider B307 is reciprocally moved according to the rotation of the screw rod B306. The joint slider B307 is connected integrally with the joint lifter B305.

The joint lifter B305 is fixed with a joint fork B301. Therefore, the joint fork B301 can be moved up and down according to up/down movement of the joint lifter B305. When the medium pack C100 is attached to the printer section B100, the joint C105 of the medium pack C100 is supported by the joint fork B301. Therefore, the joint C105 of the medium pack C100 is also moved up and down according to up/down movement of the joint fork B301. When the joint fork B301 reaches almost the upper side stroke end, as shown in FIG. 24, the needle B122 of the sub-tank B400 completely penetrates the sealing body (joint rubber) C108 of the joint C105, so that an ink supply passage is formed from the main tank C103 of the medium pack C100 to the sub-tank B400 on the carriage B104.

On the upper surface of the joint lifter B305, the suction joint B302 connected to the suction tube B303 for air suction of the cylinder pump B410 is provided. Therefore, the suction joint B302 can also be moved up and down according to up/down movement of the joint lifter B305. When the suction joint B302 is lifted to above the predetermined position, the suction joint B302 is connected with the air suction opening B123, thereby forming an air suction passage between the cylinder pump B410 and the sub-tank B400.

The joint lifter B305 is connected with the suction cap B310 and the atmosphere communication valve B405 through an appropriate mechanism. These suction cap B310 and the atmosphere communication valve B405 are moved up and down at respective timing during up/down movement of the joint lifter B305.

(Control Drive System)

Figure 28:
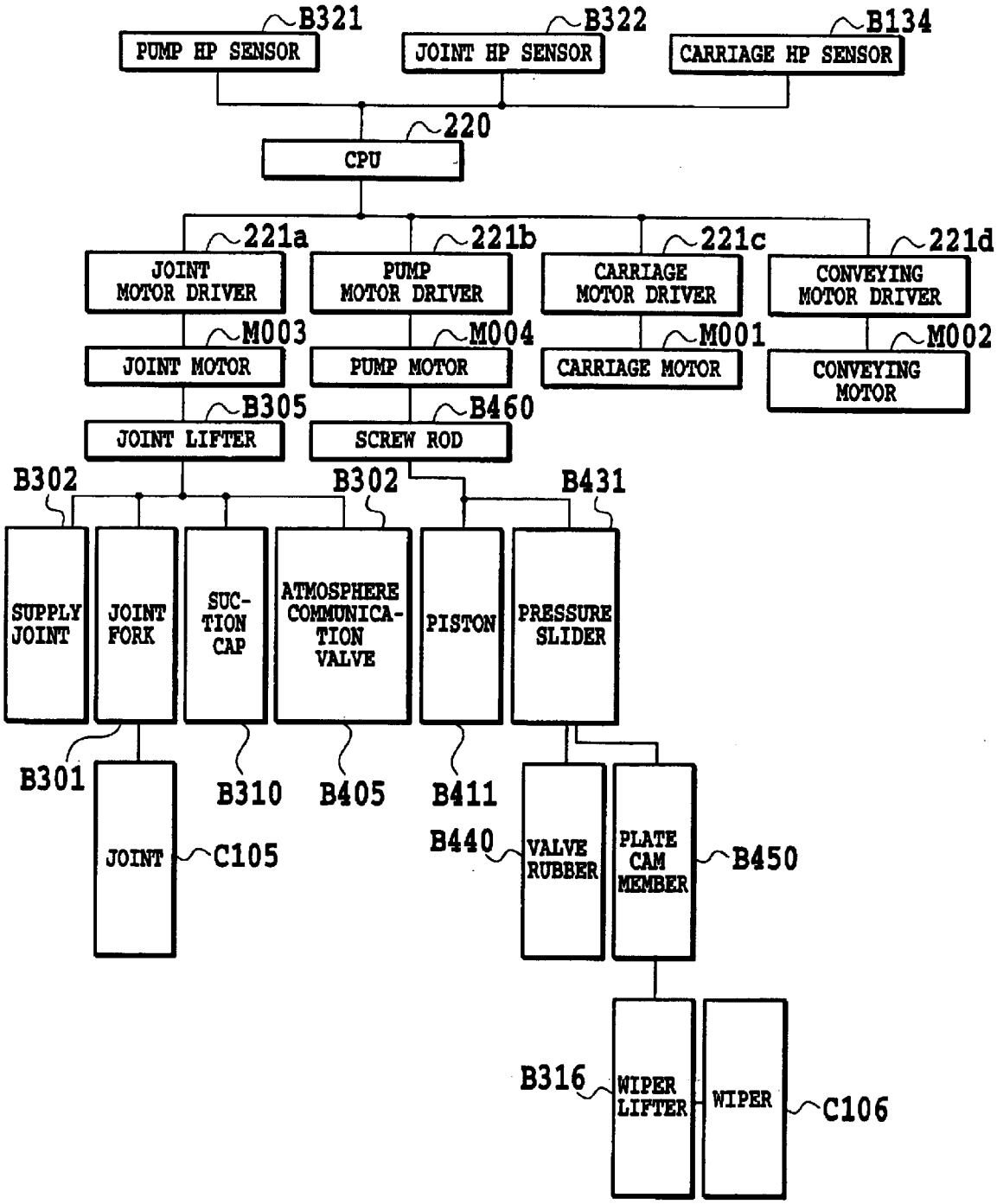
FIG. 28 is a block diagram showing conceptual construction of a control drive system of the ink supply recovery system.

FIG. 28 is a conceptual block diagram showing a brief construction of the control and drive system related to ink supply recovery processing.

A pump HP sensor B321 detects that the piston B411 of the cylinder pump B410 is positioned at stand-by position (home position). A joint HP sensor B322 detects that the joint lifter B305 is positioned at the home position. A carriage HP sensor B134 detects that the carriage B104 is positioned at the home position. Detection signals of these sensors B321, B322 and B134 are inputted to a CPU220.

The CPU220 drive controls the joint motor B305, the pump motor M004, the carriage motor M001 and the conveying motor M002 through a joint motor driver 221*a*, a pump motor driver 221*b*, a carriage motor driver 221*c*, and a conveying motor driver 221*d*.

The joint motor M003 is a driving source of up/down movement of the joint lifter B305. During up/down movement of the joint lifter B305, the suction joint B302, the joint fork B301, the suction cap B310 and the atmosphere communication valve B405 are move up and down at respective predetermined timings.

The pump motor M004 is a driving source of the screw rod B460. The piston B411 of the cylinder pump B410 and the pressure slider B431 are reciprocally moved by the rotation of the screw rod B460. Further, by the movement of the pressure slider B431, a switching of the valve rubber B440 is performed, and up/down movement of the wiper C106 is performed through the plate cam member B450 and the wiper lifter B316.

(Operation Sequence)

Figure 30:
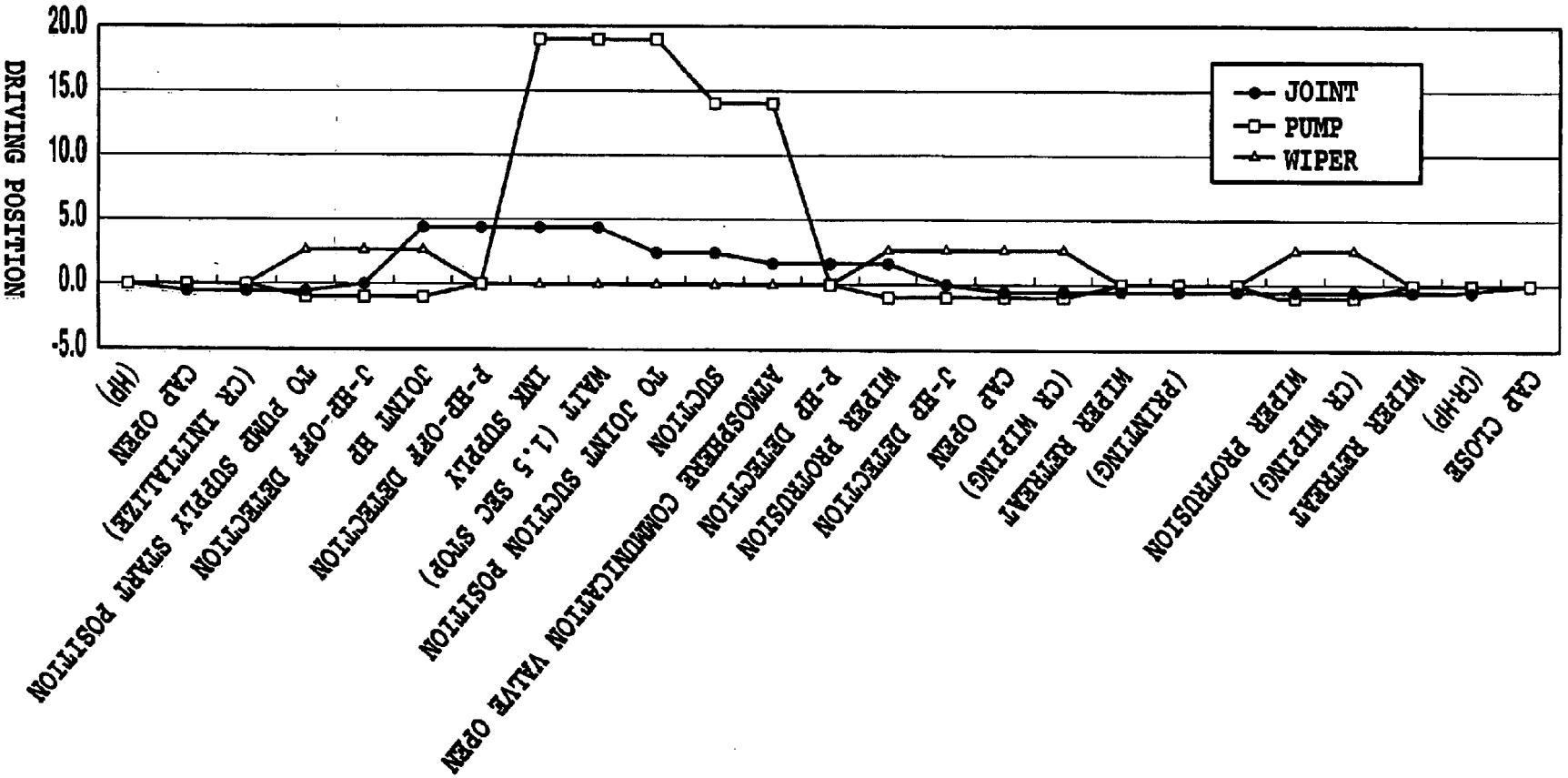
FIG. 30 is a diagram showing changes with the passage of time of drive position of a joint lifter, piston and a wiper in a cycle of ink supply recovery processing.

FIG. 29 shows an example of operation sequence of ink supply recovery processing, and FIG. 30 shows drive positions of the joint lifter B305 and the piston B411 of the cylinder pump B410 and the wiper lifter B316 in one cycle of ink supply recovery processing. Further, FIGS. 31 to 39 are process diagrams for explaining movements of respective components in the ink supply recovery processing cycle.

In the following, operation sequence of the ink supply recovery processing cycle will be described using FIGS. 31 to 39 and the like.

(Before Medium Pack Attachment)

Figure 31:
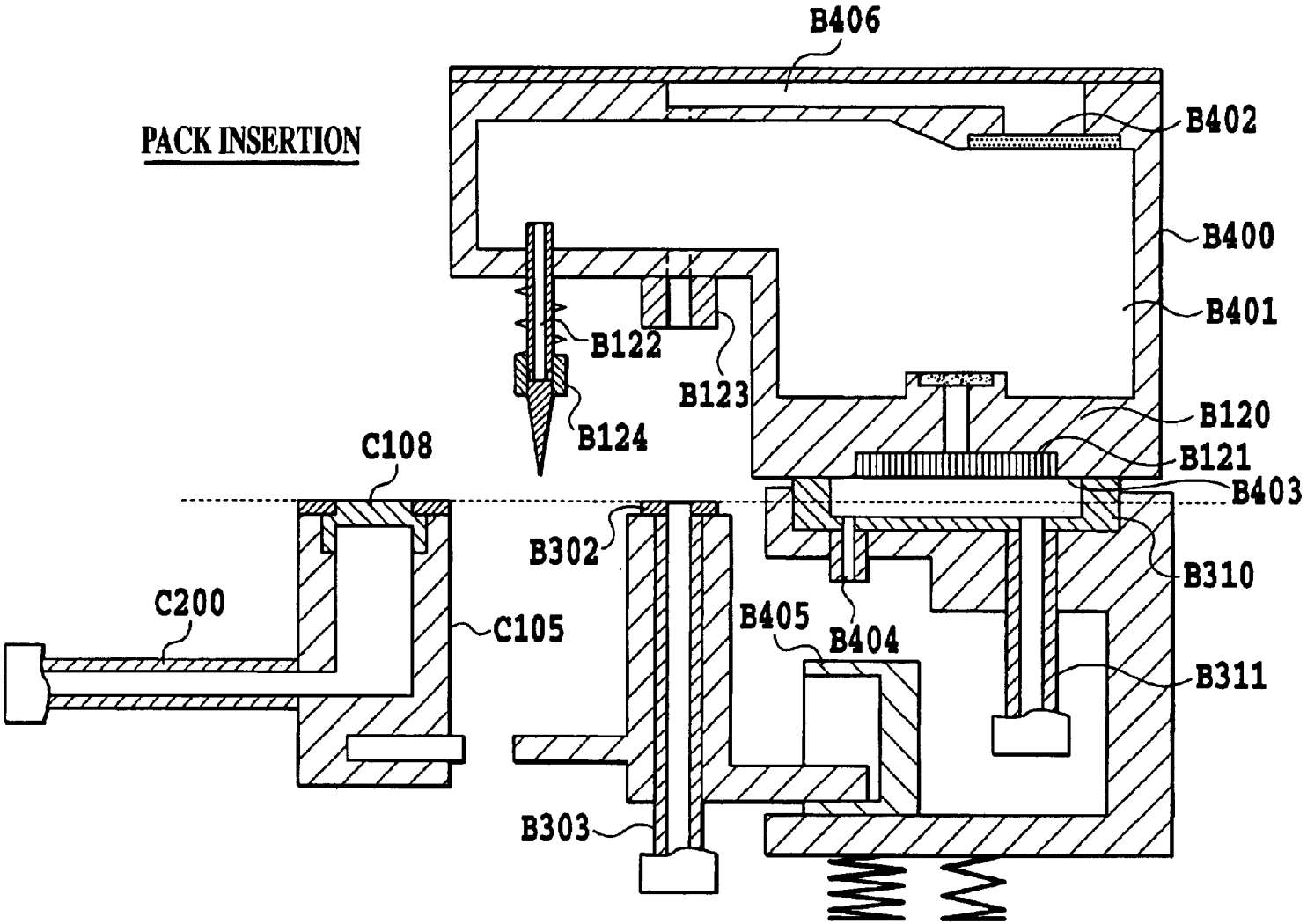
FIG. 31 is a conceptual diagram showing state of each part of the ink supply recovery system before medium pack insertion.

When the medium pack C100 is not attached to the apparatus main body A001, as shown in FIG. 31, the suction cap B310 caps the face B403 of the recording head B120, thereby preventing the ink in the ink ejection opening B121 from drying. Further, at this moment, the suction joint B302 is at a position away from the air suction opening B123 of the sub-tank B400, and the atmosphere communication opening B404 of the suction cap B310 is opened.

(Medium Pack Attachment and Stand-by)

Figure 32:
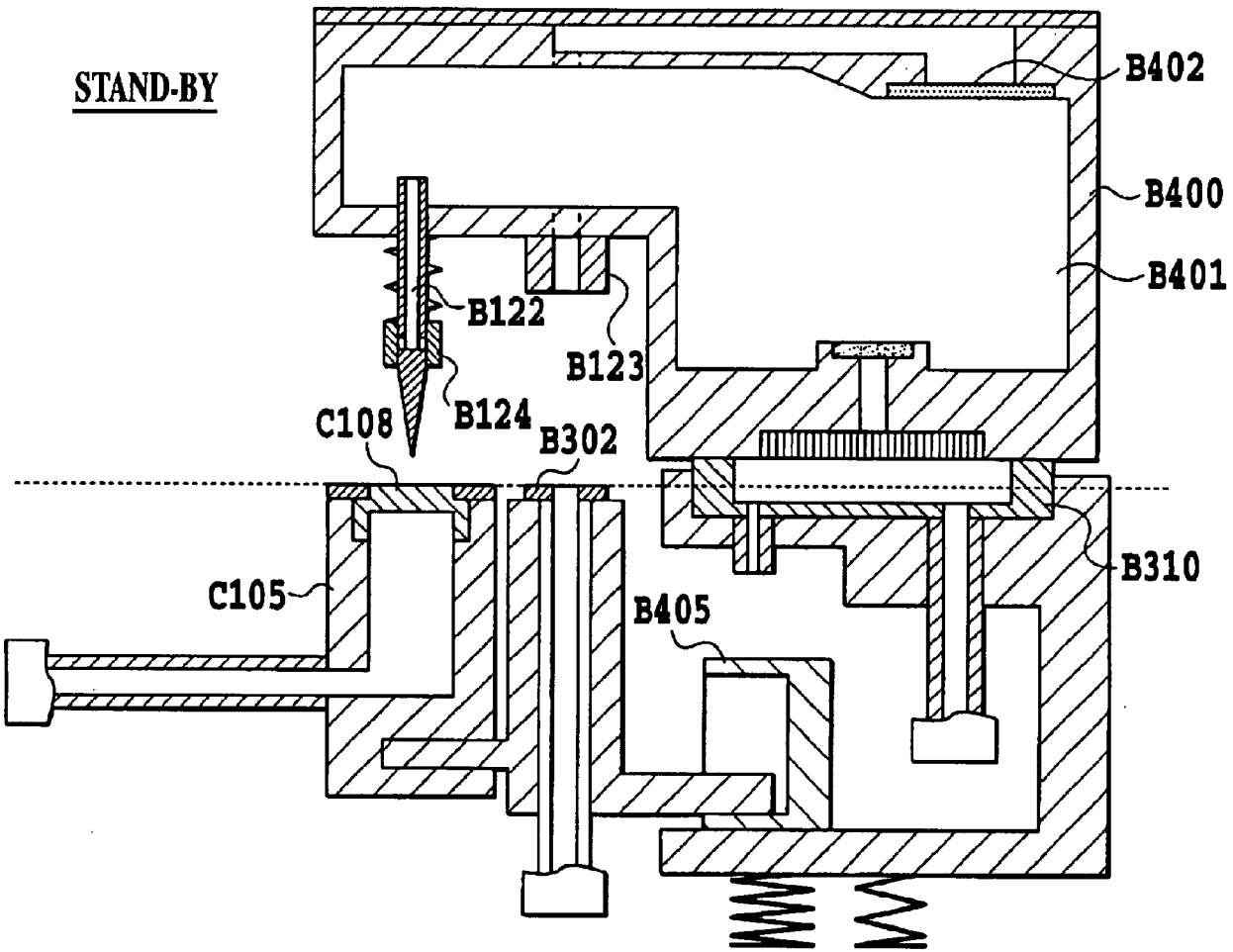

When the medium pack C100 is completely attached to the apparatus main body A001, the joint C105 of the medium pack C100 is supported by the joint fork B301. At this moment, three joint rubbers C108 of the joint C105 are, as shown in FIG. 32 and FIG. 23, positioned right beneath the three needles B122 of the sub-tank B400. The suction joint B302 is positioned right beneath the air suction opening B123 of the carriage B104.

Further, the piston B411 of the cylinder pump B410 is positioned at the stand-by position (home position) shown in FIGS. 16 to 18, and the joint lifter is also positioned at the home position (FIG. 29, step S1). Further, the carriage B104 is also positioned at the home position.

(Carriage Initialization Processing)

When, in this state, a print instruction is outputted, the joint motor M003 is forward rotated and the joint lifter B305 is slightly moved down, which also slightly moves down the suction cap B310. As a result, the suction cap B310 is slightly separated from the face B403 of the recording head B120, and the suction cap B310 is once opened (FIG. 29, step S2). Further, almost simultaneously with this, initialization of the carriage B104 is performed (FIG. 29, step S3).

(Joint Processing)

Next, the pump motor M004 is forward rotated by a predetermined number of pulses to rotate the screw rod B460, whereby the piston B411 of the cylinder pump B410 is slightly traveled from the position shown in FIG. 18 to the ink supply position shown in FIG. 19 (FIG. 29, step S4). Further, by the rotation of the screw rod B460 at this moment, the pressure slider B431 presses the valve rubber B440 through the slide pin B442, as a result thereof, the valve rubber B440, as shown in FIG. 19, is moved to a position to close the suction tube B311. Therefore, the ink suction chamber B414 of the cylinder pump B410 is communicated with the waste ink absorption body C107 of the medium pack C100 through the waste liquid tube B312.

By the movement of the pressure slider B431 at this moment, the plate cam member B450 is moved to the piston travel direction, the wiper lifter B316 is moved up by the function of the cam part B451 of the plate cam member B450, and the wiper C106 of the medium pack C100 is moved up for a small period of time. However, the upward movement of the wiper C106 has no effects on the movement of other components.

On the other hand, the joint motor M003 is reverse rotated so that the joint lifter B305 starts upward movement. When the joint lifter B305 is moved up by a predetermined amount, the joint HP sensor B322 detects that the joint lifter B305 is out of the home position (FIG. 29, step S5). Further, by upward movement of the joint lifter B305, the suction cap B310 again caps the face B403 of the recording head B120. When the drive position of the joint lifter takes a positive value in FIG. 29 and FIG. 30, the suction cap B310 is capping the face B403 of the recording head B120, and when the drive position takes a negative value, the suction cap B310 is separated from the face B403 of the recording head B120.

Figure 33:
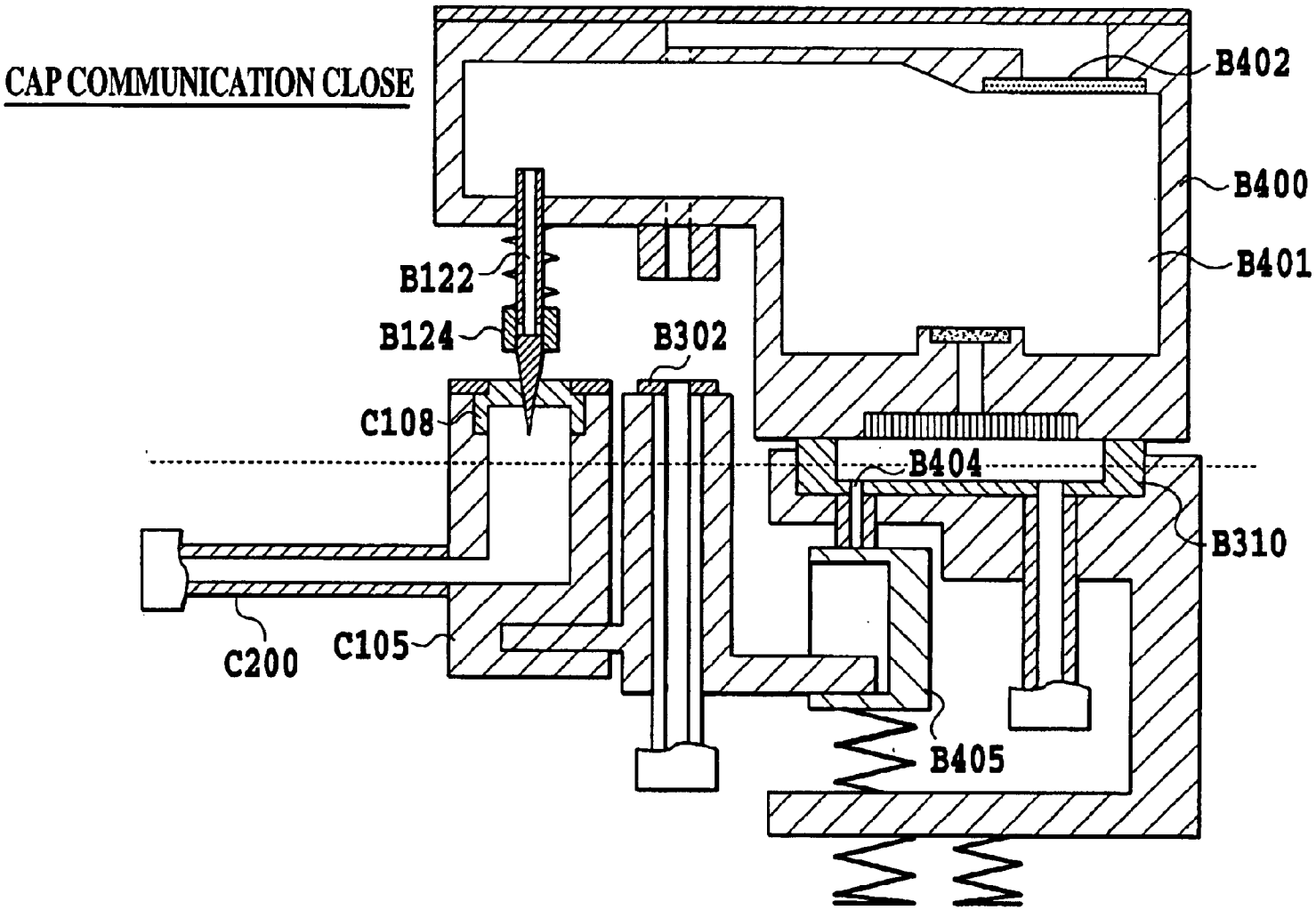
FIG. 33 is a conceptual diagram showing state of each part of the ink supply recovery system before ink supply.
Figure 34:
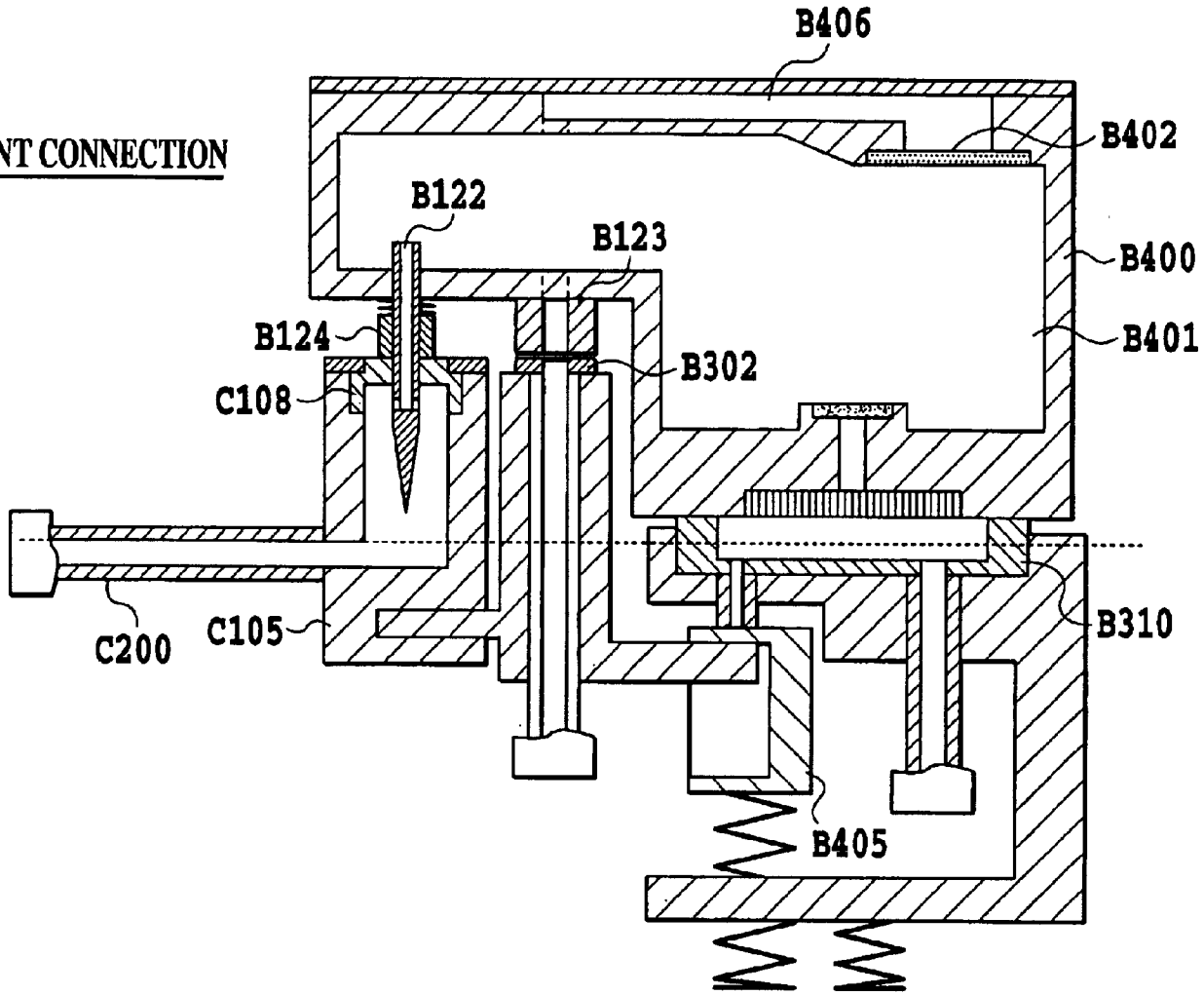
FIG. 34 is a conceptual diagram showing state of each part of the ink supply recovery system during joint connection before ink supply.

During upward movement of the joint lifter B305, as shown in FIG. 33, first the atmosphere communication opening B404 of the suction cap B310 is closed by the atmosphere communication valve B405. The joint lifter B305 is further moved up, as a result thereof, as shown in FIG. 34 and FIG. 24, the needle B122 of the sub-tank B400 is completely inserted in the joint rubber C108 of the joint C105, and the suction joint B302 is connected with the air suction opening B123 of the carriage B104. As a result, an ink supply passage between the medium pack C100 and the sub-tank B400 and an air suction passage between the sub-tank B400 and the cylinder pump B410 are formed (FIG. 29, step S6).

(Ink Supply, Wasting)

In the state that the ink supply passage and the air suction passage are formed as described above, the pump motor M004 starts rotation in the reverse direction. This rotates the screw rod B460 in the reverse direction, and the piston B411 of the cylinder pump B410 is retreated in the right direction from the state shown in FIG. 19 to the state shown in FIG. 21.

During retreating of the piston B411, the pump HP sensor B321 detects that the piston B411 of the cylinder pump B410 is out of the home position (FIG. 29, step S7).

As described above, in association with retreat movement of piston B411, the air suction chamber B413 is pressure reduced and the ink suction chamber B414 is pressurized.

Figure 35:
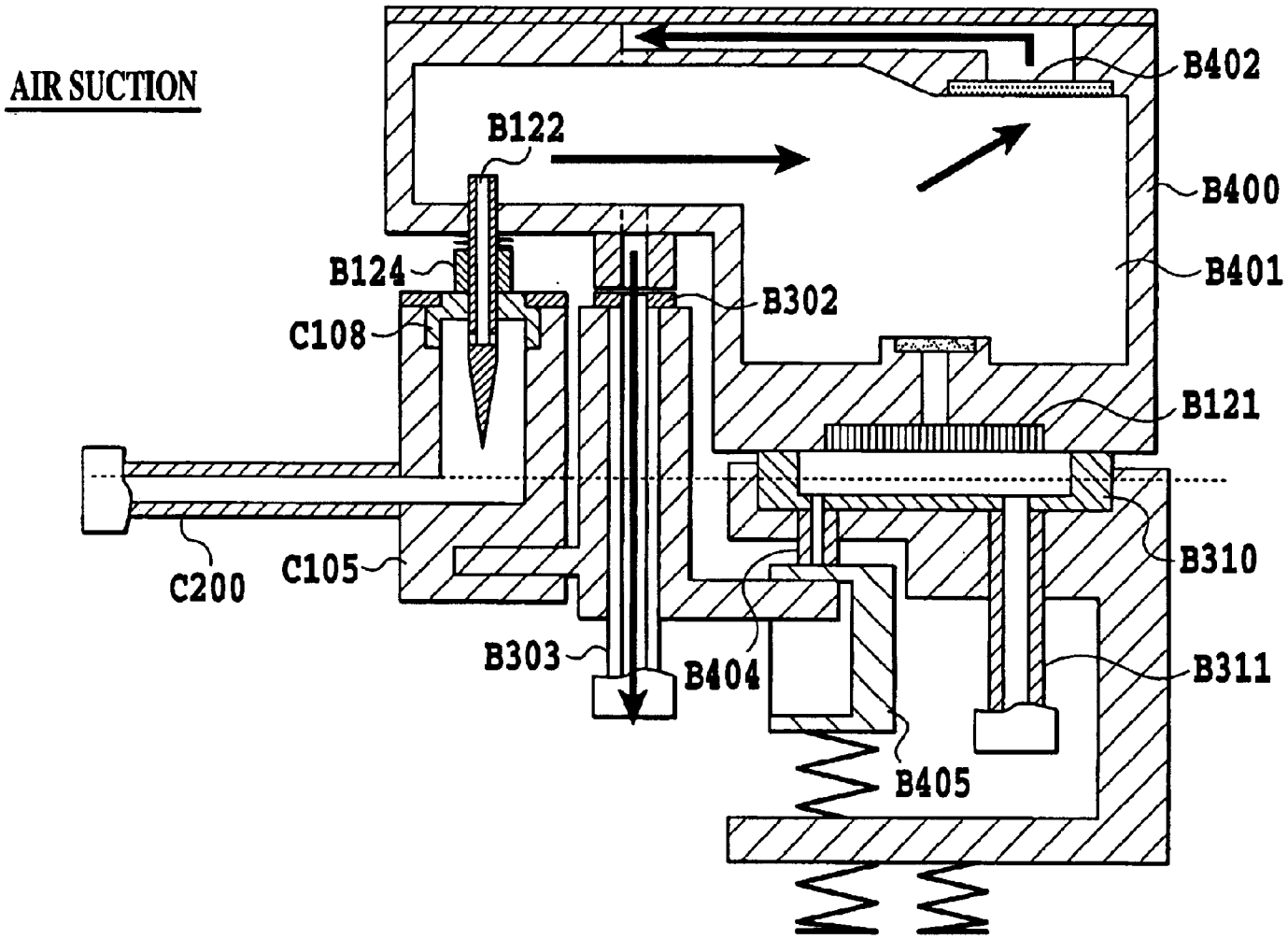
FIG. 35 is a conceptual diagram showing state of each part of the ink supply recovery system during ink supply.

By this operation, air in the sub-tank B400 is sucked to the air suction chamber B413 through the porous film B402, the negative pressure introducing section B406, the air suction opening B123, the suction joint B302, and the suction tube B303. As a result, as shown in FIG. 35, ink is supplied from the main tank C103 of the medium pack C100 to the sub-tank B400 through the ink supply passage C200 of the medium pack C100, the joint C105 and the needle B122 of the sub-tank B400 (FIG. 29, step S8).

On the other hand, since the ink suction chamber B414 of the cylinder pump B410 is pressurized in association with retreat movement of the piston B411, ink stored in the ink suction chamber B414 is flowed to the waste ink absorption body C107 of the medium pack C100 through the waste liquid tube B312 and absorbed and held by the waste ink absorption body C107.

As described above, since waste ink is wasted into the waste ink absorption body C107 in the detachable medium pack C100, the waste ink will not be remained in the printer section B100.

In the second half stage of retreat movement of the above piston B411, as shown in FIG. 20 and FIG. 21, position switching of the valve rubber B440 is performed. That is, as shown in FIG. 20, the tip flange part B419 of the piston B411 contacts against the valve rubber B440 to press it, whereby the valve rubber B440 and the plurality of slide pins B442 are moved in the right direction to the position shown in FIG. 21. As a result, as shown in FIG. 21, the input port B416 connected to the suction cap B310 through the suction tube B311 is opened, and the output port B417 connecting to the waste ink absorption body C107 is closed by the valve rubber B440.

After the piston B411 of the cylinder pump B410 is moved to almost the stroke end at the retreat side shown in FIG. 21, it is allowed to remain stopping by for a predetermined setting time (for example, 1.5 sec.) (FIG. 29, step S9).

(Suction Recovery)

Figure 36:
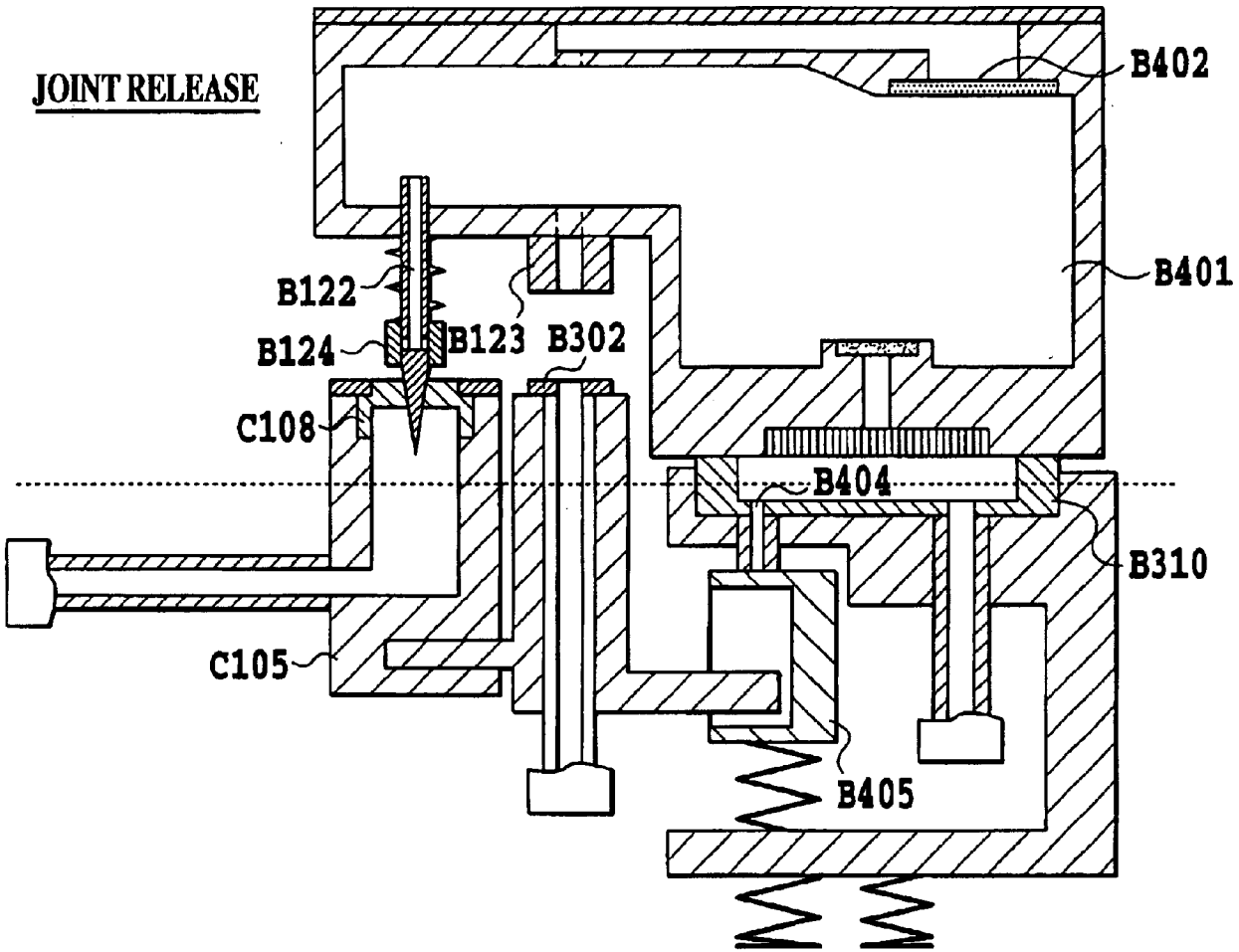
FIG. 36 is a conceptual diagram showing state of each part of the ink supply recovery system before ink suction.

Next, by forward rotatively driving the joint motor M003 to move down the joint lifter B305 by a predetermined distance, as shown in FIG. 36 and FIG. 25, the joint C105 and the suction joint B302 are moved down to the position to suck the ink of the suction cap B310 (FIG. 29, step S10). That is, the suction joint B302 is released from the air suction opening B123 of the carriage B104, and the joint rubber C108 of the joint C105 is disconnected from the needle B122 of the sub-tank B400. At this moment, the needle cover B124 is moved down to the position for protecting the opening of the needle B122 by the righting force of the spring (see FIG. 25). Further, in this state, the atmosphere communication opening B404 of the suction cap B310 is still closed by the atmosphere communication valve B405, and in the cylinder pump B410, as shown in FIG. 21, the ink suction chamber B414 is communicated with the suction tube B311.

In this state, by forward rotating the pump motor M004 to rotate the screw rod B460, the piston B411 of the cylinder pump B410 is traveled to the left direction by about ¼ stroke from the state shown in FIG. 21 (FIG. 29, step S11).

In association with the travel movement of the piston B411, the air suction chamber B413 is pressurized and the ink suction chamber B414 is pressure reduced.

Figure 37:
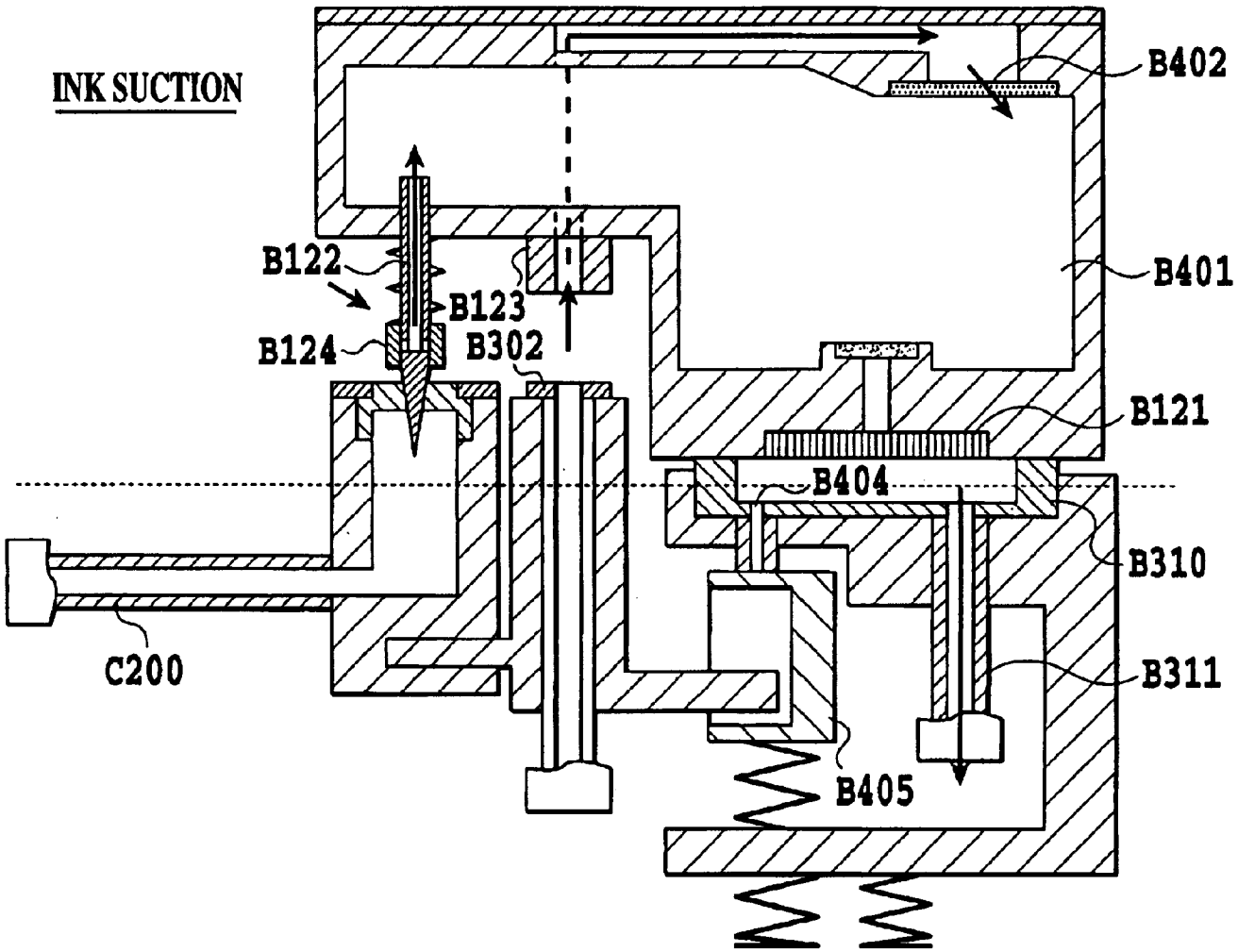
FIG. 37 is a conceptual diagram showing state of each part of the ink supply recovery system during ink suction.

By this operation, as shown in FIG. 37, the inside of the suction cap B310 connected to the ink suction chamber B414 through the suction tube B311 is pressure reduced, as a result thereof ink is sucked from the ink ejection opening B121 of the recording head B120 and stored in the suction cap B310. In association with this ink suction operation, air is sucked through the air suction opening B123 and the opening of the needle B122, thereby introducing sucked air to the porous film B402 and the needle peripheral part.

Here, needle hole of the needle B122 of the sub-tank B400 also serves as an atmosphere communication hole, however, when residual air in the tank B400 is expanded, there is a possibility that supplied ink is pushed out from the needle B122.

Then, immediately after performing ink supply to the sub-tank B400, joint connection is separated, and in this state ink suction is performed from the ink ejection opening B121 to suck a predetermined amount of ink to flow in air from the needle hole of the needle B122, thereby providing an air space in the tank B400. By this operation, even when residual air is expanded, only air is discharged from the ink supply needle B122, thereby preventing ink leakage.

(Empty Suction)

Figure 38:
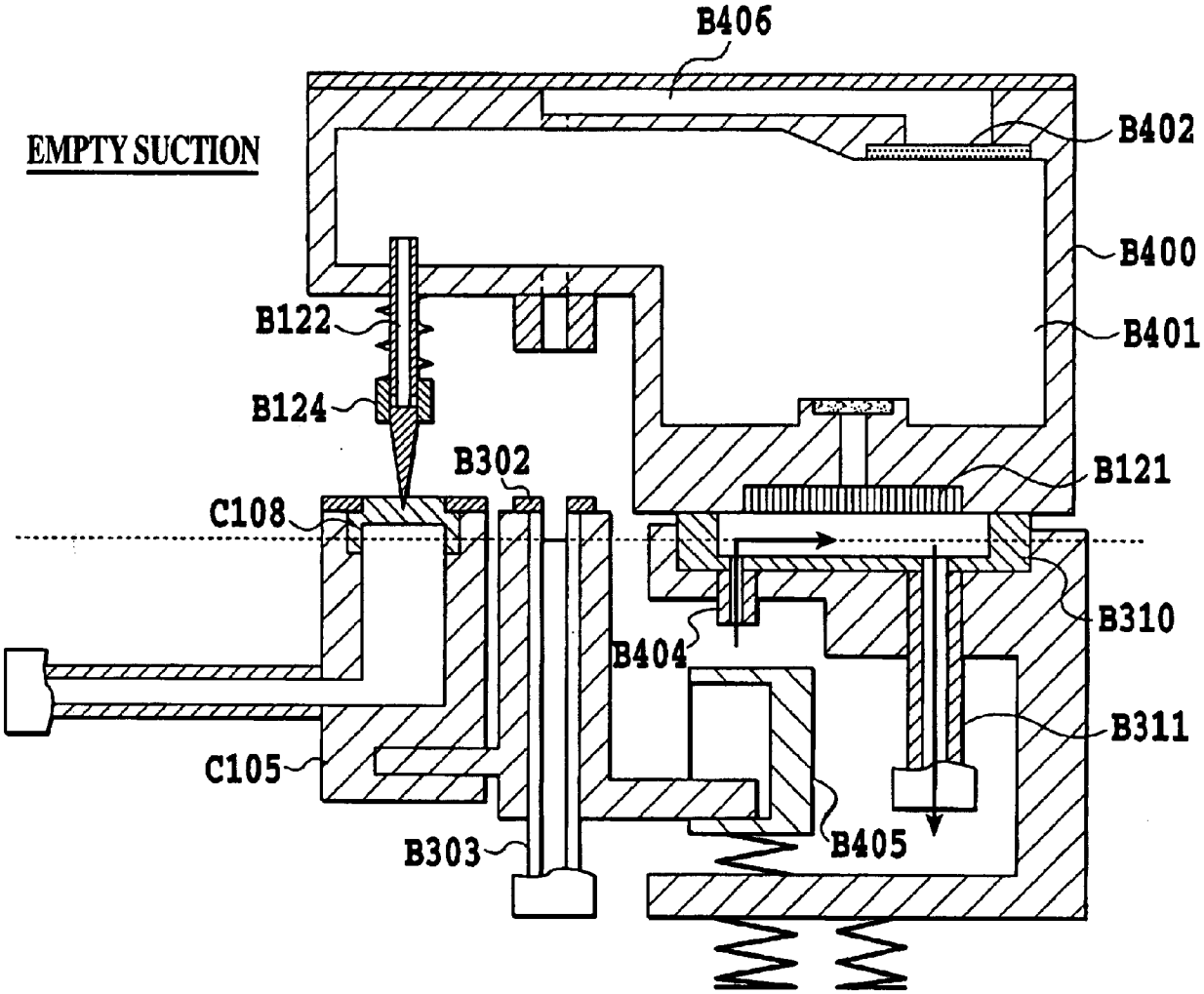
FIG. 38 is a conceptual diagram showing state of each part of the ink supply recovery system during empty suction.

Next, by further forward rotatively driving the joint motor M003 to move down the joint lifter B305 by further predetermined distance, as shown in FIG. 38 and FIG. 26, the atmosphere communication valve B405 is move down to the open position. By this operation, the atmosphere communication opening B404 of the suction cap B310 is opened (FIG. 29, step S12).

In this state, by further forward rotating the pump motor M004 to rotate the screw rod B460, the piston B411 of the cylinder pump B410 is traveled to the left direction to the ink supply start position shown in FIG. 19 through the stand-by position shown in FIG. 18 further from the position traveled as described above by about ¼ stroke (FIG. 29, steps S13, S14).

By this operation, the ink suction chamber B414 is further pressure reduced, and as a result thereof, as shown in FIG. 38, ink stored in the suction cap B310 is flowed into the ink suction chamber B414 of the cylinder pump B410 through the ink suction tube B311. Further residual ink in the suction tube B311 is also flowed into the ink suction chamber B414. By performing such empty suction, color mixing in respective nozzles is prevented.

In the course of travel movement to the left direction of the piston B411, the pump HP sensor B321 detects that the piston B411 is positioned at the home position at the time when the piston B411 of the cylinder pump B410 is traveled to the position shown in FIG. 18 (FIG. 29, step S13).

Further, when the piston B411 of the cylinder pump B410 is traveled from the state shown in FIG. 18 to the ink supply position shown in FIG. 19, as described above, by the movement of the pressure slider B431, switching of valve rubber B440 and upward protrusion operation of the wiper C106 of the medium pack C100 through the wiper lifter B316 are carried out (FIG. 29, step S14).

(Suction Cap Open)

Figure 39:
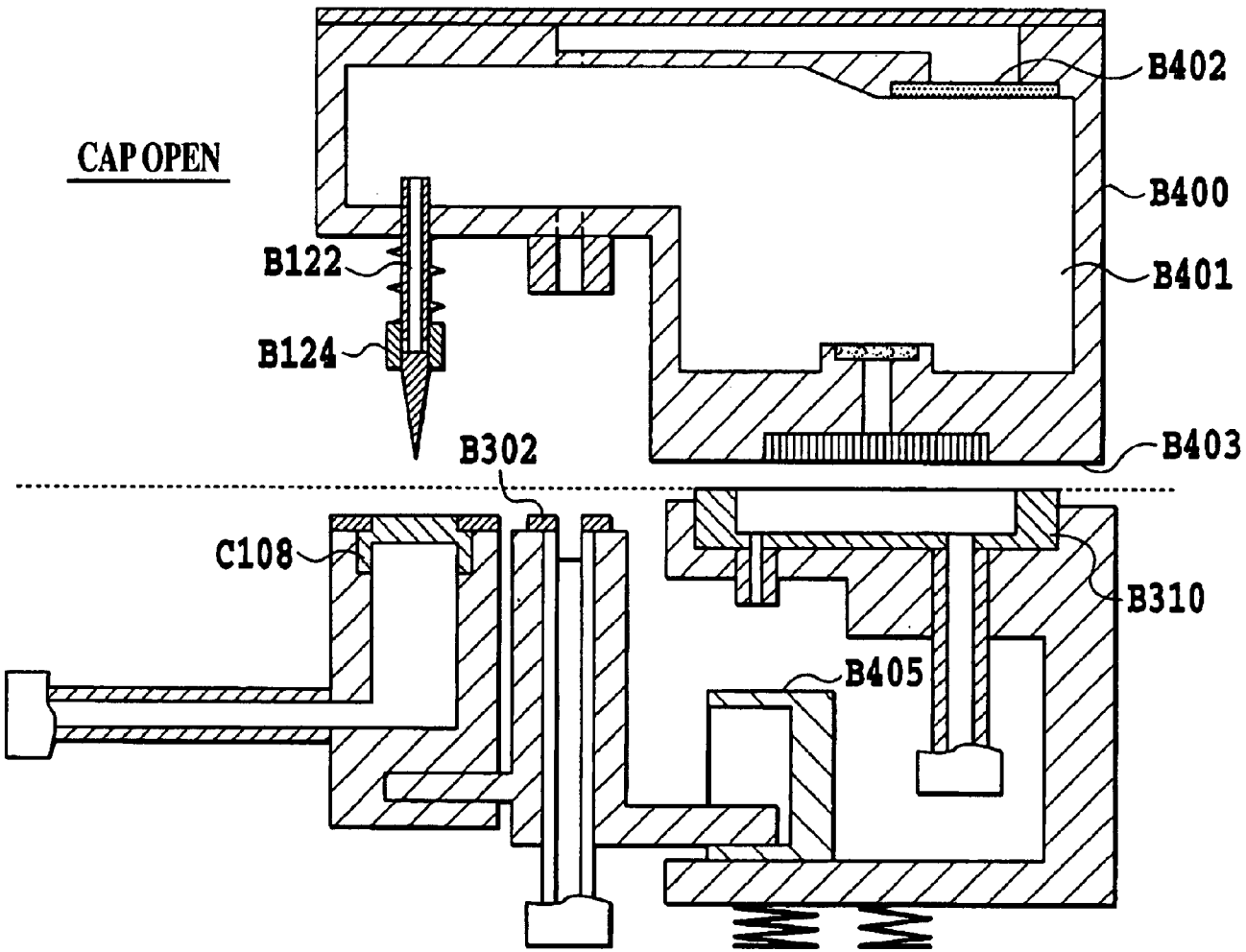
FIG. 39 is a conceptual diagram showing state of each part of the ink supply recovery system during printing.

Next, by forward rotatively driving the joint motor M003 to move down the joint lifter by further predetermined distance, as shown in FIG. 39, the suction cap B310 is caused to separate from the face B403 of the recording head B120 and make the suction cap B310 an open state (FIG. 29, steps S15, S16). By the downward movement of the joint lifter B305, the joint C105 and the suction joint B302 are also further moved down. Further, during the downward movement of the joint lifter B305, when the joint lifter B305 is at a predetermined stand-by position, the joint HP sensor B322 detects that the joint lifter B305 is positioned at the home position.

(Wiping)

In this state, after the carriage motor M001 is driven, the carriage B104 is moved to the position of the wiper C106 of the medium pack C100, and at this wiper position, the carriage B104 is reciprocally moved once to a plurality of times, it is returned to the original home position (FIG. 29, step S17). By this operation, ink adhered to the face B403 of the recording head B120 is wiped by the wiper C106.

As described above, since wiping is performed using the wiper C106 provided on the medium pack C100, scattering of ink at the printer section B100 side is prevented.

After completion of the wiping, the pump motor M004 is reverse rotated to rotate the screw rod B460, thereby retreating the piston B411 of the cylinder pump B410 in the right direction from the position shown in FIG. 19 to the stand-by position shown in FIG. 18. By the rotation of the screw rod B460, the pressure slider B431 is also moved to the right, thereby also moving the plate cam member B450 in the right direction by the righting force of the spring B453. As a result, the wiper lifter B316 engaging with the cam part B451 of the plate cam member B450 is moved down, and the wiper C106 of the medium pack C100 is also retreated.

Thus, one cycle of ink supply and suction recovery operation is completed, and printing by the printer section B100 becomes possible.

(Printing)

In the printer section B100, the carriage B104 is moved and the recording head B120 is driven while transporting a sheet of printing medium C104 taken out from the medium pack C100, thereby performing the instructed predetermined printing operation (FIG. 29, step S19).

When printing is subsequently performed after the end of printing to a sheet of a printing medium, the procedure is returned to step S4. Thereafter, the processing above step S4 to S19 is performed again, that is, ink supply for printing next page, suction recovery operation and printing next page are performed.

As described above in the present apparatus, since ink supply and suction recovery operation are performed every time a sheet is printed, a high-quality printing can be stably performed. Further, when printing is ended, the following steps S20 to step S24 are carried out following step S19.

(Wiping)

At the end of printing, the cylinder pump B410 is in stand-by state as shown in FIG. 18. From this state, the pump motor M004 is forward rotatively driven to rotate the screw rod B460, for moving the pressure slider B431 in the lift direction to the state shown in FIG. 19. By this operation, the plate cam member B450 is moved to the left, and the wiper lifter B316 is also moved up. As a result, the wiper C106 of the medium pack C100 is protruded (FIG. 29, step S20).

Next, by driving the carriage motor M001 to reciprocally move the carriage B104 at the wiper position, ink adhered to the face B403 of the recording head B120 during printing is wiped by the wiper C106 (FIG. 29, step S21).

Next, by reverse rotatively driving the pump motor M004 to reverse rotate the screw rod B460, the pressure slider B431 is moved from the state shown in FIG. 19 to the position shown in FIG. 20. By this operation, the plate cam member B450 is moved to the right, the wiper lifter B316 is moved down, and the wiper C106 of the medium pack C100 is retreated (FIG. 29, step S21).

After that, when it is detected that the carriage B104 reverts back to the home position (FIG. 29, step D22), the joint motor M003 is reverse rotatively driven to slightly move up the joint lifter B305 and the suction cap B310 is also moved up. By this operation the face B403 of the recording head B120 is capped by the suction cap B310 (FIG. 29, step S24).

(Preliminary Ejection)

Although omitted in the above operation sequence, preliminary ejection operation for intentionally ejecting ink from the ink ejection opening B121 of the recording head B120 to the suction cap B310 or the like may be performed after wiping of step 18 of FIG. 29. Further, as necessary, preliminary ejection may be performed at an appropriate time.

As described in the above embodiment, since the cylinder pump B410 uses one side cylinder chamber of the piston B411 as air suction chamber B413, the other side cylinder chamber as ink suction chamber B414, so that the respective cylinder chambers perform suction operation by reciprocal operation of the piston B411, this configuration greatly contributes to down-sizing of the pump construction. Further, since, rather than by switching the valve provided outside the cylinder pump B410, by positional switching of valve rubber 440 provided inside the pump cylinder B304, ink suction and ink discharge of the ink suction chamber B414 are switched, the pump structure can be reduced in size. Further, since the screw rod B460 is engaged inside the piston shaft B441*a* to move the piston B441, as compared with the case in which another member connected to the piston shaft B441 is engaged with the screw rod B460, the structure for reciprocally moving the piston shaft 441 is reduced in size.

Further, in the present embodiment, a relief valve B420 is provided in the piston shaft B411*a* of the cylinder pump B410 to take less space and to prevent the porous film B402 from being applied with an excessive ink pressure during ink supply, whereby assuring reliable operation of the porous film B402.

Further, in the present embodiment, the cylinder chamber B414 inserting the piston shaft B411*a* is used for ink suction, and the other cylinder chamber B413 for air suction. Therefore, suction amounts of the respective cylinder chambers B413 and B414 can be set to different values for the same stroke. Therefore, by changing the shaft diameter of the piston shaft B411*a*, the suction volume ratio of the ink suction chamber B414 and the air suction chamber B413 can be easily changed.

(Second Embodiment)

Next, with reference to FIGS. 40 to 47, a second embodiment by another pump unit including the cylinder pump B500 will be described.

Figure 40A:
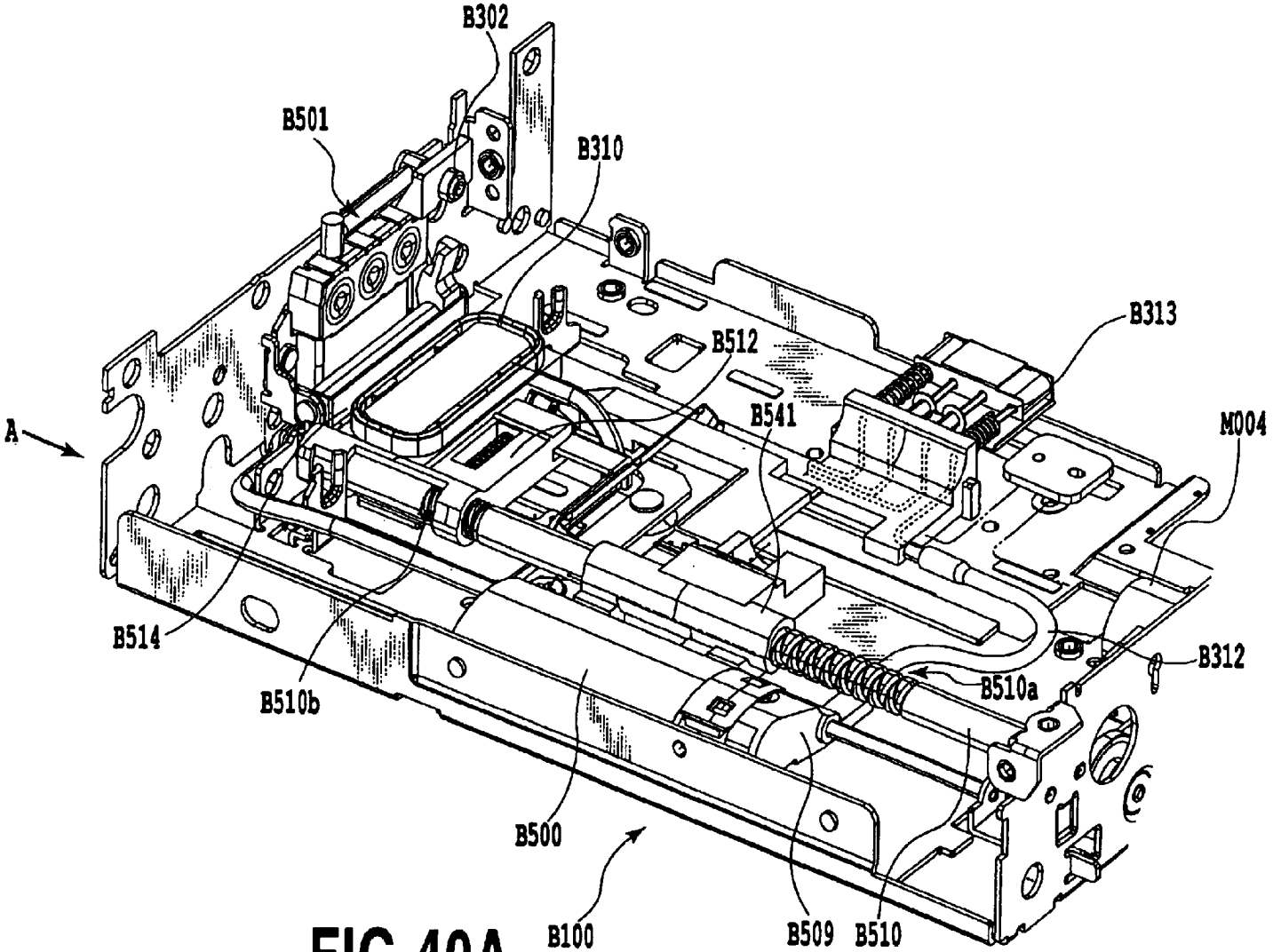
FIG. 40A is a perspective diagram of the structure of ink supply system in the printer section of FIG. 6 using another pump unit.
Figure 40B:
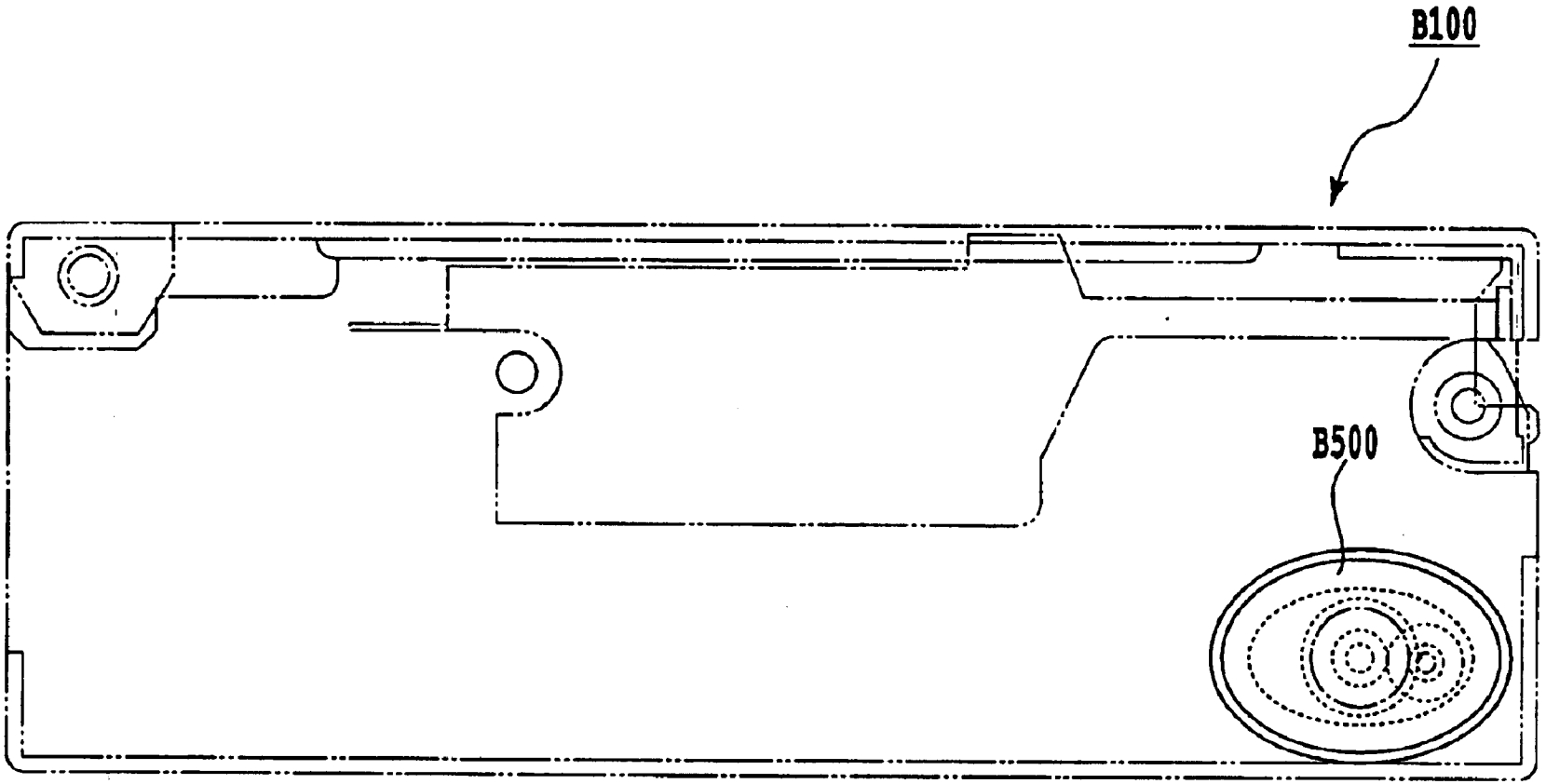
FIG. 40B is a schematic diagram showing only the pump unit viewed from the arrow A direction in FIG. 40A.

The cylinder pump B500, which is a main component of such a pump unit, in the present embodiment, as shown in FIGS. 40A, 40B, a piston B521 slidably moving in the cylinder B531 of the pump has an elliptical cross section. Accordingly, the cross section of the cylinder B531, which is also used as an external case of the cylinder pump B500, is also nearly elliptical.

Because the cross section of the piston of the pump is elliptical, when the pump is disposed in the printer, its height can be suppressed, which contributes to a reduced height of the entire printer. For example, as compared with the case of using a piston with a circular cross section of the same height in the disposed state, the elliptical cross section can provide a greater cross sectional area of the cylinder, which provides a shorter stroke, thereby providing a smaller size in the pump height and longitudinal direction. As described above, when the installation space of the pump in the printer has a room to some extent in the longitudinal direction of the ellipse, or when suppression of the printer height is preferential from the design, as in the present embodiment, it is effective that the cross sectional shape of the piston is made elliptical, and accordingly the cross sectional shape of the cylinder is made elliptical.

In particular, as in the present embodiment, in the case of the printer integral with a camera, it is effective because the printer height is limited. Specifically, as shown in FIGS. 5 and 6, the printer section B100, from the requirement of integral camera, the cross section is rectangular, on the other hand, the cylinder pump B500 and its drive mechanism and the like are substantially required to be disposed in the lower half of the printer section B100, that is, in the lower side of the transportation path of the printing medium. Therefore, the elliptical cross sectional shape in the present embodiment is preferable because the height of the cylinder pump B500 is a height to be under side of the transportation path and the cross sectional area inside the cylinder is ensured to obtain an effective suction force with a limited stroke.

Further, when considering gas-tightness of the piston to the cylinder, the elliptical shape is advantageous for applying a uniform pressure to the inner surface of the cylinder as compared to, for example, one which includes a straight part in the cross sectional shape.

As can be seen from the above description, the cross sectional shape of the piston is not necessarily required to be elliptical. A flattened shape with a suppressed height of one side can provide the above desired function. Preferably it is one which does not include a straight part in the shape in view of sealing with the cylinder.

Figure 41:
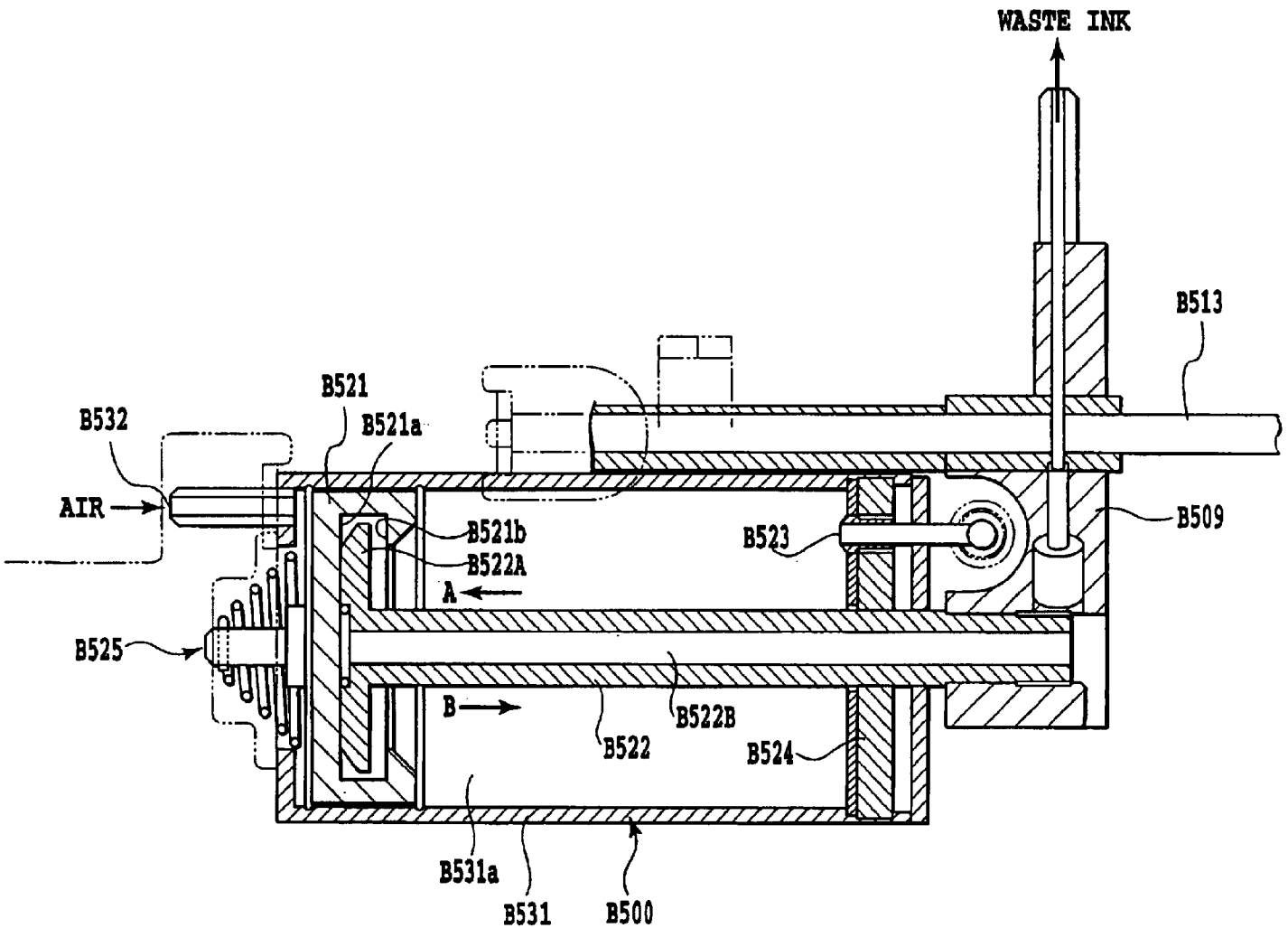
FIG. 41 is a cross sectional diagram showing the structure of the pump used in the pump unit of FIG. 40A.

The cylinder pump B500, as will be described later, according to a predetermined rotation of the lead screw B510, is a generation source of pressure for ink supply to respective ink reserving section of the carriage B104 and ink suction through the suction cap B310. FIG. 41 is a diagram showing internal structure of the cylinder pump B500 for this purpose.

As shown in FIG. 41, the cylinder pump B500, as main elements, comprises a cylinder main body B531, a piston B521 and a piston shaft B522. The cylinder main body B531, as described above, also comprises a case as an outer shape of the cylinder pump B500, which is fixed to the printer. On the other hand, the piston shaft B522 is connected with a pump driving arm B509 whereby the piston B521 can move in the cylinder B531 according to the rotation of the lead screw B510.

The piston B521 is engaged with the inner wall of the cylinder main body B531 through an O-ring provided at its end. This makes the parts (air suction chamber and ink suction chamber) partitioned by the piston B521 of the cylinder inside B531*a* non-communicational with each other and slidable with the inner wall.

The piston shaft B522 has a valve B522A formed at its one end, and has a hollow part B522B extending in the axial direction. The valve B522A, according to the movement of the piston shaft B522, can move freely in the inner space formed inside the piston B521. According to the movement, when the sealing part formed of a flexible material such as rubber closely contacts with the inner upper surface B521*a* of the inner space so as to surround the opening of the hollow part B522B above the valve B522A, the hollow part B522B of the piston shaft B522 and the cylinder inside B531*a* (ink suction chamber) can be made non-communicational with each other and air-tight. On the other hand, when the valve B522A contacts against the inner lower surface B521*b* of the inner space, the hollow part B522B of the piston shaft B522 and the cylinder inside (ink suction chamber) 531*a* are communicational through a groove (not shown) formed on the lower surface of the valve B522A.

At the upper end (left side in the figure) of the cylinder B531, an air introduction opening B532 is formed. The air introduction opening B532 communicates with a suction joint B302 shown in FIG. 40A, whereby at the time when ink is supplied from the medium pack C100 to respective ink reserving section of the carriage B104, air suction can be performed. Further, at the upper end of the cylinder main body B531, a pressure adjusting valve mechanism B525 is provided. The pressure adjusting valve is possible to adjust a pressing force by its spring. When the negative pressure of the cylinder inside (air suction chamber) B531*a* between the cylinder main body B531 and the piston B521 becomes a magnitude corresponding to the adjusted pressing force (when the pressure decreases to the corresponding value), the valve opens and, as a result, the negative pressure is adjusted to a constant value. By this operation, the air suction can be performed at a consistent negative pressure.

On the other hand, at the lower end (right side in figure) of the cylinder B531, a sealing member B524 is provided. The sealing member B524 is possible to make the cylinder inside B531*a* airtight to the outside and slidable with the piston shaft B522B while keeping the same air-tightness. The sealing member B524 is provided with an ink introduction opening B523, which communicates with the suction cap B310 shown in FIG. 40A. This makes it possible to introduce waste ink sucked through the suction cap B310 to the inside the cylinder (ink suction chamber) B531*a*. In this communication passage, a check valve (not shown) is provided, whereby ink from the suction cap B310 is passed and, to the contrary, ink flow discharged from the cylinder inside (ink suction chamber) B531*a* can be blocked.

With the above construction, when ink is supplied from the ink pack of the medium pack C100 to respective ink reserving section of the sub-tank B400 of the carriage B104, by predetermined rotation of the lead screw B510, the piston B521 moves downward (in the direction of arrow B in FIG. 41), so that generates a negative pressure in the cylinder inside B531*a* (air suction chamber). By this negative pressure, air is sucked from respective ink reserving section of the carriage B104 communicating with the cylinder inside (air suction chamber) B531*a* through the suction joint B302 and the like, thereby making the inside of the ink reserving section negative pressure and introducing ink from the ink pack to respective ink reserving section. At this time, only air passes through the above porous film B402, and ink passage is blocked. When the introduced ink reaches the porous film further suction is not performed due to a pressure balance or the like.

During the downward movement of the piston B521 in the cylinder main body B531, waste ink sucked through the suction cap B310 in the previous process to the cylinder inside (ink suction chamber) B531*a* once flows to the upper side of the valve B522A through a groove formed on the lower surface of the valve B522A, and then discharged through the hollow part B522B of the piston shaft B522. The discharged waste ink is passed through the inside passage and the like of the pump driving arm B509, and finally to the waste ink absorption body C107 of the medium pack C100.

On the other hand, in the suction recovery operation, by predetermined rotation of the lead screw B510, the piston B521 moves up (in the direction of arrow A in FIG. 41) in the cylinder. By this operation, a negative pressure is generated in the cylinder inside (ink suction chamber) B531*a*, so that the inside of the suction cap B310 connecting with it and covering the nozzle disposition surface of the recording head can be made negative pressure. By this negative pressure, ink discharged through the nozzle can be conducted to the cylinder inside (ink suction chamber) B531*a*. At this time, as described above, the valve B522A of the piston shaft B522 closely contact with the upper surface of the inner space of the piston, the cylinder inside B531*a* and the hollow part B522B of the piston shaft B522 are in the air-tight state with each other, thus maintaining air-tightness.

During the upward movement of the piston B521, simultaneously, air above the piston (air in the air suction chamber) is discharged towards the suction joint B302 through the air introduction opening. At this time, since the suction joint B302 is released from connection with the carriage B104, a case is prevented that the discharged air reaches the ink reserving section of the carriage and pressures the recording head from the inside.

With the above described construction of the cylinder pump B500, unlike the pump unit in the first embodiment, since the hollow part B522B of the piston shaft B522 is used as an ink discharge passage, it is not necessary to provide a switching valve in the cylinder as seen in the pump used in suction recovery processing in the first embodiment. Therefore, a piston stroke for position adjustment of the valve with the piston is needless to be considered, as a result thereof, the piston stroke can be reduced. Further, since the pressure adjusting mechanism is provided outside the cylinder, in the production of the pump, assembly or incorporation process can be made easy.

The lead screw B510, as described above, has a role of function of power transmission of various operations and setting of timing, including ink supply operation from the medium pack C100 to the ink reserving section of the carriage B104 or suction recovery operation through the suction cap B310. The lead screw B510, as shown in FIG. 40A, has two spiral grooves B510*a* and a single spiral groove B510*b* formed with a predetermined distance from the former groove. The spiral groove B510*a* is engaged with part of pump slider B541 to move the pump driving arm B509. On the other hand, the spiral groove B510*b* is engaged with part of switching slider B512, whereby moving the switching slider B512.

Operations performed by the movement of the pump slider B541, as described above, are ink supply to the ink reserving section, suction recovery and wiping. On the other hand, operations performed by the movement of the switching slider B512 are capping operation of the suction cap B310 to the recording head and releasing operation of the joint B501 and the carriage B104.

Figure 42:
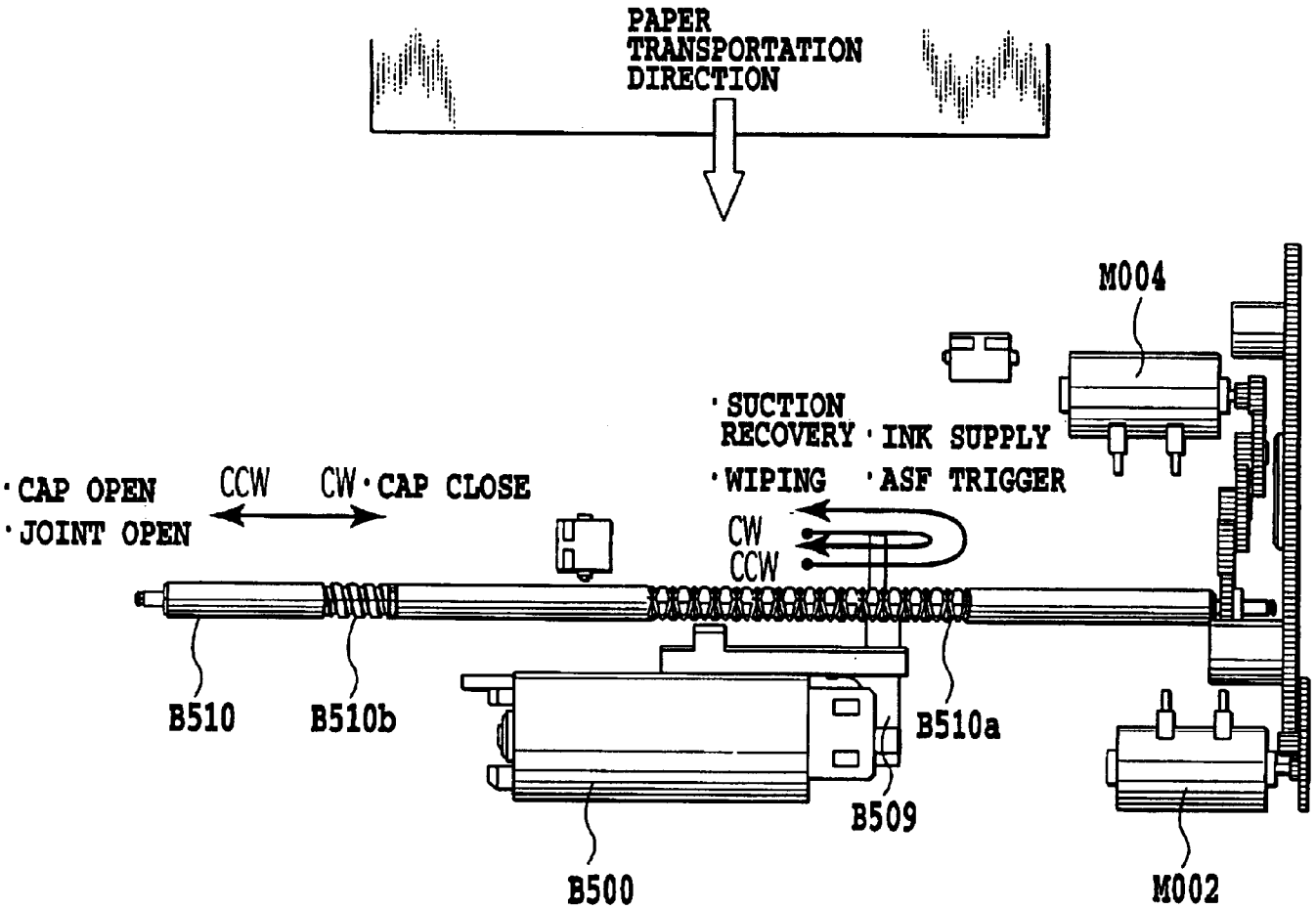
FIG. 42 is a diagram for explaining operation by lead screw of the pump unit of FIG. 40A.

FIG. 42 is a diagram for explaining the relationship between the lead screw B510 and a driving force transmission mechanism of pump motor M004 for generating a driving force for rotating the same and the above various operations by the lead screw B510. In this figure, the conveying motor M002 for supply of printing medium and transmission mechanism thereof are also shown.

In the following, with reference to the operation positions of the driving arm B509 and operation position of the switching slider B512 shown in FIG. 42, and FIGS. 43 to 47, power transmission and setting of timing of various operations by the lead screw B510 will be described.

Figure 43:
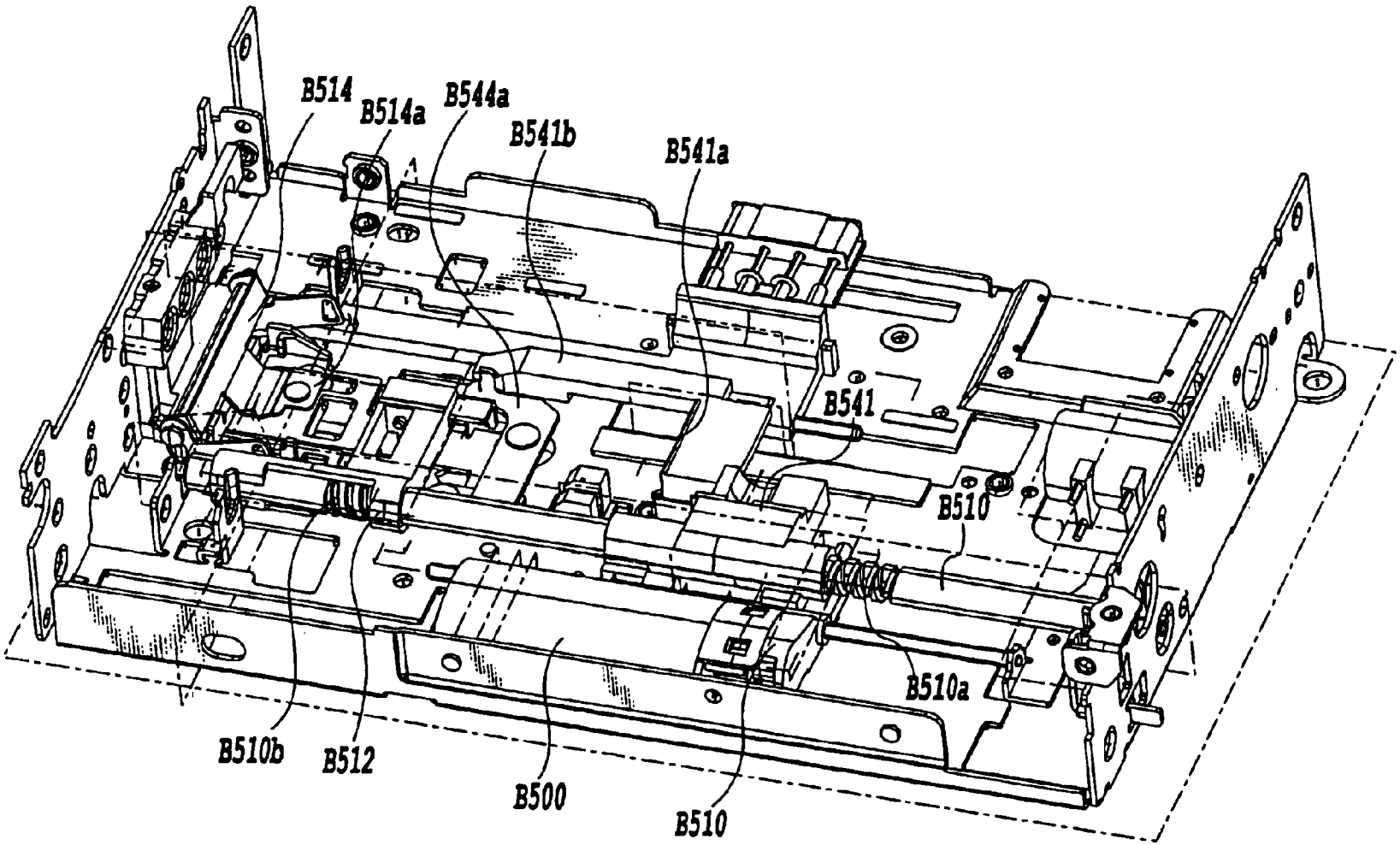
FIG. 43 is a perspective diagram showing the printer main body for explaining various operations according to positions of the pump drive arm and the switching slider moved by the lead screw of the pump unit.
Figure 44:
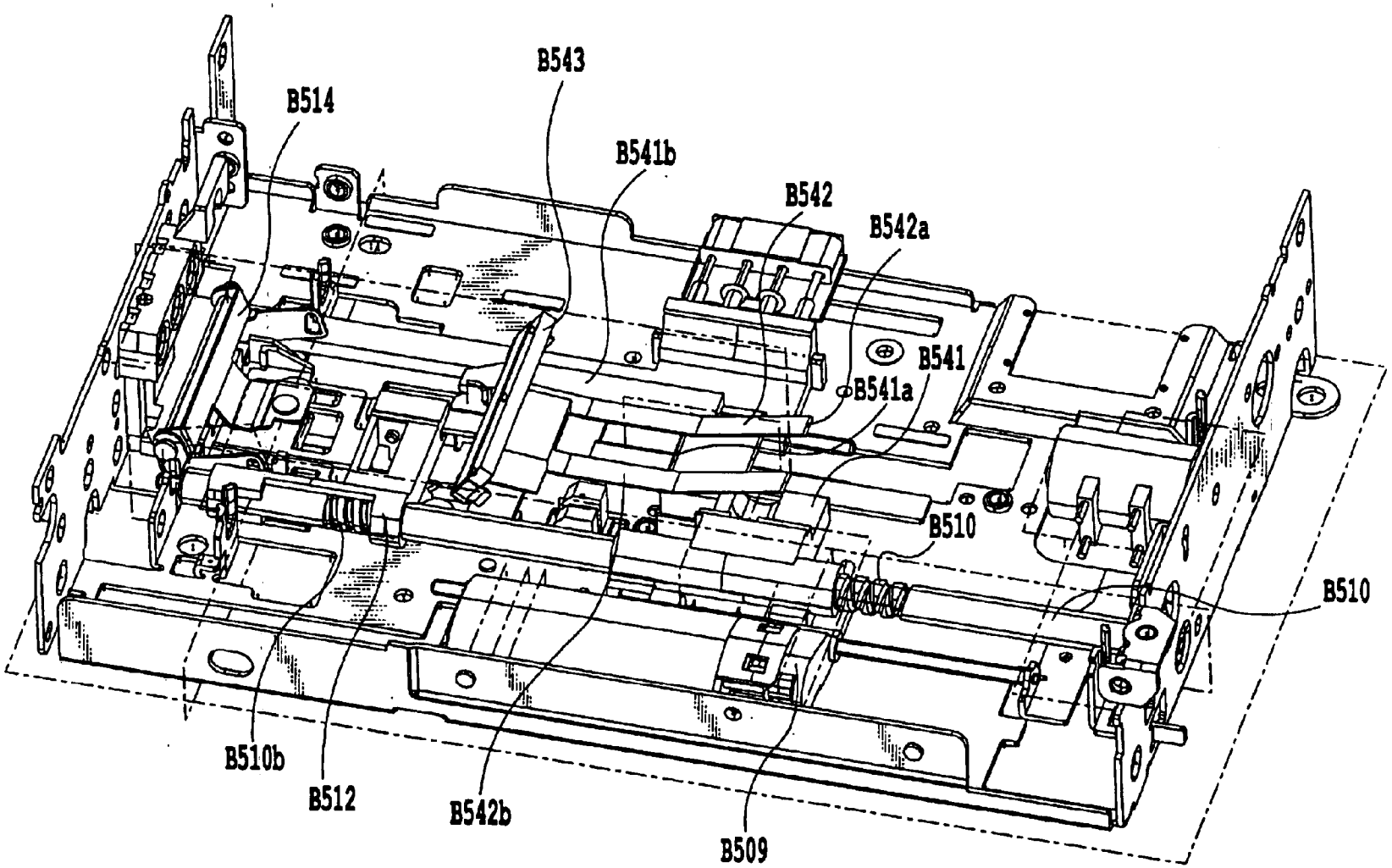
FIG. 44 is a diagram showing the same state shown in FIG. 43 shown with another subject matter added.
Figure 46A:
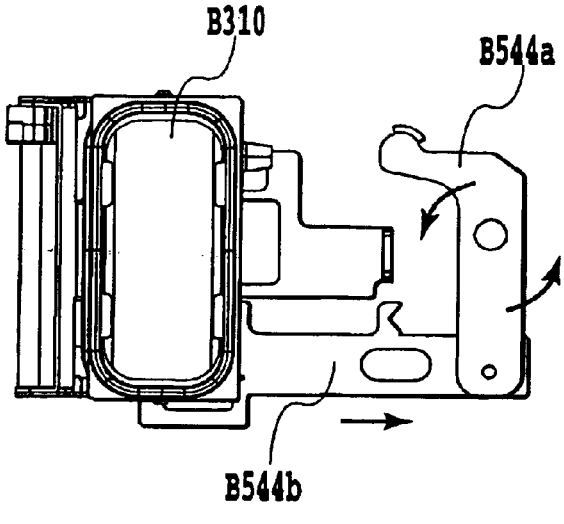
FIGS. 46A, 46B and 46C are diagrams for explaining the state of an atmosphere communication valve of the suction cap in respective states shown in FIG. 43, FIG. 44 and FIG. 45.
Figure 46B:
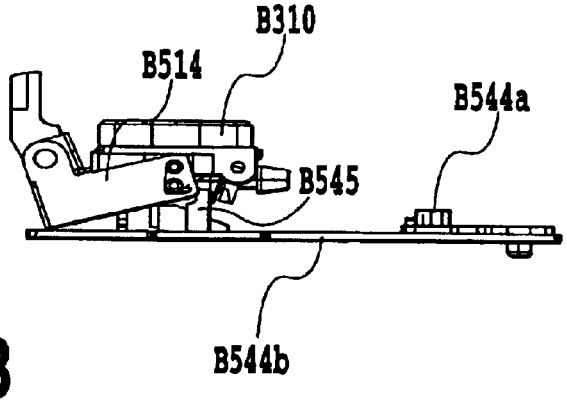
Figure 46C:
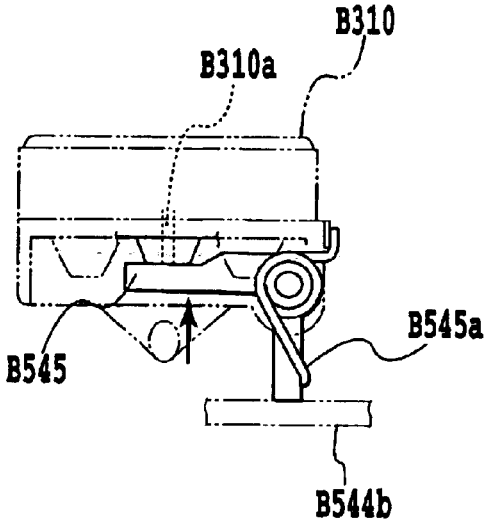
Figure 47A:
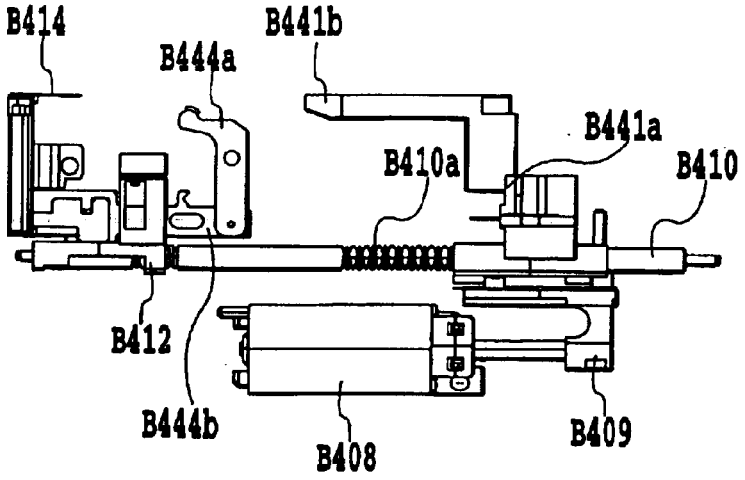
FIGS. 47A, 47B and 47C are diagrams for explaining the state of mechanism for operating the atmosphere communication valve of the suction cap in respective states shown in FIG. 43, FIG. 44 and FIG. 45.
Figure 47B:
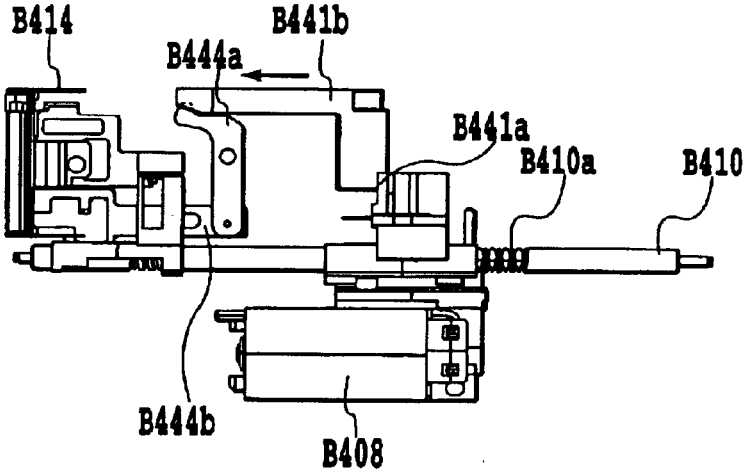
Figure 47C:
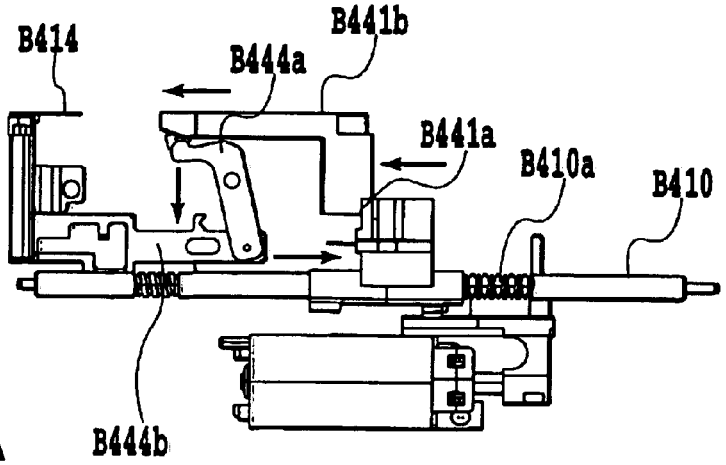

FIG. 43 shows the positions of the pump slider B541 and the switching slider B512 when the wiper and the suction cap B310 are at the ascended positions. At this time, the pump slider B541 is positioned at the left end relative to the spiral groove B510*a* of the lead screw B510, by movement to this left end, the wiper pressure part B541*a* of the pump slider B541 is moved. The wiper pressure part B541*a*, by its movement, as shown in FIG. 44, pushes up part of the plate spring-formed receiving part B542*b* of the wiper base B542 which supports its end part B542*a* by a predetermined member. By this operation, the wiper B543 becomes a rising state. At the same time, the releasing valve arm B541*b* connecting at the tip of the wiper pressure part 541*a* pushes the releasing lever B544*a*, as shown in FIG. 47C, to drive the lever and the releasing valve plate B544*b* cooperating with this lever, and to move atmosphere communication valves B545 (FIGS. 46B and 46C) to atmosphere communication positions. Further, by the movement to the left end, the above-described suction recovery processing can also be performed.

At this moment, the other switching slider B512 is at the right end relative to the spiral groove B510*b* of the lead screw B510, whereby the cap lever arm B514 is at the position where the suction cap B310 (not shown) is moved up (cap close; capping state). That is, the switching slider B512 is partly connected to the cap lever arm B514, by the movement to the right of the switching slider B512, the cap lever arm B514 is rotated, and the part B514*a* can be moved up the position where the suction cap B310 is moved up.

Figure 45:
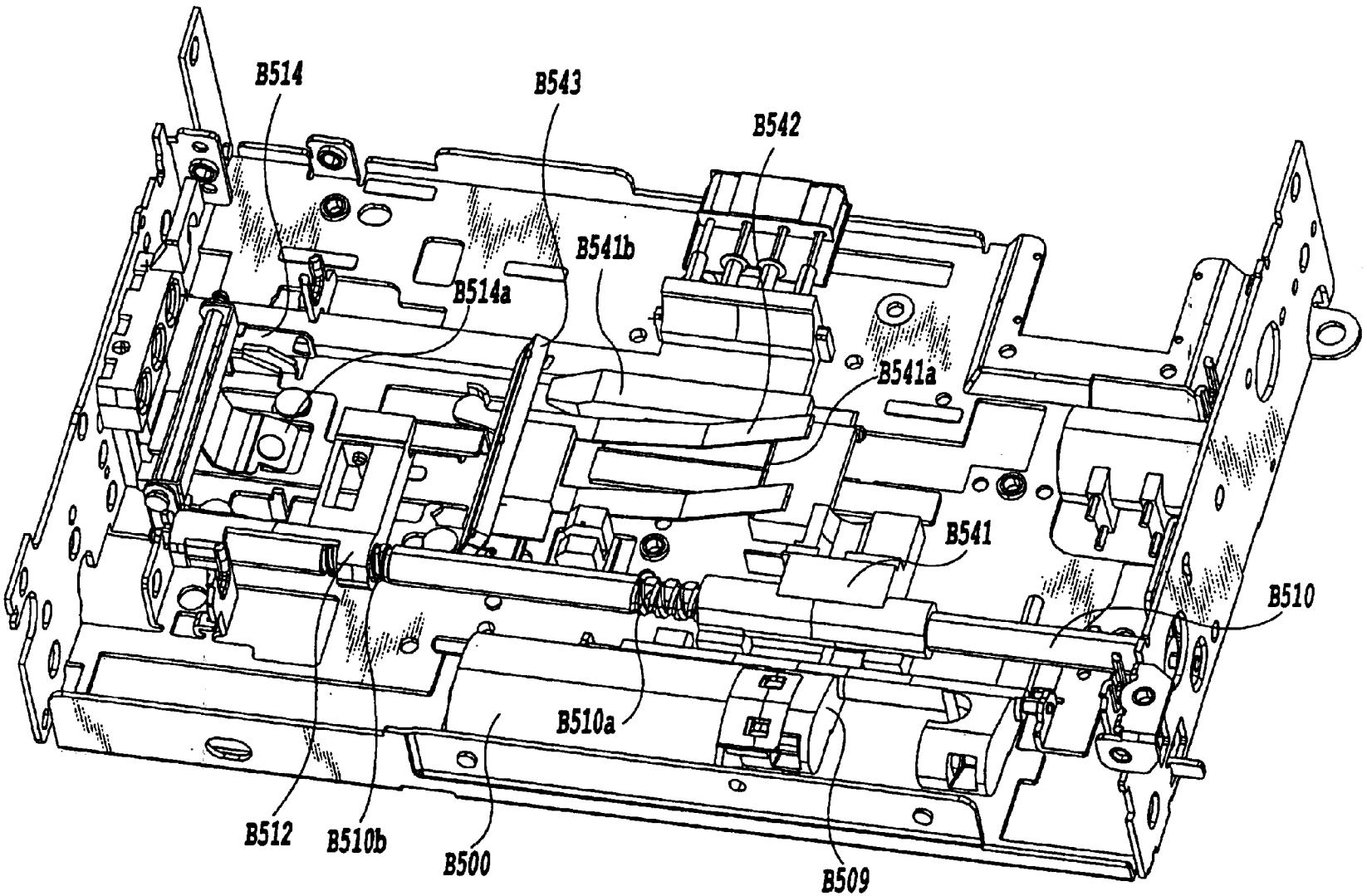
FIG. 45 is a perspective diagram of the printer main body for explaining various operations according to other positions of the pump drive arm and the switching slider moved by the lead screw of the pump unit.

FIG. 45 is a diagram showing the state of other positions relative to the respective spiral grooves of the pump slider B541 and the switching slider B512 shown in FIGS. 43 and 44. The figures show the state when the pump slider B541 is at the right end relative to the spiral groove B510*a* and the switching slider B512 is in the middle of the spiral groove B510*b*.

At this moment, the wiper pressure part B541*a* is at the retreated position from the pushed-up position of the wiper base B542, whereby the wiper B543 is at the retreated position from the movement range of the carriage B104. Further, when the joint B501 is in the state connected with respective needles of the carriage, by the movement to the right end, ink supply to the ink reserving section by the above pit-in can be performed. Further, at this time, the releasing valve arm B541*b* of the pump slider B541 is in the state shown in FIG. 47A, the atmosphere communication valve B545 of the suction cap B310 is in valve-close state as shown in FIG. 46C.

On the other hand, by moving the switching slider B512 to the left, the cap lever arm B514 is rotated, whereby its part B514*a* is pressed down and the suction cap B310 can be made open state.

As described above, the state described with reference to FIGS. 43 to 47 is a basic example of the positions of the pump driving arm and the switching slider according to the rotation of the lead screw B510. That is, by the clockwise rotation or counterclockwise rotation of the lead screw B510, the spiral groove B510*a* and the spiral groove B510*b*, by appropriately determining the formation ranges or lengths thereof and the densities of spiral grooves, as in the first embodiment, the above described basic operations are made possible, and by combinations of these, various processing using the pump motor M004 are made possible. For example, in the above description, upward movement of the suction cap B310 and rising of the wiper C106 are performed simultaneously, only the wiper rising can be performed.

As described above, with the present invention, since different fluids such as air and ink are flowed in the cylinder chambers on both sides of the piston, by reciprocal movement of the piston, suction of different fluids are performed by these respective cylinder chambers, a compact pump can be provided. Further, since suction discharge operation in one cylinder chamber is switched by port switching means provided in the cylinder, the pump structure can be made compact. Further, since the screw rod is engaged inside the piston shaft to move the piston, the pump structure can be reduced in size.

Further, since a relief valve is provided in the piston of the pump cylinder, the pump structure can be reduced in size. Still further, the porous film is prevented from being applied with an excessive pressure during ink supply, whereby assuring reliable operation of the porous film.

Further, since the piston shaft is inserted in one cylinder chamber of the pump cylinder, suction amounts of the respective cylinder chamber can be set to different values with the same piston stroke. Therefore, by changing the shaft diameter of the piston shaft, the suction volume ratio of both ink suction chambers can be easily changed.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. A cylinder pump unit comprising:

a cylinder pump including a reciprocally movable piston and a cylinder main body having a first cylinder chamber partitioned at one side of said piston and introduced with air and a second cylinder chamber partitioned at the other side of said piston and introduced with ink, wherein said second cylinder chamber has an input port for sucking ink and an output port for discharging ink;

a piston driving means for reciprocally moving said piston of said cylinder pump, wherein a piston shaft of said piston is extended to outside said cylinder main body through said second cylinder chamber and connected to said piston driving means; and a port switching means for performing switching of opening and closing of said input port and said output port in association with movement of said piston so that when said second cylinder chamber is pressure reduced by movement of said piston, said output port is closed and said input port is opened, and when said second cylinder chamber is pressurized by movement of said piston, said input port is closed and said output port is opened.

2. A cylinder pump unit according to claim 1, wherein said port switching means is incorporated in said second cylinder chamber.

3. A cylinder pump unit according to claim 1, wherein said piston driving means comprises a screw rod engaging with said piston shaft, and rod driving means for rotatively driving said screw rod.

4. A cylinder pump unit according to claim 1, wherein said piston driving means comprises a pump driving arm for connecting through said piston shaft;

a lead screw engaging with said pump driving arm for reciprocally driving said pump driving arm; and screw driving means for rotatively driving said lead screw.

5. A cylinder pump unit according to claim 1, wherein said first cylinder chamber is connected with an air suction part provided with a porous film in an ink tank, said air suction part introduces a negative pressure that supplies ink from intake into the ink tank, and said piston shaft is a hollow cylindrical body and provided with a relief valve at a tip of said piston shaft for maintaining suction pressure of said first cylinder chamber at less than a predetermined pressure.

6. A cylinder pump unit according to claim 5, wherein a setting relief pressure of said relief valve is set smaller than a pressure capable of maintaining performance of said porous film.

7. A cylinder pump unit according to claim 1, wherein cross sectional form of said cylinder pump is elliptical.

8. A cylinder pump unit comprising:

a cylinder pump including a reciprocally movable piston and a cylinder main body having a first cylinder chamber partitioned at one side of said piston and introduced with air and a second cylinder chamber partitioned at the other side of said piston and introduced with ink; wherein said second cylinder chamber has an input port for sucking ink;

a piston driving means for reciprocally moving said piston of said cylinder pump;

a piston shaft of said piston, which is extended to outside said cylinder main body through said second cylinder chamber and connected to said piston drive means, wherein said piston shaft has a hollow cylindrical form, and said hollow part is an output port for discharging ink; and a port switching means for performing switching of opening and closing of said input port and output port in association with movement of said piston so that when said second cylinder chamber is pressure reduced by movement of said piston, said output port is closed and said input port is opened, when said second cylinder chamber is pressurized by movement of said piston, said input port is closed and said output port is opened.

9. A cylinder pump unit according to claim 8, wherein said port switching means is a check valve provided in a passage communicating with said input port and a check valve provided between said piston and said piston shaft.

10. A cylinder pump unit according to claim 8, wherein said piston driving means comprises a screw rod engaging with said piston shaft, and rod driving means for rotatively driving said screw rod.

11. A cylinder pump unit according to claim 8, wherein said piston driving means comprises a pump driving arm for connecting through said piston shaft;

a lead screw engaging with said pump driving arm for reciprocally driving said pump driving arm; and screw driving means for rotatively driving said lead screw.

12. A cylinder pump unit according to claim 8, wherein said first cylinder chamber is connected with an air suction part provided with a porous film in an ink tank, said air suction part introduces a negative pressure that supplies ink from intake into the ink tank, and said piston shaft is a hollow cylindrical body and provided with a relief valve at a tip of said piston shaft for maintaining suction pressure of said first cylinder chamber at less than a predetermined pressure.

13. A cylinder pump unit according to claim 12, wherein a setting relief pressure of said relief valve is set smaller than a pressure capable of maintaining performance of said porous film.

14. A cylinder pump unit according to claim 8, wherein cross sectional form of said cylinder pump is elliptical.

* * * * *

UNITED STATES PATENT AND TRADEMARK OFFICE

CERTIFICATE OF CORRECTION

PATENT NO. : 6,769,763 B2
DATED : August 3, 2004
INVENTOR(S) : Tetsuji Kurata et al.

It is certified that error appears in the above-identified patent and that said Letters Patent is hereby corrected as shown below:

Title page,
Item [56], References Cited, U.S. PATENT DOCUMENTS, insert the following:

| | | |
|---|---|---|
| -- 4,339,761 | 7/1992 | Matsumoto, et al |
| 5,367,328 | 4/1994 | Erickson |
| 5,777,649 | 7/1998 | Otsuka, et al |
| 5,781,204 | 7/1998 | Kanematsu, et al |
| 6,019,452 | 2/2000 | Hirano, et al |
| 6,048,047 | 4/2000 | Terasawa, et al --. |

FOREIGN PATENT DOCUMENTS

| | | |
|---|---|---|
| -- 99/04551 | 4/1999 | PCT/WO --. |

Column 8,
Line 44, "screw 13106" should read -- screw B106 --.

Column 11,
Line 15, "recording-of" should read -- recording of --.

Signed and Sealed this

First Day of February, 2005

JON W. DUDAS
*Director of the United States Patent and Trademark Office*